US007942657B2

(12) United States Patent
Gray

(10) Patent No.: US 7,942,657 B2
(45) Date of Patent: May 17, 2011

(54) ROTARY COMBUSTION APPARATUS

(76) Inventor: David DuSell Gray, Sammamish, WA (US)

( * ) Notice: Subject to any disclaimer, the term of this patent is extended or adjusted under 35 U.S.C. 154(b) by 235 days.

(21) Appl. No.: 11/566,024

(22) Filed: Dec. 1, 2006

(65) Prior Publication Data

US 2007/0160487 A1 Jul. 12, 2007

Related U.S. Application Data

(60) Provisional application No. 60/742,092, filed on Dec. 1, 2005.

(51) Int. Cl.
*F01C 1/00* (2006.01)

(52) U.S. Cl. ..... 418/255; 418/254

(58) Field of Classification Search ..... 418/255, 418/11, 4, 63–66, 244, 112–124, 68, 75–82
See application file for complete search history.

(56) References Cited

U.S. PATENT DOCUMENTS 1,430,929 A * 10/1922 Yeatts ..... 60/316
1,686,569 A 10/1928 McMillan
1,802,887 A * 4/1931 Feyens ..... 418/54
2,091,120 A * 8/1937 Kinney ..... 123/235
2,462,732 A * 2/1949 Dusevoir ..... 418/135
2,827,025 A * 3/1958 Puim ..... 123/231
3,656,875 A 4/1972 Luck
3,690,791 A * 9/1972 Dieter et al. ..... 418/61.1
3,873,245 A * 3/1975 Doshi ..... 418/5
3,988,080 A * 10/1976 Takada ..... 418/76
3,996,901 A * 12/1976 Gale et al. ..... 123/242
4,008,982 A * 2/1977 Traut ..... 417/204
4,061,445 A * 12/1977 Doshi ..... 418/54
4,300,874 A * 11/1981 Georgiev ..... 418/54
4,484,873 A * 11/1984 Inagaki et al. ..... 418/150
4,519,206 A 5/1985 van Michaels
5,006,053 A * 4/1991 Seno ..... 418/150
5,131,270 A * 7/1992 Lew ..... 73/259
5,316,456 A * 5/1994 Eckhardt ..... 418/150
5,322,425 A * 6/1994 Adiwinata ..... 418/54
5,421,706 A * 6/1995 Martin, Sr. ..... 417/371
5,511,525 A * 4/1996 Jirnov et al. ..... 123/204
5,558,509 A * 9/1996 Jirnov et al. ..... 418/15
5,640,938 A * 6/1997 Craze ..... 123/222
5,711,265 A 1/1998 Duve ..... 123/190.2
5,755,197 A * 5/1998 Oplt ..... 123/239
5,758,501 A * 6/1998 Jirnov et al. ..... 60/670
5,937,820 A * 8/1999 Nagata et al. ..... 123/243
7,434,563 B2 * 10/2008 Kim ..... 123/242
7,549,850 B2 * 6/2009 Trapalis ..... 418/59

FOREIGN PATENT DOCUMENTS

CN 1374439 A 10/2002

* cited by examiner

*Primary Examiner* — Thomas Denion
*Assistant Examiner* — Douglas J. Duff
(74) *Attorney, Agent, or Firm* — Seed IP Law Group PLLC

(57) ABSTRACT

A combustion apparatus having a housing including an inner surface that defines at least one chamber, a rotor, a rotor shaft, an intake shaft, an exhaust shaft, and a gearing mechanism. The chamber includes an intake valve port and an exhaust valve port, and the rotor shaft is coupled to a gear at one end and has at least two opposing flat surfaces received by an opening in the rotor. The intake and exhaust shafts are geared to the rotor shaft and have at least one opening each that is aligned with the intake and the exhaust valve ports. A gearing mechanism selectively controls the duration in which the openings are aligned with the ports. Two or more rotors may be utilized to produce more power and reduce vibration.

21 Claims, 43 Drawing Sheets

ROTARY COMBUSTION APPARATUS

BACKGROUND OF THE INVENTION

1. Field of the Invention

The present invention is generally directed to engines utilizing rotary combustion architecture and, more particularly, to a rotary engine having a rotor and chamber arrangement with an effective constant diameter chamber and variable valve timing.

2. Description of the Related Art

Various designs have been proposed for utilizing a chamber and a rotor as compressors, engines, and measurement devices. For example, McMillan, U.S. Pat. No. 1,686,569, describes a rotary compressor; Moreover, Feyens, U.S. Pat. No. 1,802,887 is directed to a rotary compressor; and Luck, U.S. Pat. No. 3,656,875, also describes a rotary piston compressor.

Dieter, U.S. Pat. No. 3,690,791, pertains to a rotary engine having a radially shiftable rotor. The rotary engine includes a hollow housing having an irregular but generally cylindrical cavity therein and a shaft journalled through the cavity in off-center relation thereto. The curved walls of the housing define and extend about the cavity, gradually increasing and decreasing in radial distance from the axis of rotation of the shaft, however, the spacing between all working curved wall portions of the cavity lying at opposite ends of all diameters of the aforementioned axis is constant. An elliptical rotor is mounted on the shaft within the cavity for rotation with the shaft and for shifting radially off the axis of rotation of the shaft along a line extending between the vertices of the rotor while fuel mixture and exhaust by-products inlet and outlet and fuel mixture ignition are spaced about the outer periphery of the cavity. Also, the rotor and shaft define a rotary assembly having axially extending air passages therethrough opening through opposite ends of the housing with an air vane structure carried by one end of the rotary assembly operative to pump cooling air through the air passages in response to rotation of the assembly.

Furthermore, van Michaels, U.S. Pat. No. 4,519,206, describes multi-fuel rotary power plants using gas pistons, elliptic compressors, internally cooled thermodynamic cycles, and slurry type colloidal fuel from coal and charcoal. These rotary power plants are designed for universal application, such as engines for large industrial compressors, cars, electrical power plants, marine and jet propulsion engines.

Lew, U.S. Pat. No. 5,131,270, is directed to a sliding rotor pump-motor-meter for generating and measuring fluid flow and generating power from fluid flow. The design includes two combinations of a cylindrical cavity and a divider member rotatably disposed in the cylindrical cavity about an axis of rotation parallel and eccentric to the geometrical central axis of the cylindrical cavity. The divider member extends across the cylindrical cavity on a plane including the axis of rotation in all instances of rotating movement thereof, and a rotary motion coupler for coupling rotating motions of the two divider members in such a way that a phase angle difference of ninety degrees in the rotating motion is maintained between the two divider members. Fluid moving through the two cylindrical cavities and crossing each plane, including the geometrical central axis and the axis of rotation in each of the two cylindrical cavities, relates to rotating motion of the two divider members.

Despite the various designs for engines that utilize a rotor instead of a piston, challenges continue to exist with such designs. For example, rotary engines are typically less efficient than piston engines and involve reciprocating motion, complicating the manufacturing and maintenance of such engines. Existing designs also tend to vibrate as a result of the centrifugal forces created by the rotation of the rotor. Furthermore, related designs generally do not provide for selective control over air and fuel intake of rotary engines because a continuously rotating rotor defines the air and fuel intake amounts.

There is a need for a rotary engine that is fuel efficient, produces more power, is easier to manufacture, provides more control over the air and fuel intake, and exhibits less vibration than existing engines.

BRIEF SUMMARY OF THE INVENTION

In accordance with one embodiment of the invention, a rotary engine is provided that includes a generally cylindrical housing having an outer surface and an inner surface, the inner surface defining at least one chamber having a constant diameter, varying radii about a center of origin, an intake valve port, and an exhaust valve port; a rotor having an axis of rotation and an elongate opening, a first end, and a second end, wherein the first end and the second end are rotatably and sealingly in contact with the inner surface; and a rotor shaft having one end slidably received in the elongate opening of the rotor.

In accordance with another embodiment of the invention, a rotary engine is provided that includes a cylindrical housing having at least two end walls, an outer surface, and an inner surface, the inner surface defining a chamber having an intake valve and an exhaust valve; a first shaft having at least two opposing flat surfaces, a first end, and a second end; means for producing a combustive force from igniting fuel and air received in the intake valve port; at least one rotor having a first end, a second end, and an elongated opening adapted to slidably receive the flat surfaces of the first shaft, wherein the rotor is operable to rotate in response to the combustive force, and the first end and the second end of the rotor are rotatably and sealingly in contact with the inner surface of the housing; a second shaft having at least one opening extending laterally therethrough, a first end, and a second end, wherein the first end is rotatably mounted on an end wall of the housing, and the opening is positionable adjacent the intake valve of the chamber; a third shaft having at least one opening extending laterally therethrough, a first end, and a second end, wherein the first end is rotatably mounted on an end wall of the housing and the opening is positionable adjacent the exhaust valve of the chamber; and means for rotating the second shaft and the third shaft, respectively aligning the openings in the second shaft and the third shaft with the intake valve port and the exhaust valve port, in an alternating pattern.

BRIEF DESCRIPTION OF THE SEVERAL VIEWS OF THE DRAWING(S)

DETAILED DESCRIPTION OF THE INVENTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures or components or both associated with engine components and other devices including but not limited to ignition devices, distributor devices, steam generators, or condensers have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Reference throughout this specification to "expansion", "combustion", "expansion cycle" or "combustion cycle" is not intended in a limiting sense, but is rather intended to refer to any cycle or state that exhibits expansive or combustive properties, or that is descriptive of converting air and fuel to energy, or in which air and fuel are ignited. "Fluid" as used herein includes liquid, gas, and a mixture of liquid and gas.

Figure 1:
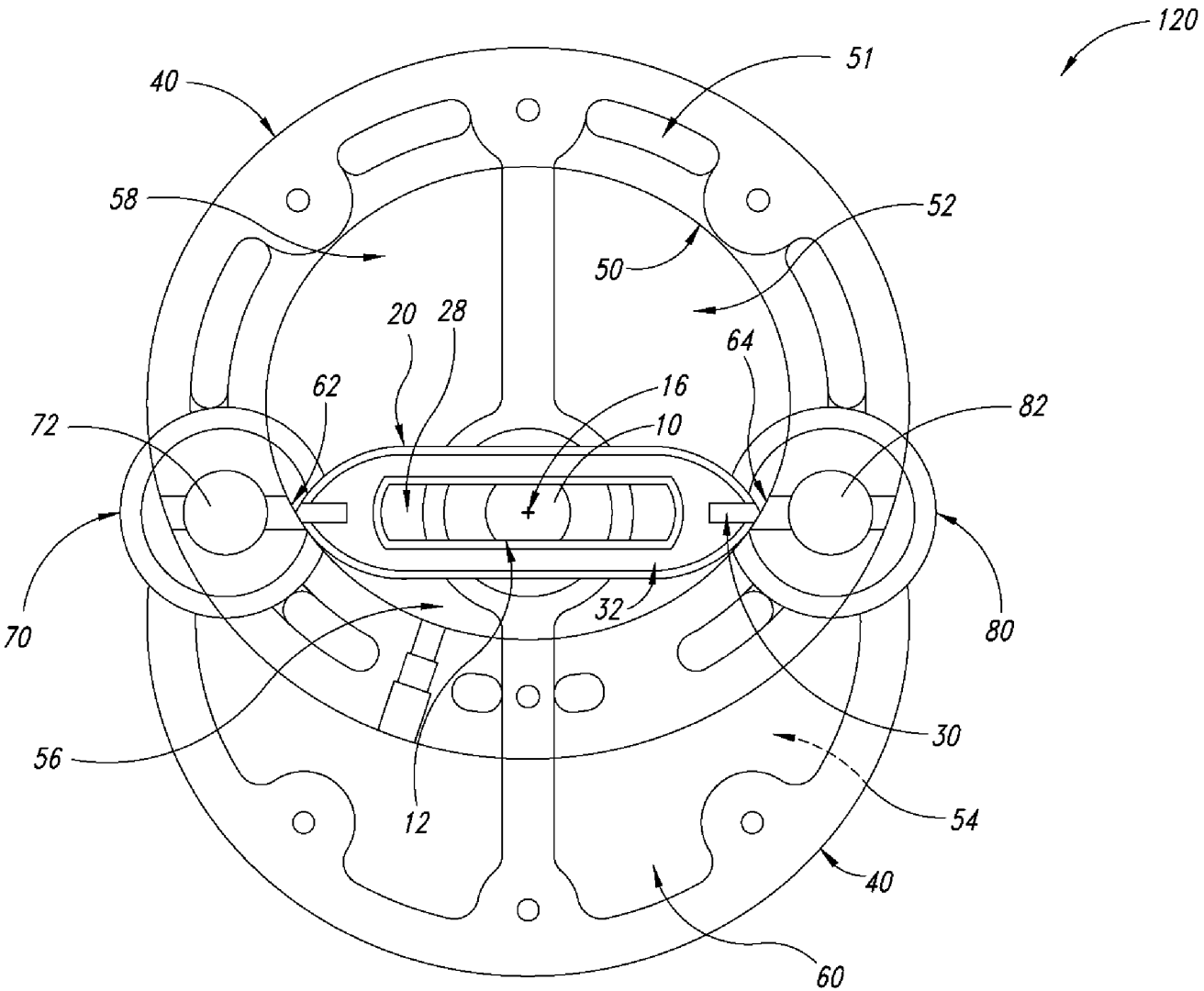
FIG. 1 is a cross-sectional view of a rotary engine provided in accordance with one embodiment of the present invention.
Figure 7:
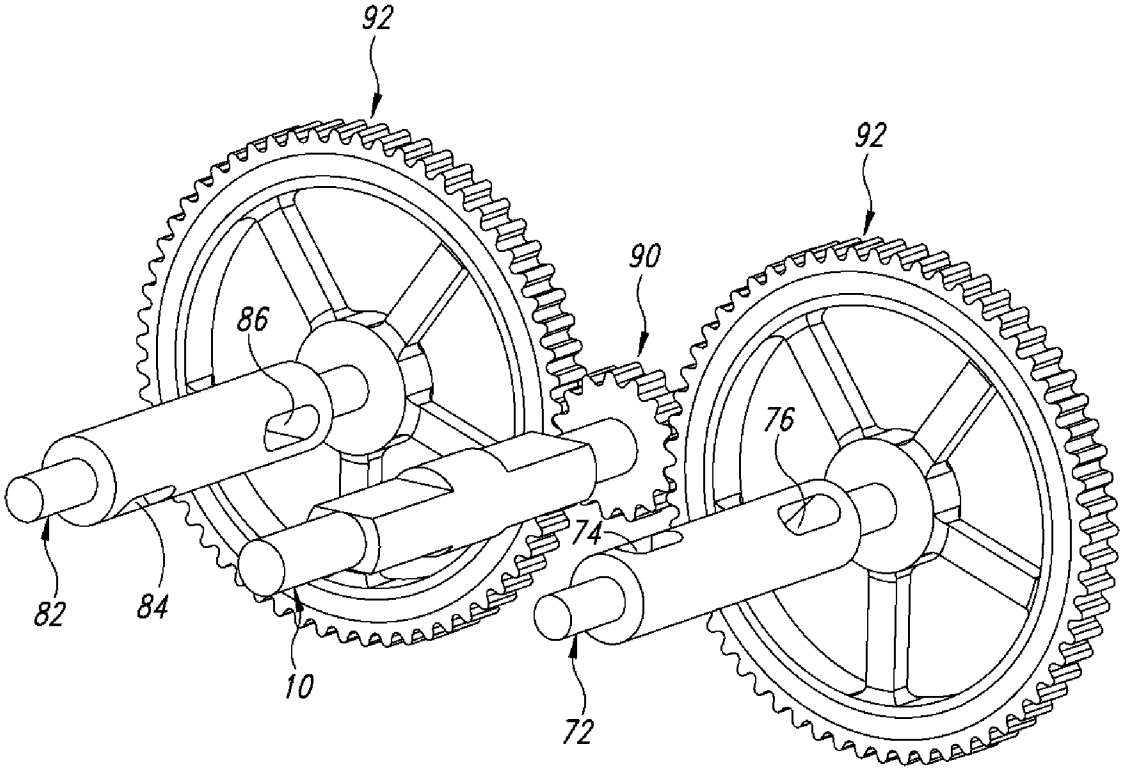
FIG. 7 is an isometric view of a rotor shaft and two valve shafts provided in accordance with an embodiment of the present invention.

In one embodiment shown in FIG. 1, the present design provides a rotary engine 120 made up of seven major components: a rotor shaft 10, at least one rotor 20, rotor seals 30, 32, a rotor housing 40, a rotary intake valve 70, a rotary exhaust valve 80, and rotary valve gears 90, 92 shown in FIG. 7. The gears 90, 92 can include a spur gear or other intermittent gearing known to those skilled in the art.

Figure 2A:
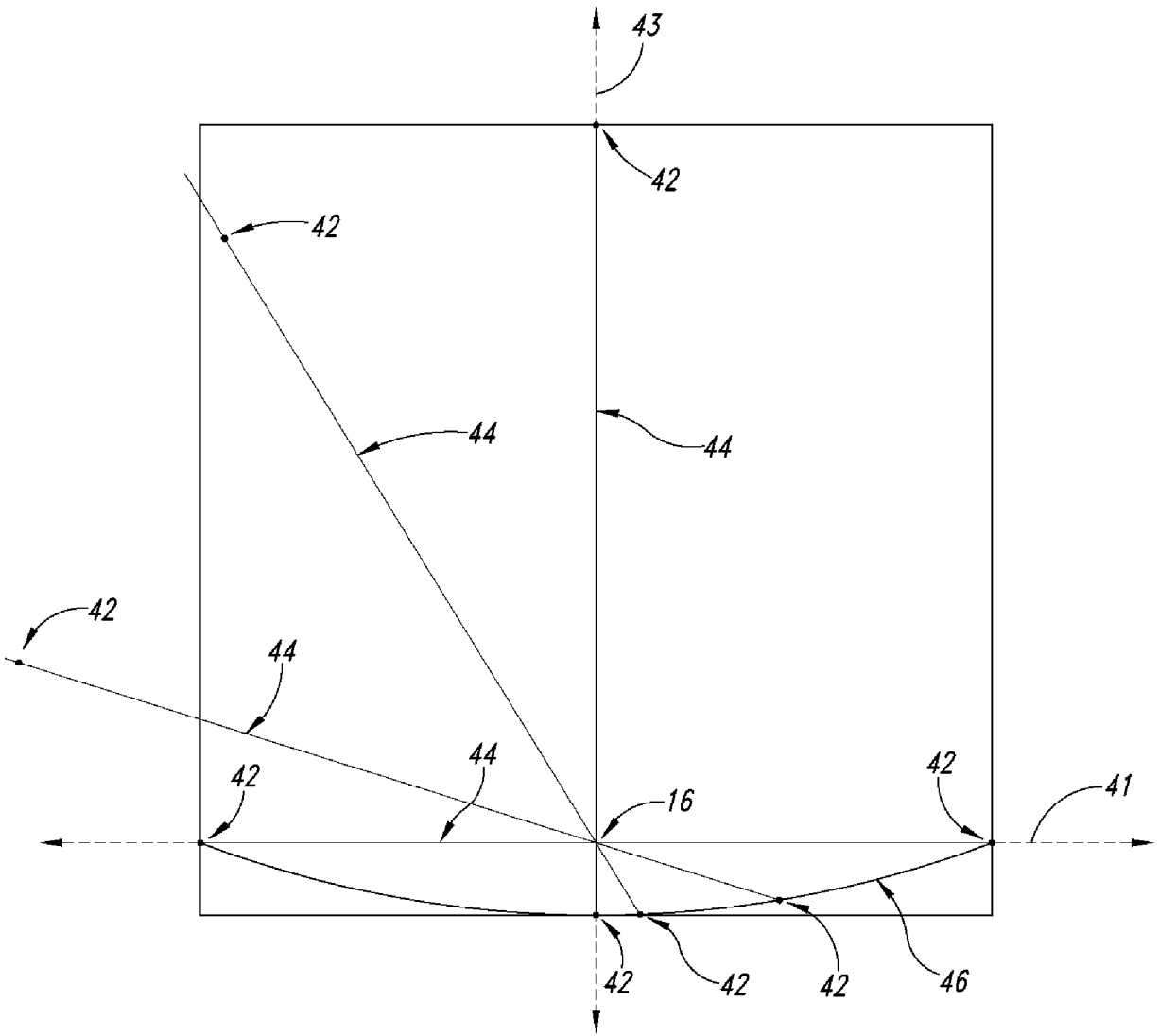
FIG. 2A is a planar view of a method of generating a shape of an inner surface of a rotor housing of the rotary engine illustrated in FIG. 1.

As shown in FIG. 2A, a series of points 42 determines a unique contour of an inner surface 50 of the rotor housing 40 shown in FIG. 1. The points 42 are generated by the ends of a line segment 44, which has a length equal to the length of the rotor 20. The other ends of the line segment 44 trace a curve 46 that forms one segment of the contour of the inner surface 50. The center of rotation of the rotor shaft 10 and the center of rotation of the rotor 20 is the origin 16. The inner surface 50 of the rotor housing 40 has a variable radius with respect to the origin 16 but a constant diameter, which corresponds to the length of the rotor 20. The radius of the inner surface 50 of the rotor housing 40 is the distance from the origin 16 of the inner surface 50 to a point 42 on the inner surface 50 of the rotor housing 40. The radius defined by the inner surface 50 of the rotor housing 40 and the rotor 20 as it rotates and slides about the origin 16 in the rotor housing 40 will vary continuously. When any two opposite radii are added together they will equal the length of the rotor 20, and hence the diameter of the rotor chamber 52.

Figure 2B:
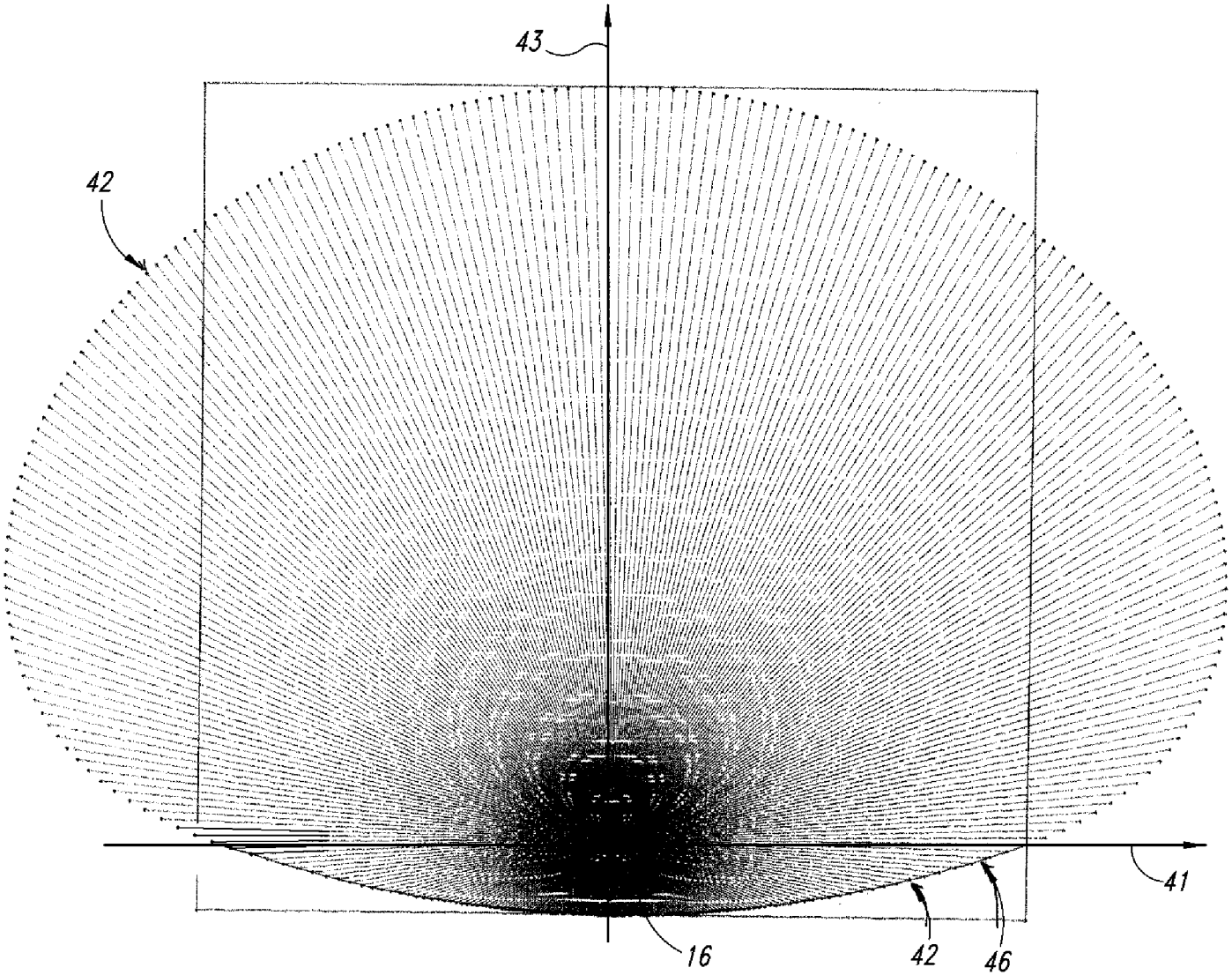
FIG. 2B is a view of the inner surface generation of FIG. 2A.

As shown in FIG. 2B, the curve 46 that determines the shape of the inner surface 50 of the rotor housing 40 can be a chord or segment of a circle, a parabola, an ellipse, or any other curve that satisfies the relationship described above and results in a desired performance of the rotary engine 120. The shape of the curve 46 determines the shape of the inner surface 50 of the rotor housing 40, which along with the shape of the rotor 20 determines the shape of the chamber 52 shown in FIG. 1.

As illustrated in FIG. 1, the inner surface 50 and at least two end walls 60 of the rotor housing 40 form two rotor chambers 52, 54. The shape of the rotor chamber 52, where the combustion of the air-fuel mixture occurs, determines the fuel combustion efficiency and hence the fuel efficiency of the rotary engine 120. Different fuels may require rotor chambers 52, 54 of different shapes in order to obtain the most efficient combustion.

Referring to FIGS. 2A and 2B, the center of origin 16 is also where a first axis 41 and a second axis 43, perpendicular to the first axis 41, intersect. The inner surface 50 of the rotor housing 40, shown in FIG. 1, is not symmetrical about the first axis 41 and need not be symmetrical about the second axis 43. As shown in FIG. 2A, both the first axis 41 and the second axis 43 run through the center of origin 16 of the inner surface 50 of the rotor housing 40 shown in FIG. 1. The distance the end point 42 of the line segment 44 travels from the center of origin 16 towards the inner surface 50 as the line segment 44 rotates around the center of origin 16 determines the contour of the inner surface 50 of the rotor housing 40. The greater this distance, the more radical and less circular the inner surface 50 of the rotor housing 40 becomes.

The displacement of the rotary engine 120 is determined by the shape of the inner surface 50 of the rotor housing 40 and the width and shape of the rotor 20. The displacement is the volume of the rotor chamber 52 that is created by the top surface of the rotor 20 and the inner surface 50 of the rotor housing 40 when the rotor 20 is parallel to the first axis 41 in the rotor housing 40.

The placement of the rotor shaft 10 in the rotor housing 40, the shape of the inner surface 50, and the shape of the rotor 20 are major factors in determining the compression ratio of the rotary engine 120. The compression ratio of the rotary engine is the ratio between the maximum area of increasing volume 56 in the rotor chamber 52 and the minimum area of decreasing volume 58 in the rotor chamber 52. The distance the center of the rotor 20 moves from the center of the rotor shaft 10 as the rotor 20 rotates around the inner surface 50, along with the shape of the inner surface 50 and the shape of the rotor 20, determine the compression ratio of the rotary engine 120. The greater the distance the center of the rotor 20 moves from center of rotation or origin 16 of the rotor shaft 10, the greater the compression ratio of the rotary engine.

A cooling agent such as water or air, depending on the application for which the engine 120 is used, can be used to cool the rotor housing 40. Air-cooled or water-cooled designs can be used to obtain maximum performance for different applications of the engine. The illustrated embodiment of FIG. 1 shows a water-cooled version of the engine 120 having at least one water jacket or chamber 51. In the air-cooled version, the water chambers 51 would be replaced by air-cooling fins mounted on the exterior of the rotor housing 40.

In one embodiment shown in FIGS. 3A through 3E, the rotary engine 120 has a rotor shaft 10 made up of have a round or cylindrical shaft body 11 with an enlarged rotor guide 13 section formed thereon. The shaft 11 has a circular cross-sectional configuration with the enlarged rotor guide 13 having a pair of mutually-opposing planar surfaces 12 where the rotor 20 slides back and forth. These flat surfaces 12 provide positive engagement between the rotor 20 and the rotor shaft 10 as the rotor 20 reciprocates when it rotates during the operating cycle. Thus, these flat surfaces 12 guide the rotor 20 in a translational movement that is perpendicular to the axis of the shaft 11 as the shaft 11 is rotating in the rotor chamber 52. The rotor shaft 10 is rotates about the origin 16 in the chamber 52.

In the embodiment illustrated in FIGS. 3A-3E, to reduce friction, the rotor shaft 10 can be mounted on a plurality of ball bearings or roller bearings 14 in the end walls 60 of the rotor housing 40. As shown in FIG. 1, the flat surfaces 12 on the rotor guide 13 fit through a rectangular opening 28 in the rotor 20 shown in FIG. 11. The rotor shaft bearings 14 fit on the round end sections of the cylindrical shaft 11.

Figure 4A:
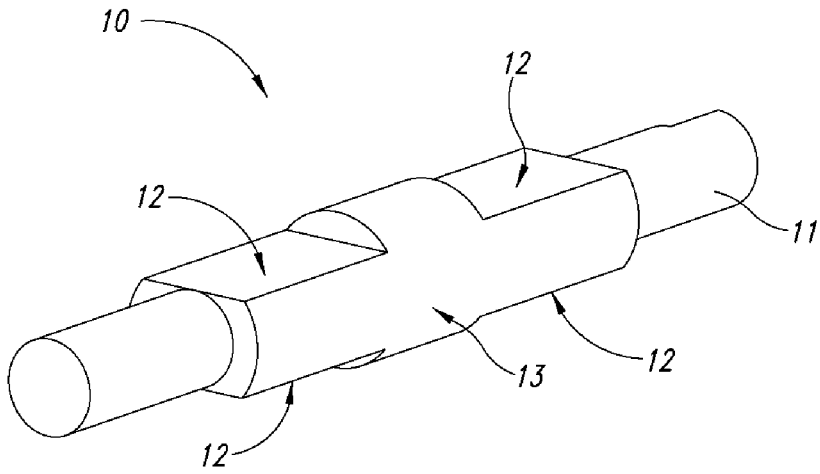
FIG. 4A is an isometric view of a rotor shaft provided in accordance with one embodiment of the present invention.
Figure 4B:
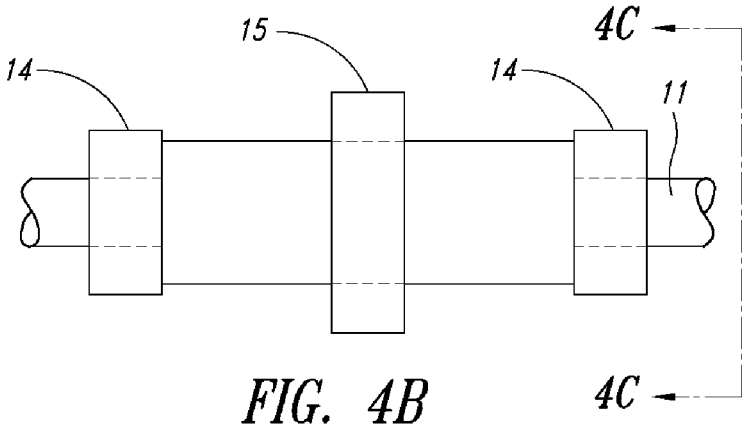
FIGS. 4B-4E are top, side, and corresponding cross-section views of a rotor shaft with a plurality of bearings provided in accordance with one embodiment of the present invention.
Figure 4C:
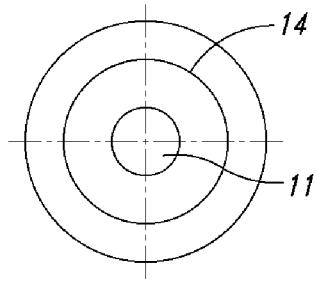
Figure 4D:
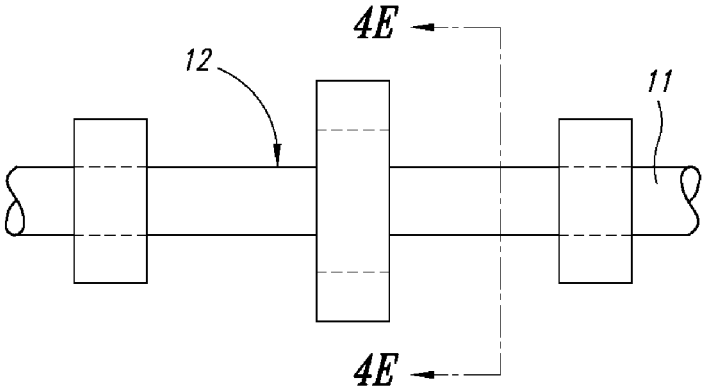
Figure 4E:
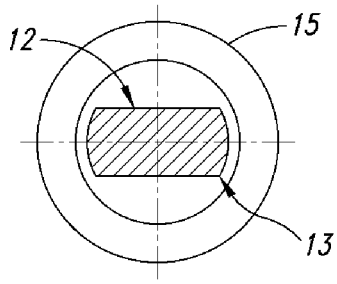

In another embodiment, discussed in more detail below in conjunction with FIG. 12, the rotary engine can have two rotors 20, 22 mounted on flat surfaces 12 formed on opposing ends of the rotor shaft 10, as shown in FIG. 4A. The rotors 20, 22 turn the rotor shaft 10 as the rotors 20, 22 rotate around their respective rotor chambers 52, 54 shown in FIG. 1, during the operating cycle. The rotors 20, 22 slide back and forth across the flat surfaces 12 of an enlarged rotor guide 13 formed on the cylindrical shaft 11 of the rotor shaft 10, moving perpendicular to the axis of the rotor shaft 10. Preferably the rotor guide 13 is integrally formed on the shaft 11, although it may be a discrete component that is mounted on or attached to the cylindrical shaft 11 in a conventional manner.

In the embodiment illustrated in FIGS. 4A-4E, to reduce friction, the rotor shaft 10 can be mounted on a plurality of ball bearings or roller bearings 14, 15 in the end walls 60 of the rotor housing 40, shown in FIG. 1. As shown in FIG. 1, the flat surfaces 12 on the rotor guide 13 fit through a rectangular opening 28 in the rotors 20, 22, shown in FIG. 12. The rotor shaft bearing 15 with a larger inner raceway diameter is mounted at the center of the cylindrical shaft body 11. The larger diameter raceway allows the bearing 15 to slide over the rectangular surfaces 12 of the rotor shaft 10. The rotor shaft bearings 14 fit on the round end sections of the cylindrical shaft 11.

In the embodiment shown in FIGS. 5A through 5E, the rotary engine 120 includes the rotor shaft 10 having the round or cylindrical shaft body 11 and rotor guide 13 the opposing flat surfaces 12 formed on the shaft 11 where a plurality of rotors 20, 22 (shown in FIG. 12) slide back and forth. Here, the bearing member 15 is not used, and the rotor shaft 10 can be of rectangular cross section with opposing flat surfaces 12 on the rotor guide 13 where the rotors 20, 22, shown in FIG. 12, mount on the rotor shaft 10. These flat surfaces 12 guide the translational movement of the rotors 20, 22 on the rotor shaft 11 as the rotors 20, 22 rotate in the rotor chambers 52, 54 during the operating cycle. These flat surfaces 12 also allow the rotors 20, 22 to slide across the flat surfaces 12 of the rotor shaft 11, moving perpendicular to the axis of the rotor shaft 11 as the rotors 20, 22 turn the rotor shaft 11.

The rotor shaft 11 is located at the origin 16 of the inner surface of the rotor housing 50, which is also the center of rotation for the rotors 20, 22. As illustrated in FIG. 5B, embodiments of the present invention with rectangular rotor shafts 11 can have bearings with modified inner raceways 18 that fit over the rectangular section of the rotor shaft 11, i.e., the inside surface of the inner raceway 18 has a rectangular cross-sectional configuration. Bearings with modified inner raceways 18, illustrated in FIG. 5B, would be used in embodiments having multiple rotor pairs 20, 22, as shown in FIG. 12, to accommodate the flat surfaces 12 of the rotor shaft 11. A completely rectangular rotor shaft 11 can be used by mounting the rotor shaft 11 in the end walls 60 of the rotor housing 40 using only bearings with the special inner raceway 18, as shown in FIG. 5B.

Figure 5A:
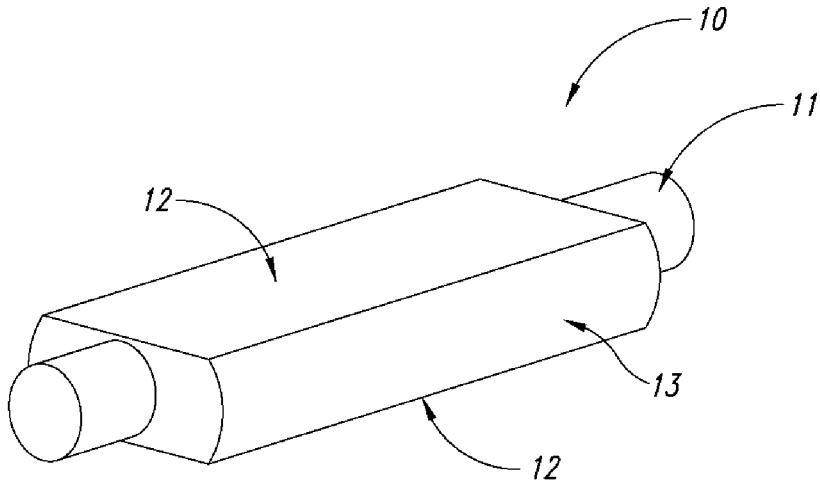
FIG. 5A is an isometric view of a rotor shaft provided in accordance with one embodiment of the present invention.
Figure 5B:
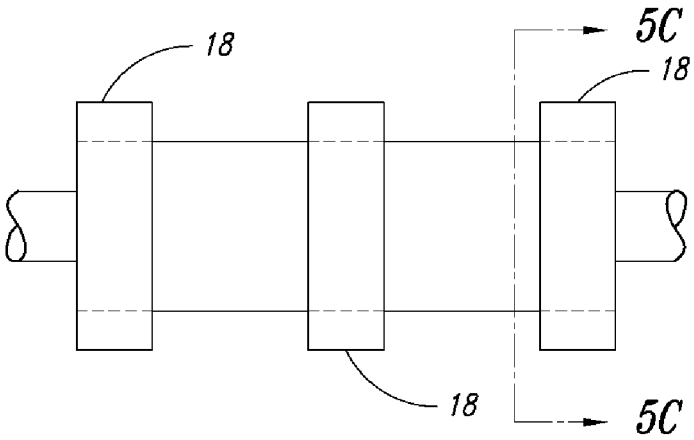
FIGS. 5B-5E are top, side, and corresponding cross-section views of a rotor shaft with a plurality of bearings provided in accordance with one embodiment of the present invention.
Figure 5C:
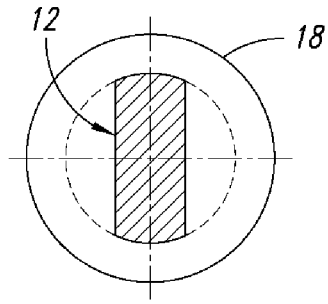
Figure 5D:
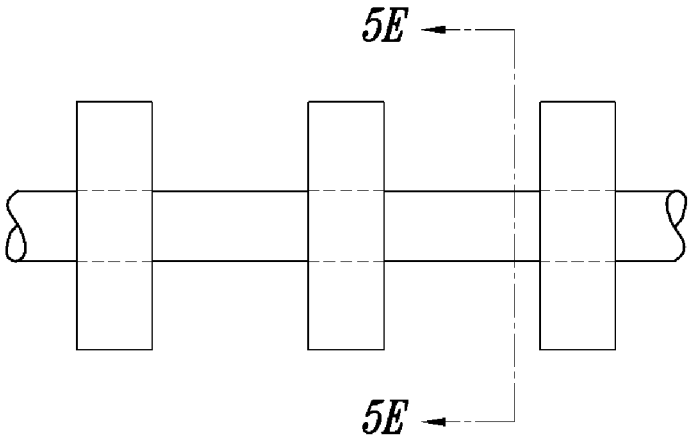
Figure 5E:
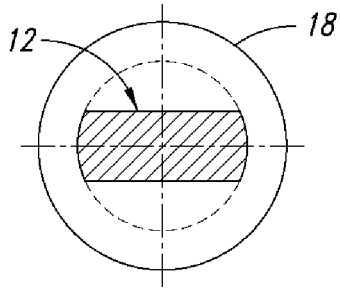
Figure 12:
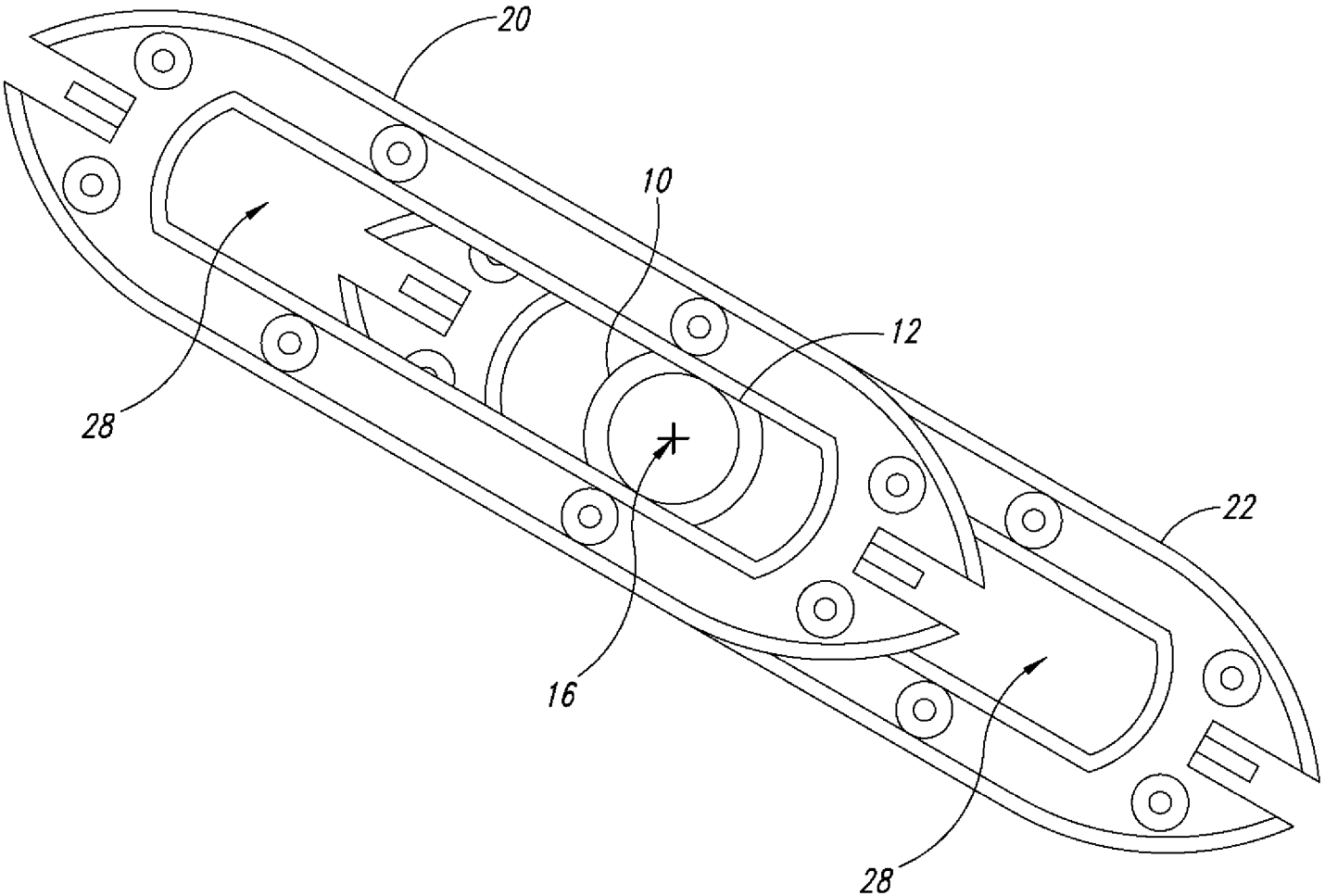
FIG. 12 is a side view of two rotors provided in accordance with another embodiment of the present invention.

In one of the embodiments of the present invention having multiple rotor pairs 20, 22, as shown in FIG. 12, bearings with modified inner raceways 18 will be used, which fit over the rectangular sections 12 on the rotor shafts 10 shown in FIG. 5A. A rectangular enlarged section 13 on the rotor shaft 11 can be used by mounting the rotor shaft 10 in the end walls 60, shown in FIG. 1, of the rotor housing 40 using only bearings with the special inner raceway 18.

To lubricate the flat surfaces 12 of the rotor shaft 10 on which the rotors 20, 22 are mounted, a small diameter hole (not shown) may be bored in the center 16 of the rotor shaft 10. Lubricant is pumped through this hole and onto the flat surfaces 12 of the rotor shaft 10 to lubricate the flat surfaces 12 on which the rotors 20, 22 move.

As further illustrated in FIG. 1, the engine 120 has an intake valve port 62 and an exhaust valve port 64 located on opposite sides of the rotor housing 40. Preferably, the valve ports 62, 64 in the rotor housing 40 are rectangular in shape with rounded corners, although other known shapes may be used. The large rectangular shape allows for a greater quantity of air to enter into and exhaust from the chamber 52, giving the engine 120 better combustion, greater power, and greater fuel efficiency.

Figure 6A:
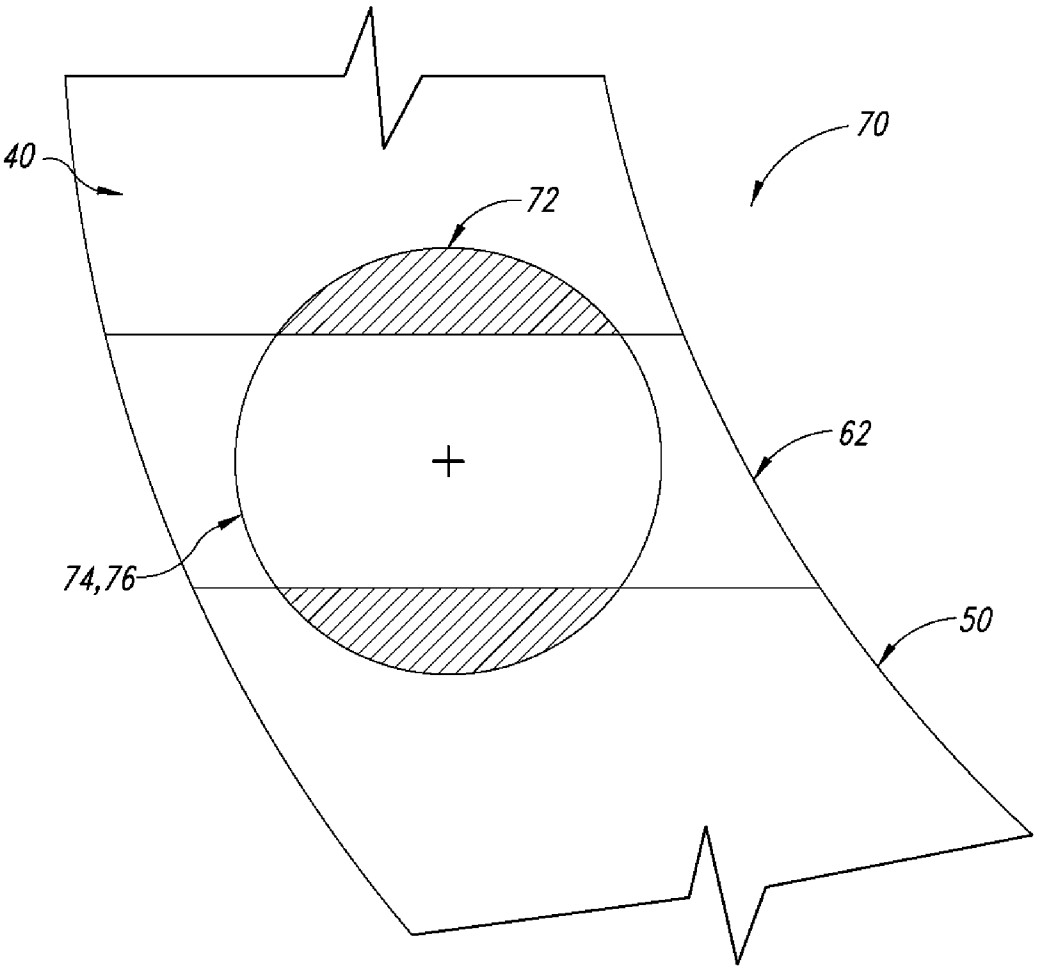
FIG. 6A is a cross-sectional view of a valve of a rotary engine in an open configuration, provided in accordance with an embodiment of the present invention.
Figure 6B:
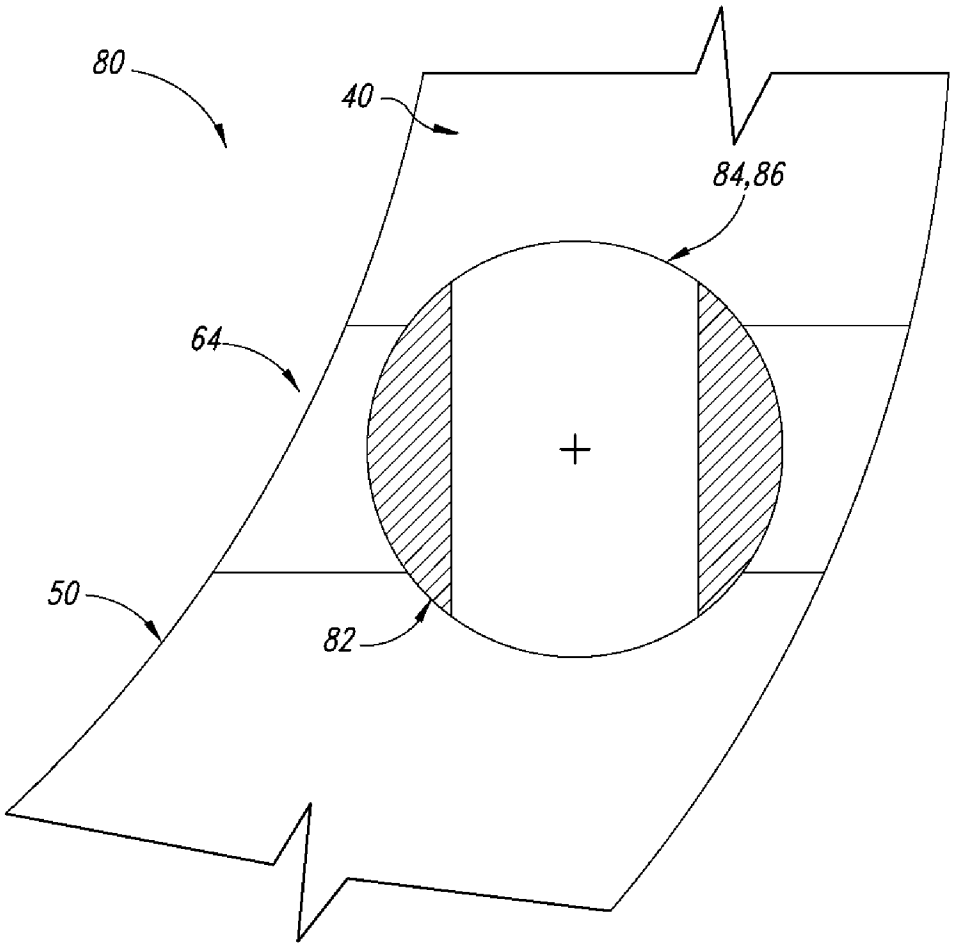
FIG. 6B is a cross-sectional view of a valve of a rotary engine in a closed configuration, provided in accordance with an embodiment of the present invention.

As illustrated in FIGS. 6A and 6B, the engine 120 has a rotary intake valve 70 and a rotary exhaust valve 80 mounted on either side of the rotor housing 40. Two valve shafts 72, 82, illustrated in FIG. 7, are associated with the respective rotary valves 70, 80. The valve shafts 72, 82 are parallel to and in the same plane as the main rotor shaft 10 and are mounted in the intake valve port 62 and exhaust valve port 64, respectively, of the rotor housing 40. Valve shaft openings 74, 76, 84, 86, are formed perpendicular to the axis of the valve shafts 72, 82 and extend entirely through the valve shafts 72, 82, preferably at a right angle to the axis of the valve shafts 72, 82.

The length of the valve shaft openings 74, 76, 84, 86 is approximately the same as the width of the rotors 20, 22 and can vary in width depending on the diameter of the valve shafts 72, 82. To reduce friction, the valve shafts 72, 82 can be mounted on ball bearings or roller bearings located in the end walls 60 of the rotor housing 40. The intake valve port 62 and the exhaust valve port 64, located on opposite sides of the rotor housing 40, are illustrated in FIGS. 6A and 6B. As the valve shafts 72, 82 rotate, the valves 70, 80 open and close by aligning the openings 74, 76, 84, 86 in the valve shafts 72, 82 with the respective air intake port 62 and exhaust port 64 in the rotor housing 40. When the openings 74, 76, 84, 86 are aligned with the intake and exhaust ports 62, 64 as shown in FIG. 6A, fluid, gas, liquid, or a mixture of gas and liquid can flow through the rotary valves 70, 80 into and out of the chamber. When the holes are not aligned, the valves 70, 80 are closed, as shown in FIG. 6B, and fluid cannot flow into or out of the chamber.

In certain embodiments the engine 120 has two rotors 20, 22, shown in FIG. 12, that are mounted in parallel on the rotor shaft and located one behind the other in separate rotor chambers 52, 54 in the rotor housing 40, as shown in FIG. 1. To provide for the two rotors 20, 22, there are four valve shaft openings 74, 76, 84, 86 cut through the valve shafts 72, 82 one behind the other. The valve shaft openings 74, 76, 84, 86 run from side to side through the valve shafts 72, 82. The valve shaft openings 74, 76, 84, 86 form passages for the air and exhaust gases to flow to and from the rotor chambers 52, 54.

As illustrated in FIG. 7, the four valve shaft openings 74, 76, 84, 86 are identical but oriented at different angles from each other along the axis of the rotary valve shafts 72, 82, and they are perpendicular to the longitudinal axis of the rotary valve shafts 72, 82.

The spur gears 92 are mounted on each valve shaft 72, 82 that are driven by a single drive gear 90 mounted on the rotor shaft 10. As the rotor shaft 10 is turned by the rotors 20, 22, the gear 92 engages the valve shafts 72, 82 and the valve shafts 72, 82 are turned, opening and closing the rotary valves 70, 80. Other suitable gears or timing belts and pulleys can be used to rotate the rotary valve shafts 72, 82 continuously.

The shape of the valve shaft openings 74, 76, 84, 86 in the valve shafts 72, 82, the width of the valve ports 62, 64 in the rotor housing 40, shown in FIGS. 6A and 6B, and the speed of rotation of the valve shafts 72, 82 determine how long the rotary valves 70, 80 will remain open or closed. Hence, these parameters determine the performance of the rotary valves 70, 80. As the rotor 20, shown in FIG. 1, rotates the rotor shaft 10, the rotor shaft 10 rotates the gear 90 mounted on the rotor shaft 10. The rotor shaft gear 90 simultaneously rotates the spur gear 92 mounted on the intake valve shaft 72 and the spur gear 92 mounted on the exhaust valve shaft 82.

Preferably, the gears 92 mounted on the intake and exhaust valve shafts 72, 82 rotate one time to four rotations of the gear 90 mounted on the rotor shaft 10. Thus, when the rotor 20 and rotor shaft 10 turn 360 degrees, the intake valve shaft 72 and exhaust valve shaft 82 will turn 90 degrees. The shape of the intake valve port 62 and exhaust valve port 64 in the rotor housing 40, shown in FIGS. 6A and 6B, and the shape of the valve shaft openings 74, 76 in the intake valve shaft 72 and the valve shaft openings 84, 86 in the exhaust valve shaft 82 are such that the intake valve 70 and the exhaust valve 80 will open or close every time the rotor 20 and rotor shaft 10 rotate 180 degrees. By rotating the intake valve shaft 72 and the exhaust valve shaft 82 continuously, the engine 120 will run smoother with less vibration than a conventional piston engine or other rotary engines with standard valving mechanisms.

Figure 8:
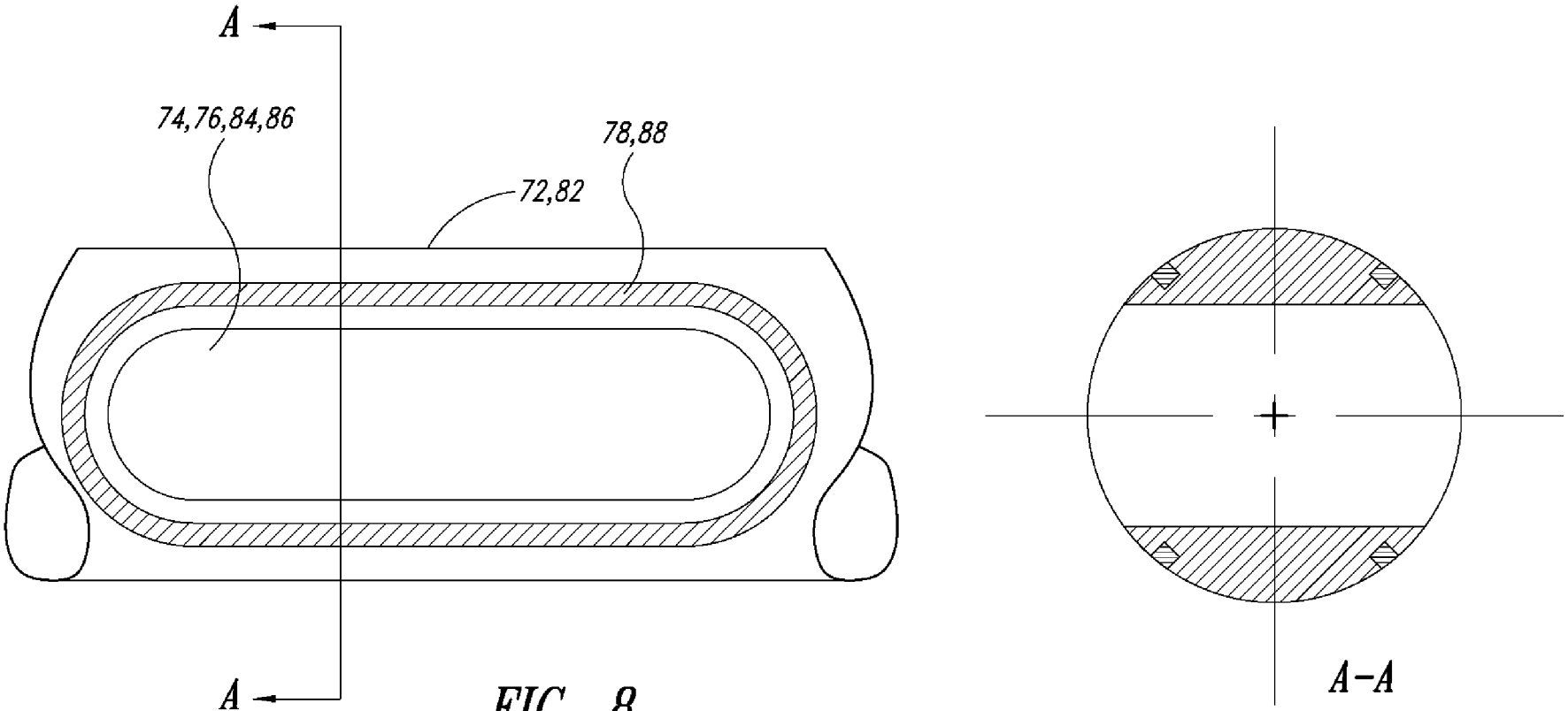
FIG. 8 is a side view of a valve shaft, illustrating a valve shaft opening having a valve seal provided in accordance with an embodiment of the present invention.

In an embodiment of the present invention illustrated in FIG. 8, valve seals 78, 88 are mounted in grooves cut around the openings 74, 76, 84, 86 in the valve shafts 72, 82. There are also grooves cut along the top and bottom of the valve shafts 72, 82. These seals 78, 88, preferably made of wear and heat resistant material, are spring loaded to remain in constant contact with the sides of the rotary valve ports 62, 64 and automatically adjust for wear.

Figure 9B:
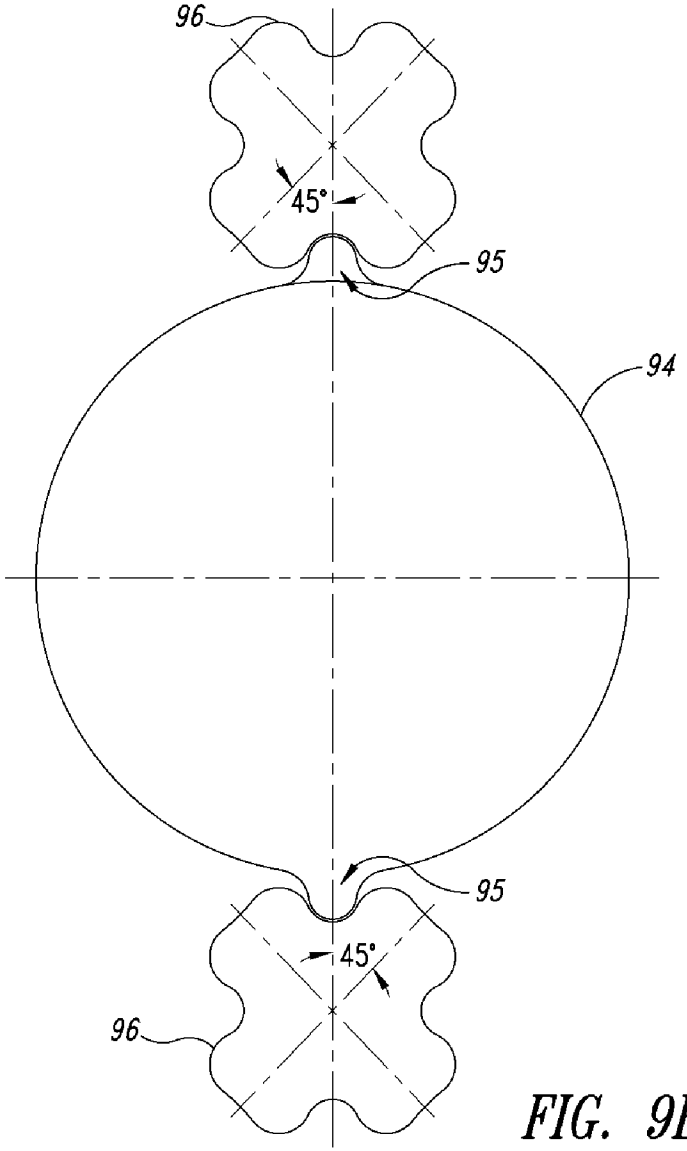
FIG. 9B is a partial front view of the rotary engine of FIG. 9A.
Figure 9A:
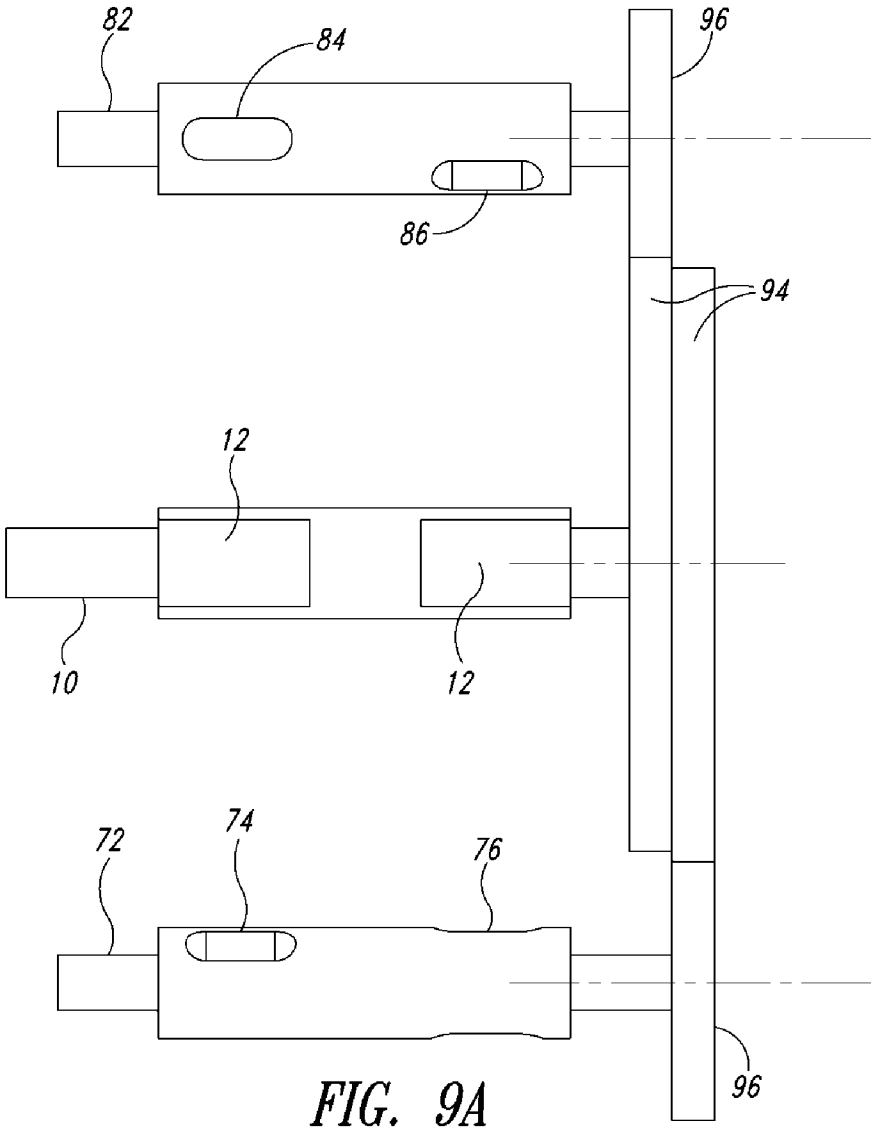
FIG. 9A is a partial top view of a rotary engine provided in accordance with another embodiment of the invention, illustrating a rotor shaft, two valve shafts, and intermittent rotating gears.

In yet a further embodiment illustrated in FIGS. 9A and 9B, an intermittent gearing configuration using two continuously rotating single toothed spur gears 94 driving two intermittently rotating gears 96 are used to open and close the intake valve 70 and exhaust valve 80 quickly. The intermittently rotating intake valve shaft 72 and the intermittently rotating exhaust valve shaft 82 will remain in the full open or full closed position longer than the continuously rotating intake valve shaft 72 and the continuously rotating exhaust valve shaft 82. By remaining open longer, the intake valve 70 and exhaust valve 80 allow more fluid to enter the rotor chamber 52 in a given amount of time and more fluid to be exhausted from the rotor chamber 52 in a given amount of time, thereby increasing the fuel efficiency and decreasing the fuel consumption of the engine 120.

Figures 10A, 10B, 10C:
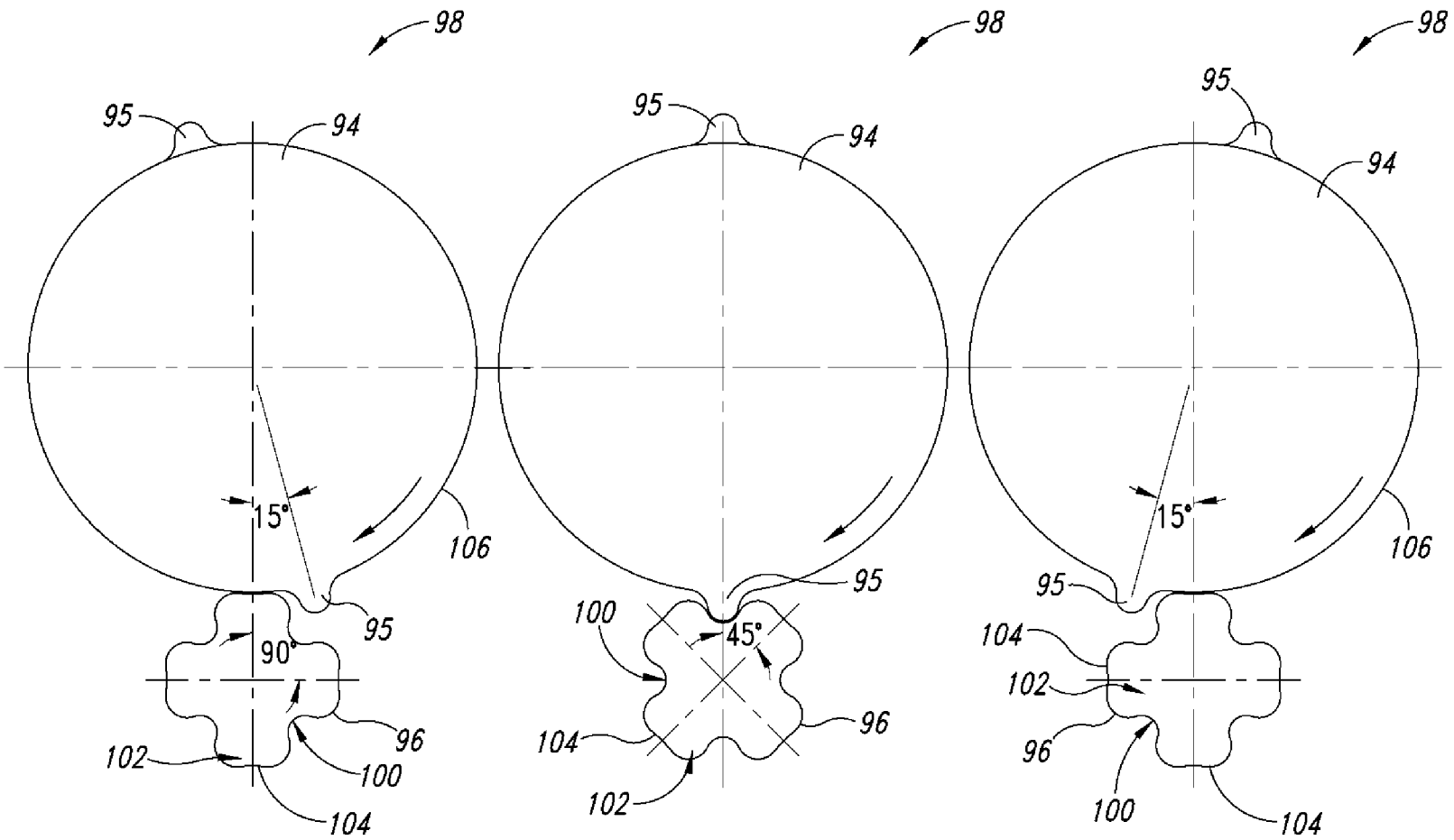
FIGS. 10A-10C are a series of partial front views of intermittent rotating gears provided in accordance with yet another embodiment of the present invention.

The two identical continuously rotating single toothed driver gears 94 are shown mounted on the rotor shaft 10 with their single teeth 95 oriented 180 degrees apart from each other. The first driven gear 96 is attached to the intake valve shaft 72 and the second driven gear 96 is attached to the exhaust valve shaft 82. These driven gears 96 rotate the intake valve shaft 72 and the exhaust valve shaft 82 to either the open or closed position. Referring to FIGS. 10*a* to 10*c*, as the driver gears 94 mounted on the rotor shaft 10 rotate through a small arc of approximately 20 to 30 degrees, the single tooth 95 of the driver gears 94 engage the driven gears 96 and rotate them 90 degrees. After rotating 90 degrees the driven gear 96 remains locked in position by the single toothed driver gear 94 until the driver gear 94 rotates 360 degrees and engages the driven gear 96 and repeats the cycle. Because the two single toothed driver gears 96 are oriented 180 degrees from each other, they counter balance the force generated by the single tooth of each gear as it rotates. In other embodiments, a single continuously rotating driver gear 94 rotating at half the speed of the rotor shaft 10 with two teeth located 180 degrees from each other could also be used to rotate the driven intermittent rotary valve gears 96.

As illustrated in FIG. 10A, the driver gear 94 has one tooth which engages a plurality of spaces 100 between a plurality of gear lobes 102 of the intermittent driven gear 96. The driver gear 94 is a round disc with a single gear tooth protruding from it. Other than the single tooth the driver gear 94 is round and smooth with only the single gear tooth extending from its surface. In the illustrated embodiment of FIGS. 10A to 10C, the driven gear 96 has four spaces 100 that engage the tooth of the driver gear 94. Between the four spaces 100 that engage the driver gear 94 are four specially shaped gear lobes 102. These four specially shaped gear lobes 102 engage the smooth round surface 106 of the driver gear 94 during the portion of its rotation when the driver gear 94 tooth 95 is not engaging the space between the gear lobes 102 of the driven gear 96. An outer surface 104 of the gear lobes 102 of the driven gear 96 engages the round surface 106 of the driver gear 94 as it rotates. This action locks the driven gear 96 into position so that it cannot rotate until the tooth 95 of the driver gear 94 rotates and engages the space 100 between the gear lobes 102 of the driven gear 96.

An embodiment of the engine 120 with intermittent rotation of the intake valve shaft 72 and exhaust valve shaft 82 may vibrate more than an engine with continuous rotation of the intake valve shaft 72 and exhaust valve shaft 82. However, intermittent rotation of the intake valve shaft 72 and exhaust valve shaft 82 may result in greater operating performance and greater fuel efficiency of the engine 120. In other embodiments, driver gears 94 and driven gears 96 with several teeth may be used instead of single toothed gears in order to dampen and eliminate the vibration caused by the single toothed driver gear 94 as it engages the driven gear 96.

Figure 11:
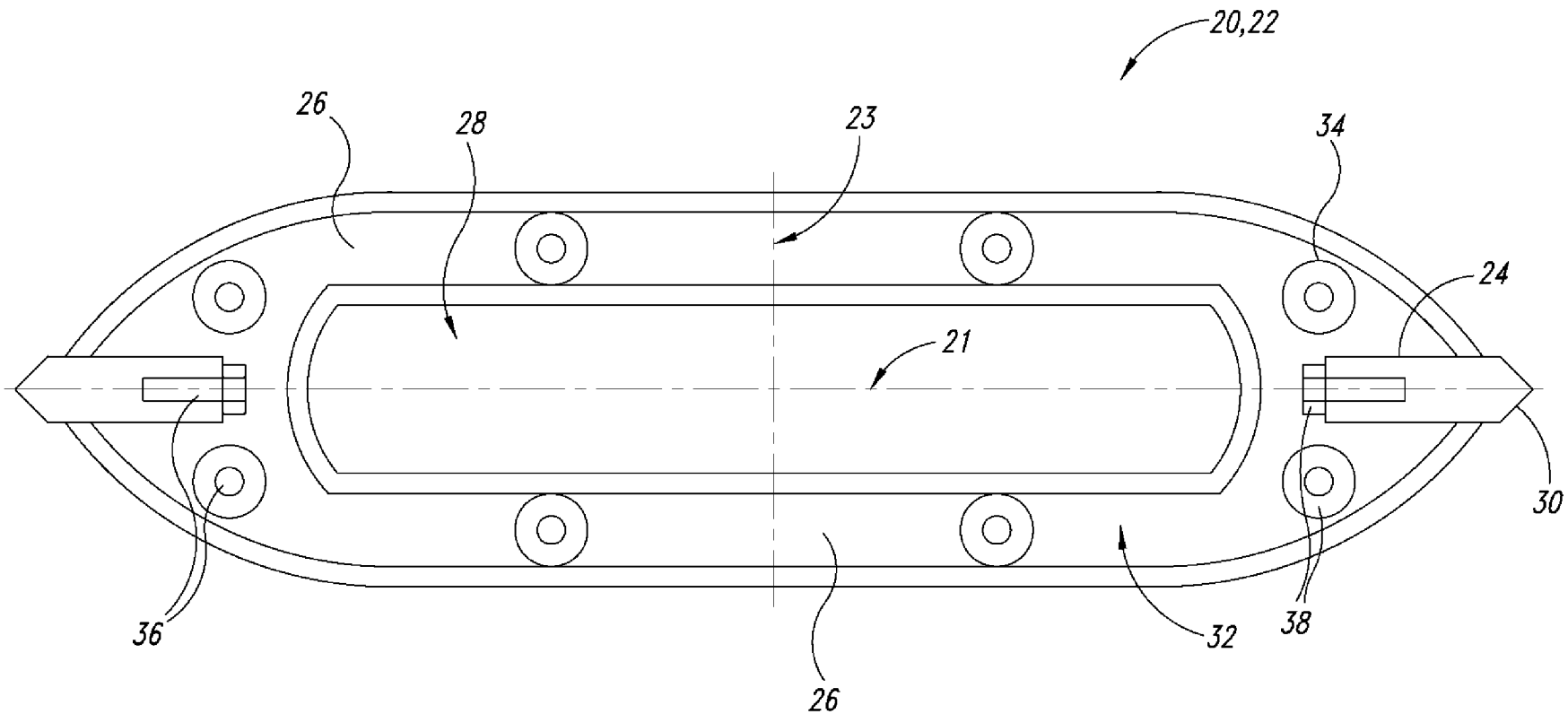
FIG. 11 is a side view of a rotor provided in accordance with one embodiment of the present invention.

In one embodiment shown in FIG. 11, the design utilizes a rotor 20 shaped like a rectangular block that has rounded ends and is symmetrical along a longitudinal axis 21 and along a lateral axis 23 that is perpendicular to the axis longitudinal 21. The top, bottom, and side surfaces of the rotor 20 are flat. There are at least two recessed areas 24 in the rounded ends of the rotor 20 and at least two recessed areas in the sides 26 of the rotor 20 for rotor seals 30 and 32, respectively. There is a large rectangular opening 28 passing from one side of the rotor 20 to the opposing side of the rotor 20. The rotor 20 mounts on the flat surfaces of the rotor shaft 12, shown in FIG. 1, which runs through the large rectangular opening 28 in the side of the rotor 20. The rotor shaft 10 passes through this rectangular opening 28, allowing the rotor 20 to slide across the flat surfaces 12 of the rotor shaft 10, moving perpendicular to the axis of the rotor shaft 10 as the rotor 20 rotates around the inner surface of the rotor housing 50. The end seals 30 of the rotor 20 are always in contact with the opposite sides of the inner surface of the rotor housing 50 as the rotor 20 rotates around the inner surface of the rotor housing 50. The side seals 32 of the rotor 20 are always in contact with the rotor housing end wall 60, as the rotor 20 rotates around the inner surface of the rotor housing 50.

Ideally, the rotor 20 has a plurality of round holes 34 in the ends and sides of the rotor 20 to hold the rotor seal springs 38. Guide pins 36 can be mounted in the middle of these holes 34 to position and guide the rotor seals 30, 32.

The top and bottom surfaces of the rotor 20 go through the complete operating cycle with every 720 degrees of rotation of the rotor 20. This double acting function of the rotor 20 generates a power stroke with every 180 degrees of rotation with a pair of rotors 20, 22 oriented 180 degrees opposite each other as shown in FIG. 12.

Figure 13:
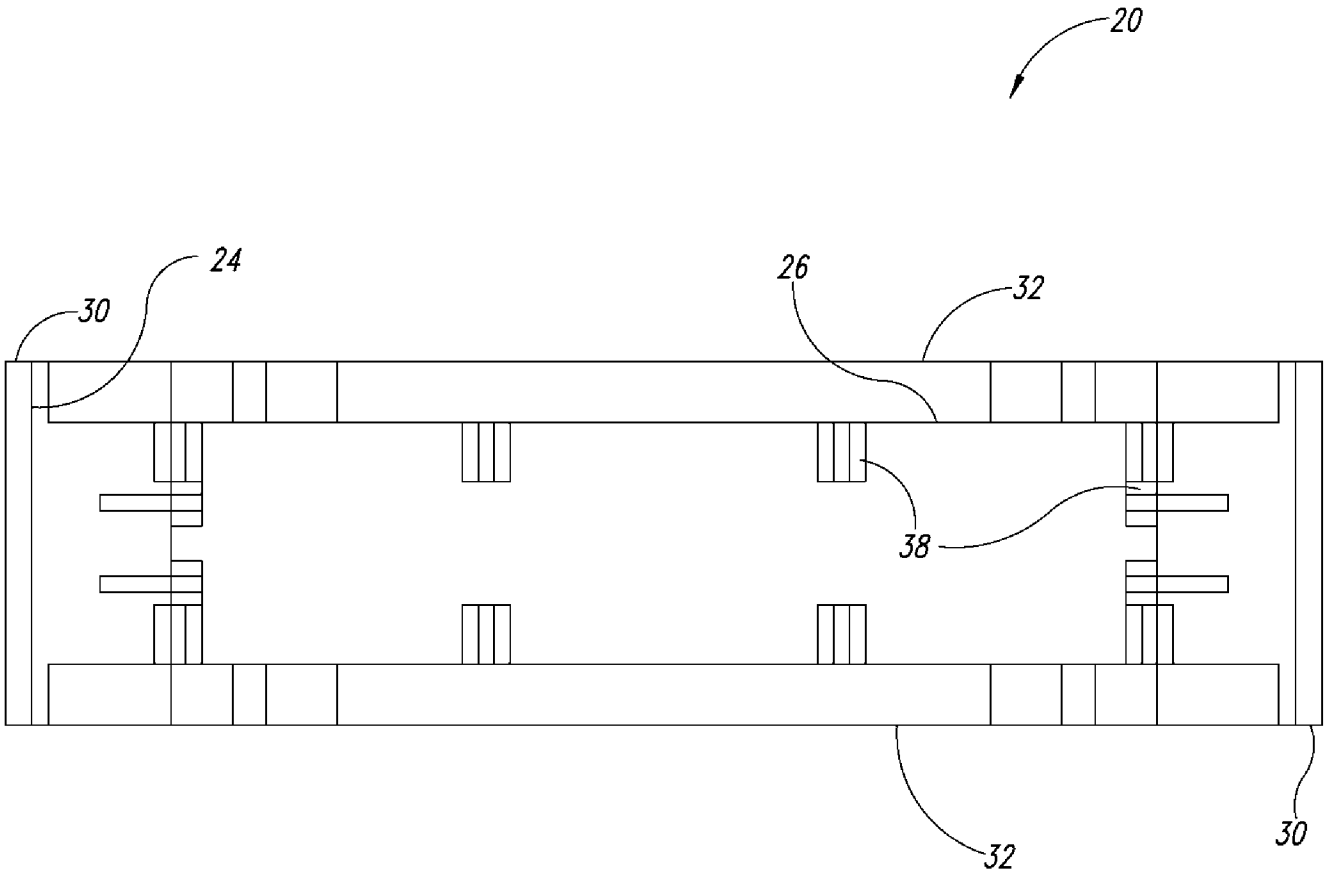
FIG. 13 is a top view of the rotor of FIG. 11.

As better illustrated in FIG. 13, the rotor seals 30, 32 are respectively mounted in recessed areas 24 in each end of the rotor 20 and in recessed areas 26 in each side of the rotor 20. The seals 30, 32 are made of special material to reduce friction and wear as well as resist heat and are replaceable. A plurality of springs 38 urges the seals to maintain constant contact with the inner surface 50 and end walls 60 of the rotor housing 40. This enables the rotor seals 30, 32 to automatically compensate and adjust for wear. The side and end rotor seals 30, 32 interlock at the corners of the rotor 20 to keep the surfaces of the rotor 20 sealed from each other so that no air, air-fuel mixture, exhaust gases, or other fluid will pass between the chambers 56, 58 created by the rotor 20 and illustrated in FIG. 1, and the inner surface 50 and end walls 60 as the rotor 20 rotates inside the rotor chamber 52.

Figure 14:
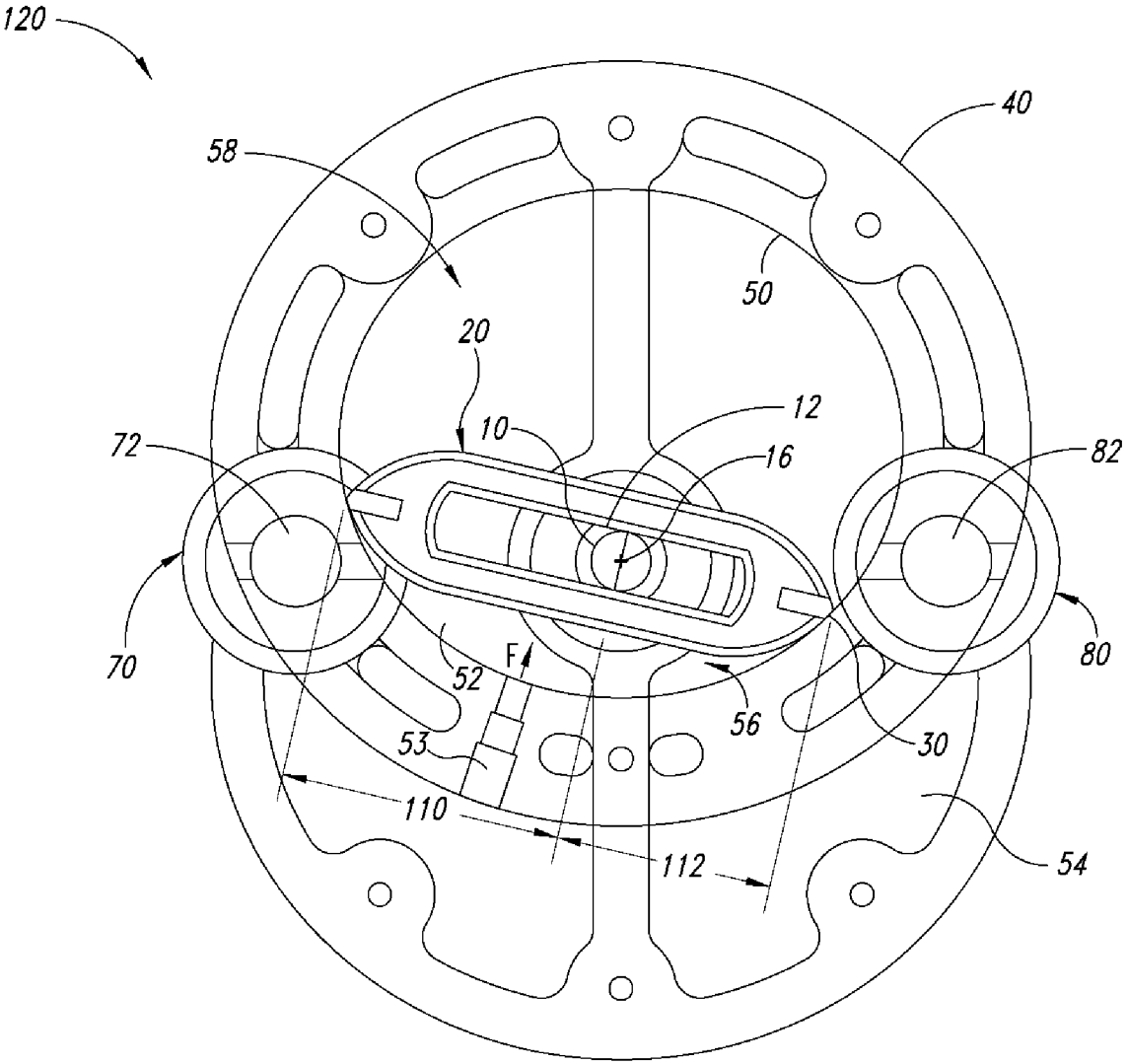
FIG. 14 is a cross-sectional view of a rotary engine according to another embodiment of the present invention.

Referring to FIG. 14, when the engine 120 is operating, a force F acts on a surface of the rotor 20 due to pressure from the combustion of fuel in the chamber 52 formed by the rotor 20 and the inner surface 50 during the combustion and expansion phase of the operating cycle. As the rotor 20 rotates around the inner surface 50, the rotor 20 also moves along its longitudinal axis with respect to the flat surface of the rotor shaft 12. The rotor 20 is divided into two segments 110,112, one on each side of the rotor shaft 10, at the center of which is the center of rotation or origin 16 for the rotor 20 and the rotor shaft 10. At the time of ignition, the functional surface area of one rotor segment 110 is greater than the functional surface area of the other rotor segment 112 on the other side of the center of rotation 16. The total force acting on the larger surface of the one rotor segment 110 is greater than the total force acting on the smaller surface of the other rotor segment 112 thus creating an unbalanced force. This unbalanced force acting on the one rotor segment 110 during the expansion cycle causes the rotor 20 to rotate around the inner surface 50, preferably clockwise, and causes the rotor to turn the rotor shaft 10 in the direction of the larger rotor segment 110.

As the rotor 20 rotates around the inner surface 50 during the expansion phase of the operating cycle, the functional surface area of the one rotor segment 110 increases and the surface area of the other rotor segment 112 decreases. The increase in functional surface area of the one rotor segment 110 and the decrease in functional surface area of the other rotor segment 112 increases the unbalanced force acting on the rotor 20, resulting in an increase in torque and power as the rotor 20 rotates in the housing 40 during the expansion phase of the operating cycle.

The rotary engine 120 is a true rotary engine in that the rotors 20, 22, shown in FIG. 12, actually rotate inside the rotor chambers 52, 54 and form areas of increasing and decreasing volumes 56, 58 within the rotor chambers 52, 54 (FIG. 14). The inner surfaces 50 have a unique contour that allows the rotors 20, 22 to rotate around the rotor chambers 52, 54 with the rotor seals 30 at the ends of the rotors 20, 22 always in contact with the inner surfaces of the rotor housing 50.

The engine 120 also has a unique twin rotor design that dynamically balances the forces generated by the individual rotors 20, 22 as they rotate around the individual rotor chambers 52, 54 of FIG. 14. The rotor housing 40 of the engine 120 has two rotor chambers 52, 54 located one behind the other and oriented 180 degrees from each other. Individual rotors 20, 22 in each rotor chamber 52, 54 are mounted on the same rotor shaft 10 as shown in FIG. 12. The rotor shaft 10 has flat surfaces 12 on which the rotors 20, 22 are mounted. The rotors 20, 22 turn the rotor shaft 10 as the rotors 20, 22 rotate around the rotor chambers 52, 54. The rotors 20, 22 slide across the flat surfaces 12 of the rotor shaft 10 moving perpendicular to the axis of the rotor shaft 10 as the rotors 20, 22 rotate around the rotor chambers 52, 54.

Referring to FIG. 14, the placement of the rotor shaft 10 in the rotor housing 40, the contour of the inner surface of the rotor housing 50, and the shape of the rotors 20, 22 causes the rotors 20, 22 to generate an area of increasing volume 56 and an area of decreasing volume 58 between surfaces of the rotors 20, 22 and the inner surface 50, as the rotors 20, 22 rotate in the rotor chambers 52, 54. These areas of increasing volume 56 and decreasing volume 58 in the rotor chambers 52, 54 enable the engine 120 to go through its operating cycle of intake, compression, expansion, and exhaust. The engine 120 has rotary intake valves 70 and rotary exhaust valves 80 with valve shafts 72 and 82 that rotate either continuously or intermittently, as depicted in FIGS. 7 and 9A, depending on the application for which the engine 120 is being used and the performance required.

Figure 15:
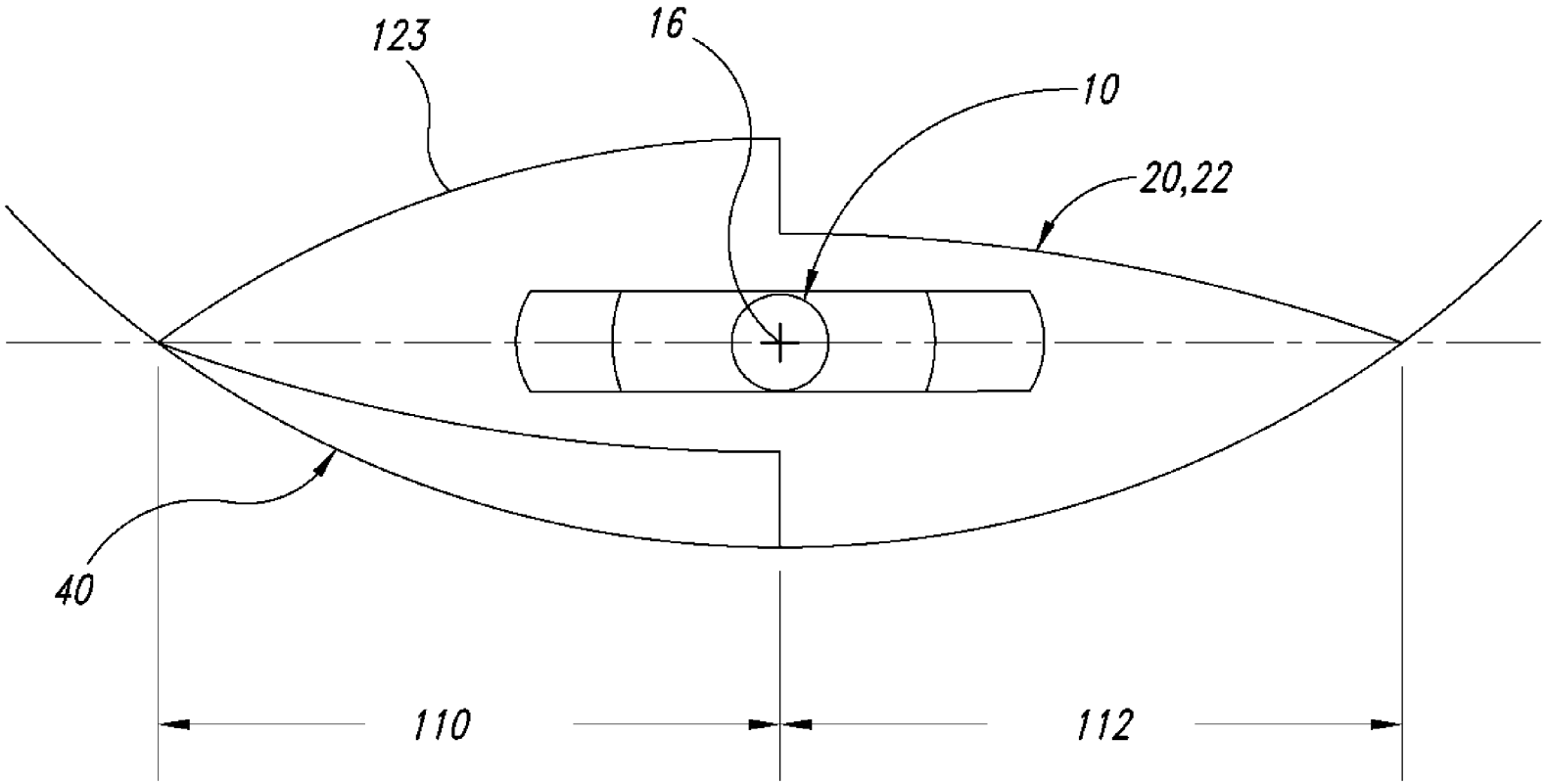
FIG. 15 is a side view of a rotor provided in accordance with yet another embodiment of the present invention.

In still another embodiment of the present invention, to increase the power, performance, and efficiency of the engine 120, the contour of the surfaces of the rotor 20 can be shaped to allow more force to act on the one rotor segment 110 than on the other rotor segment 112 during the expansion phase of the operating cycle. As shown in FIG. 15, a contour of a surface 123 of the rotor 20 can be shaped to give the rotor segment 110 a larger surface area than the surface area of the other rotor segment 112. A larger difference between the surface areas of the rotor segments 110, 112 will create a greater imbalance of the forces acting on the rotor 20 and thus a greater torque in the engine 120. The contour of the surfaces 123 of the rotor 20 against which a force is applied during the expansion phase can be shaped so that a greater force acts on the one rotor segment 110 that has more surface area. Reducing the surface area of the other rotor segment 112 that is exposed to the pressure generated by the combustion of fuel during the expansion phase of the engine 120 operating cycle reduces the force acting on the smaller rotor segment 112, thus increasing the unbalanced force acting on the surface of the larger rotor segment 110. This increases the power, torque, and efficiency of the engine 120 during the first portion of the expansion phase of the operating cycle.

As illustrated in FIG. 12, in one embodiment, the engine 120 has two rotors 20, 22 mounted parallel to each other on the same rotor shaft 10. The combined function of the two rotors 20, 22 is to provide a power stoke every 180 degrees of rotation of the rotors 20, 22 and the rotor shaft 10 and also to balance the unbalanced forces created by each rotor 20, 22 as they rotate around the rotor chambers 52, 54, shown in FIGS. 1 and 14. The engine 120 may use pairs of rotors 20, 22 to cancel the vibration of the engine. The rotors 20, 22 balance the centrifugal forces generated by the unequal masses of the individual rotors 20, 22 as they move with respect to the center of rotation 16 while traveling across the flat surfaces 12 of the rotor shaft 10 as they rotate around the inner surface 50 and turn the rotor shaft 10.

The engine 120 with pairs of rotors 20, 22 can balance the forces generated by the unbalanced rotating mass of the individual rotors 20, 22 as they travel across the flat surfaces 12 of the rotor shaft 10. As the individual rotor 20 rotates around the inner surface 50, a second rotor 22 will rotate 180 degrees out of phase from the first rotor 20. To cancel the forces generated by the unbalanced rotating mass of the first rotor 20 there is a second rotor 22 traveling 180 degrees out of phase with the first rotor 20. As the rotor 20 travels across the flat surface 12 of the rotor shaft 10 the rotor 20 is divided into two rotor segments 110 and 112, shown in FIG. 14, one on each side of the rotor shaft 10, which is the center of rotation 16 for the rotor 20.

While the total mass of the rotor 20 is constant just as the total length of the rotor 20 is constant, the unbalanced portion of the rotating mass of each rotor segment 110, 112 varies directly as the radius of rotation of the rotating rotor segment 110, 112 varies. The radius of rotation and mass of each of these rotor segments 110 and 112 changes as the rotor 20 rotates around the inner surface of the rotor housing 50. The change in radius and rotating mass of each rotor segment 110, 112 causes an unbalanced condition.

Referring to FIG. 12, the second rotor 22 mounted on the rotor shaft 10 and rotating 180 degrees out of phase from the first rotor 20 counter balances the unbalanced forces generated by the first rotor 20. As the first rotor 20 moves laterally with respect to the center of rotation 16, the second rotor 22 moves laterally in the opposite direction and 180 degrees out of phase from the first rotor 20 and cancels the forces generated by the first rotor 20. The second rotor 22 rotates in the same direction as the first rotor 20.

Referring to FIGS. 1, 6 and 7, as the rotor 20 rotates in the housing 40, it performs a self valving function relative to the rotor housing intake port 62 and the rotor housing exhaust port 64 by allowing and denying access to the intake port 62 and exhaust port 64. As the rotor 20 moves past the intake port 62 and the exhaust port 64, the rotor 20 allows and denies access to these ports due to the rotational position of the rotor 20 relative to the ports 62, 64. As the rotor 20 rotates around the inner surface 50, each end of the rotor 20 is rotating toward one of these ports and away from the other port. This action allows access to the port toward which the rotor 20 is rotating, and denies access to the port from which the rotor 20 is rotating away. By denying access to a port, the rotor 20 is actually closing the valve. By allowing access to the port, the rotor 20 is allowing the valve to be open if the valve shaft openings 74, 84 are in the open position.

Figure 16A:
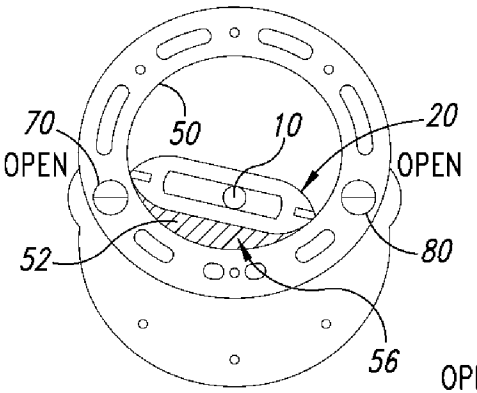
FIGS. 16A-16P are a series of cross-sectional views of a rotary engine provided in accordance with an embodiment of the present invention and illustrating an operating cycle.
Figure 16B:
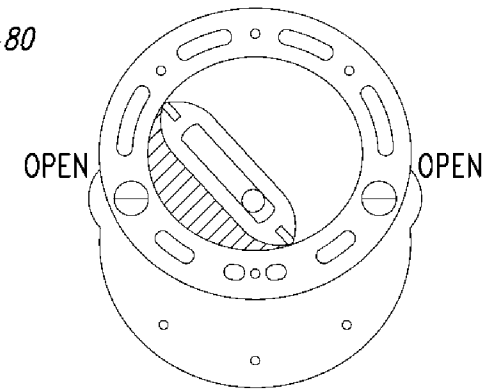
Figure 16C:
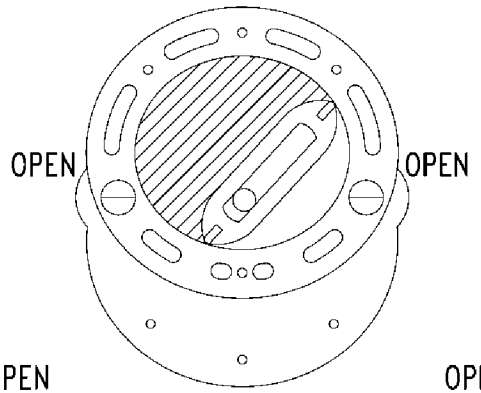
Figure 16D:
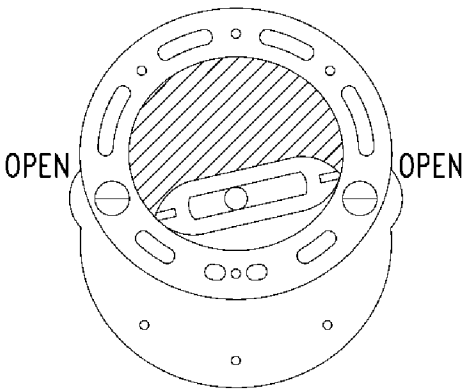
Figure 16E:
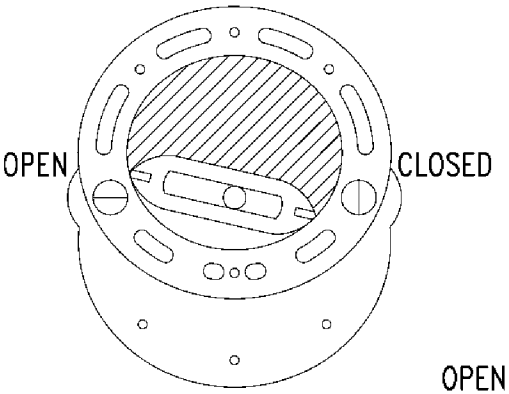
Figure 16F:
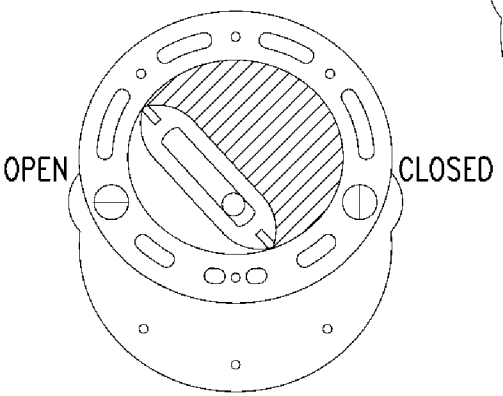
Figure 16G:
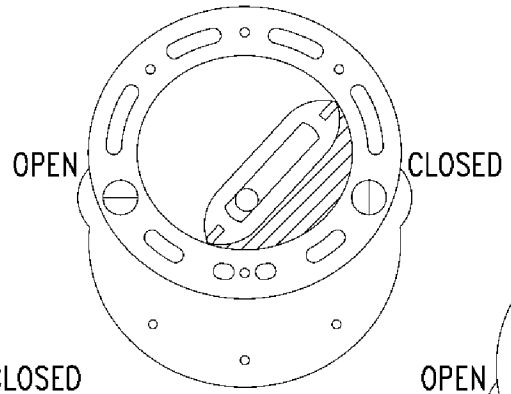
Figure 16H:
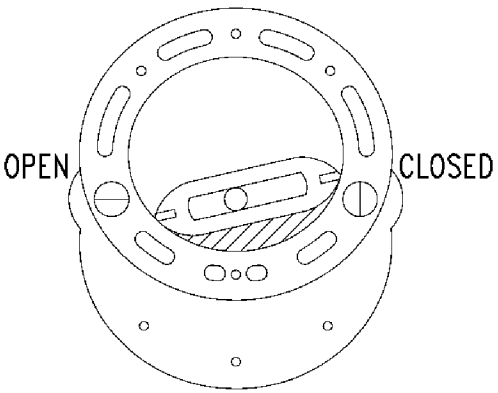

Referring to the illustrated embodiment of FIGS. 16A-16Q, the operating cycle of the engine 120 has four phases; intake, compression, expansion, and exhaust. The operating cycle of one side of a single rotor 20 in an engine 120 is now described.

Intake Cycle—0 to 180 degrees of rotation of the rotor 20. Referring to FIGS. 16A-16D, during the intake cycle, an air-fuel mixture (the shaded area) is taken into the rotor chamber 52 through the rotary intake valve 70. The rotation of the rotor 20, the shape of the rotor chamber 52, and the position of the rotary intake valve 70 in the rotor chamber 52 create turbulence in the air-fuel mixture to cause the air-fuel mixture to mix thoroughly within the rotor chamber 52 before ignition.

Compression Cycle—180 to 360 degrees of rotation of the rotor 20. Referring to FIGS. 16E-16H, the air-fuel mixture is compressed as the rotor 20 rotates in the rotor chamber 52.

Expansion Cycle—360 to 540 degrees of rotation of the rotor 20. Referring to FIGS. 16I-16L, during the first part of this cycle, illustrated in FIG. 16I, ignition of an air-fuel mixture takes place in the rotor chamber 52 when the rotor is a few degrees out of alignment with the valves so that rotor segment 110 has a larger surface area than rotor segment 112 as shown in FIG. 14. This unequal surface area creates unequal forces that act on the rotor, causing it to rotate about the center of rotation 16 of the rotor 20 and rotor shaft 10. After ignition, the combusted gas expands during the expansion cycle. In a four-cycle gasoline version of the engine 120, ignition devices 53, illustrated in FIG. 14, such as a conventional spark plug, and a distributor device (not shown), are used to ignite the air-fuel mixture. The distributor device includes a rotor that is in rotational communication with the rotor shaft 10 via a rotating coupling mechanism, such as gears similar to the gears 90, 92 coupled to the rotor shaft 10 and the valve shafts 72, 82, illustrated in FIG. 7. In other embodiments, a timing belt and at least two pulleys may be used to rotatably couple a distributor device rotor shaft to the rotor shaft 10 of the engine 120. The distributor may be mounted on the housing 40 or it can be mounted on other structure proximate to the housing 40. An electronic distributor device and ignition system (not shown) may also be used to control and ignite the air fuel mixture.

A variety of fuels may be used to operate the engine 120. The type of fuel used will determine the type of ignition device 53 used to ignite the air-fuel mixture. For example to ignite the air-fuel mixture in engines 120 that use gasoline as the fuel, the ignition device 53 illustrated in FIG. 14 may be a conventional spark plug. In other embodiments, such as, but not limited to, those that use diesel as the fuel, the ignition device 53 may be a glow plug (not shown). It will be understood that various embodiments may not incorporate an ignition device 53. For example, certain diesel engines may be designed to ignite the air-fuel mixture using heat generated from compressed air. One of skill in the art, having reviewed this disclosure, will appreciate these and other variations that can be made to the device 53 without deviating from the spirit of the invention.

Exhaust Cycle—540 to 720 degrees of rotation of the rotor 20. Referring to FIGS. 16M-16P, the combusted gas is expelled through the rotary exhaust valve 80 as the rotor 20 rotates around the rotor chamber 52.

Table 1 tabulates the relationships of the two sides of the two rotors 20, 22, in embodiments with rotor pairs, as they rotate around the rotor chamber 52 during the engine 120 operating cycle.

TABLE 1

| Rotor Operating Cycle Sequence | | | |
|---|---|---|---|
| Rotor 1 Side 1 | Rotor 1 Side 2 | Rotor 2 Side 1 | Rotor 2 Side 2 |
| Intake | Exhaust | Expansion | Compression |
| Compression | Intake | Exhaust | Expansion |
| Expansion | Compression | Intake | Exhaust |
| Exhaust | Expansion | Compression | Intake |

Table 2 tabulates the rotary input and exhaust valve functions as a single rotor 20 rotates around the rotor chamber 52.

TABLE 2

| | Rotor Side 1 | | Rotor Side 2 | | Combined Rotor Sides 1 & 2 | |
|---|---|---|---|---|---|---|
| Rotor Rotation | Input Valve | Exhaust | Input Valve | Exhaust | Input Valve | Exhaust |
| 0 to 180 | Open | | | Open | Open | Open |
| 180 to 360 | | Closed | Open | | Open | Closed |
| 360 to 540 | Closed | | | Closed | Closed | Closed |
| 540 to 720 | | Open | Closed | | Closed | Open |

Embodiments of the engine 120 may have multiple pairs of rotors 20, 22, mounted on the rotor shaft 10 to provide increased power with smoother operation. These pairs of rotors 20, 22 can be oriented in such a manner as to give continuous maximum power during each 360 degree rotation of the rotor shaft 10. For example, an engine 120 with four rotors would have two pairs of rotors 20, 22 oriented ninety degrees from each other. An engine 120 having six rotors would have three pairs of rotors 20, 22 oriented sixty degrees from each other.

In still another embodiment, the engine 120 can incorporate a pre-combustion chamber to increase the efficiency and decrease fuel consumption of the engine by thoroughly mixing the air-fuel mixture before the intake cycle of the engine 120. The pre-combustion chamber would mix the air-fuel mixture before it enters the combustion chamber. The air-fuel mixture from the pre-combustion chamber would feed directly into the combustion chamber. The pre-combustion chamber would have a similar rotor and housing inner surface configuration as that for rotor chambers 52, 54 of the engine 120.

Additionally, or alternatively, the engine 120 can incorporate a super-charger chamber to increase power and performance. The supercharger chamber would be similar to the pre-combustion chamber but would compress the air-fuel mixture before it enters the rotor chambers 52, 54 of the engine 120. This super-charger chamber would have a similar rotor and housing inner surface configuration as that for the rotor chambers 52, 54 of the engine 120. The super-charger may also serve as a pre-combustion chamber to thoroughly mix the air-fuel mixture as described above before it compresses the air-fuel mixture.

Additionally, or alternatively, a turbo-charger can be used to increase the power and performance of the engine 120 by increasing the amount of air entering the rotor chambers 52, 54 of the engine 120. The exhaust gases of the engine 120 can drive the turbo-charger. The intake and exhaust ports 62, 64 of the engine 120 are located in close proximity so that turbo-chargers can be mounted without difficultly on the engine.

Additionally, or alternatively, the engine 120 can readily accommodate a post-combustion chamber that burns the unburned fuel contained in the exhaust gases from the main rotor chambers 52, 54 of the engine 120. The post-combustion chamber would have a similar rotor and rotor chamber as the main rotor 20 and rotor chamber 52 of the engine 120. The post-combustion chamber will increase fuel efficiency of the engine 120 by gaining additional power by burning the unburned fuel exhausted from the main rotor chambers 52, 54. These unburned gases only need to produce enough power to rotate the rotor with sufficient speed so as to not affect the performance of the engine and therefore not consume any power from the engine. The effect of the post-combustion chamber will be to decrease the exhaust emissions of the engine 120 while providing additional power.

Furthermore, the design of the engine 120 can be used for the basis of an air compressor using single or multiple rotors. As the rotor 20 rotates around the rotor chamber 52, the shape of the inner surface 50 and the rotor 20 create increasing and decreasing volumes within the rotor chamber 52. During the intake cycle of the compressor the volume of the air chamber formed by the rotor 20 and the inner surface 50 increases in volume thus drawing air into the rotor chamber 52. During the compression cycle of the compressor the volume of the rotor chamber 52 formed by the rotor 20 and the inner surface 50 decreases in volume thus compressing the air in the rotor chamber 52. The compressor would not require any intake valves 70 or exhaust valves 80 due to the self-valving action of the rotor 20 as it rotates around the rotor chamber 52, although one-way exhaust valves may be used to increase the efficiency of the compressor.

In such an embodiment, as the rotor 20 passes air intake port 62, the compressor would draw air into the rotor chamber 52 to be compressed. Air would continue to be drawn into the compressor as the rotor 20 rotates in the rotor chamber 52 for 180 degrees. At this time the opposite end of the rotor 20 would pass the air intake port 62 in the rotor housing 40 thus sealing the rotor chamber 52. An end of the rotor 20 would pass the exhaust port 64 in the rotor chamber 52 thus opening the port 64 for the compressed air to be exhausted. The compression phase of the cycle would begin as the rotor 20 rotates around the rotor chamber 52, which gets smaller as the rotor 20 rotates around the inner surface 50. As the rotor 20 reaches the point of maximum compression the compressed air in the compressor chamber is exhausted out of the compression chamber through a one-way valve in the exhaust port 64.

A more complex version of the compressor may use the rotary exhaust valve design of the engine 120 to gain additional efficiency. Such compressors can be developed using multiple compression chambers feeding one in to the other. In this design rotary intake valves 70 and exhaust valves 80 will control access to the compression chambers to increase the efficiency of the compressor.

Figures 16I, 16J, 16K, 16L:
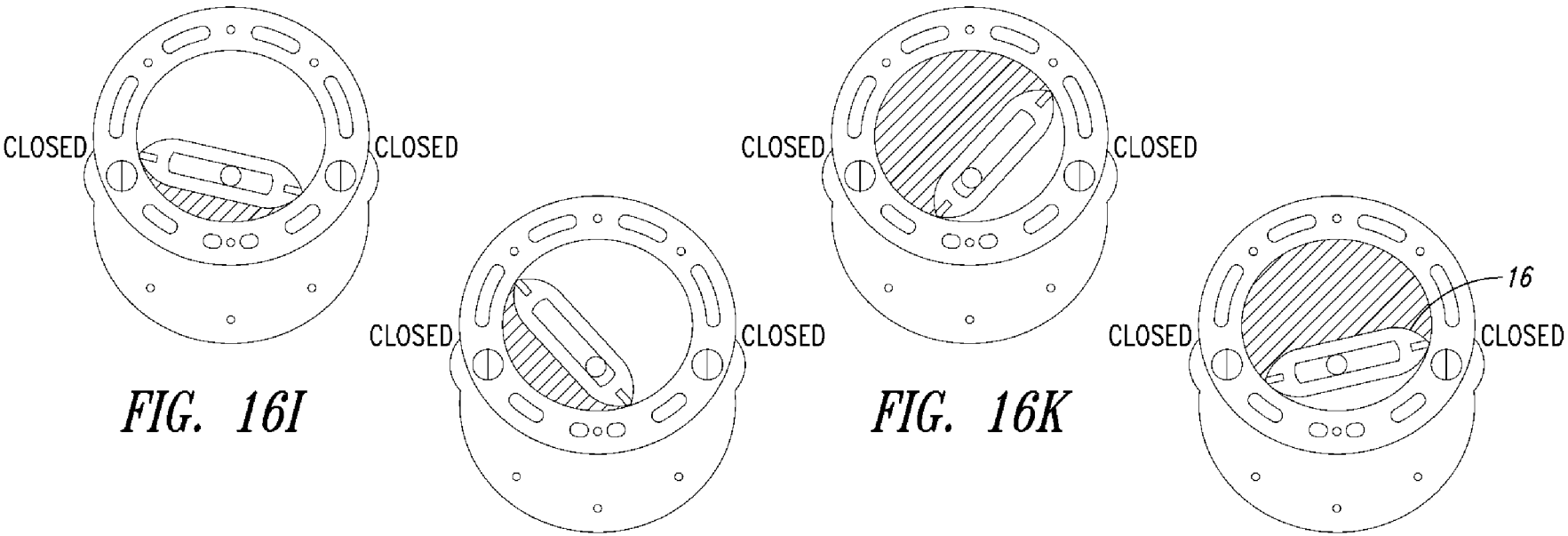
Figure 16P:
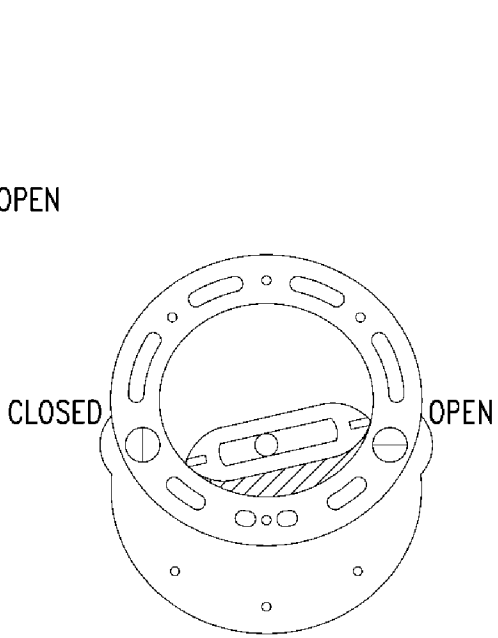
Figure 16O:
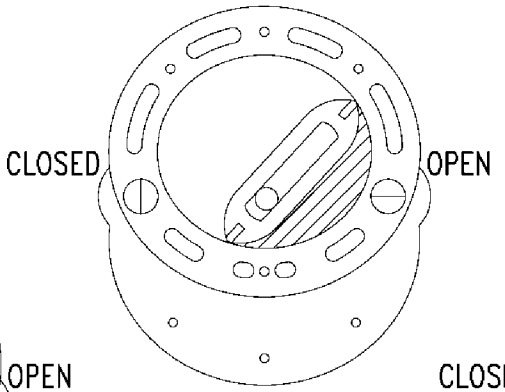
Figure 16N:
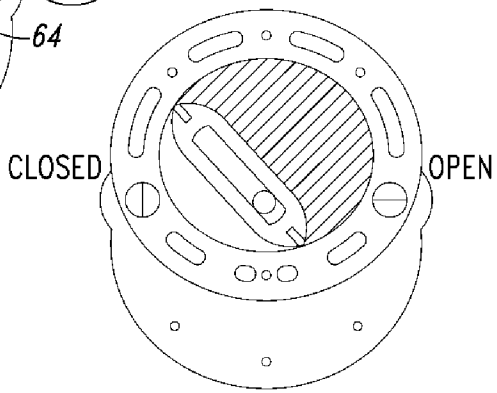
Figure 16M:
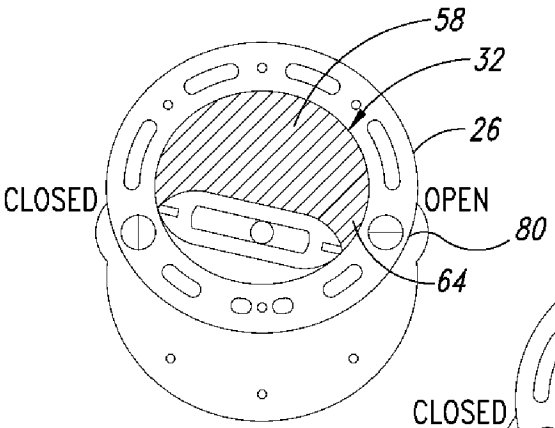

Additionally, or alternatively, the engine 120 may operate through two cycles. A glow plug may be used as the ignition device 53, illustrated in FIG. 14, in a two-cycle combustion engine 120. In yet other embodiments of a two-cycle engine 120, steam or compressed air may be used as the expansion medium, where the engine 120 operates in the expansion and exhaust cycles. There are various methods of generating steam, including several types of steam generators that have been used effectively in the past and continue to be improved upon with new technology. Steam expands into the rotor chamber 52 during the first portion of the expansion cycle, illustrated in FIG. 16I. The intake valve 70 is then closed and the steam continues to expand in the rotor chamber 52 as the rotor rotates around the rotor housing, as illustrated in FIGS. 16J-16L. At the end of the expansion cycle, the steam is exhausted from the rotor housing through the exhaust port 64, as illustrated in FIGS. 16M-16P. It will be understood that various embodiments may not incorporate the rotary exhaust valve 80. For example, the self-valving action of the rotor 10 relative to the location of the exhaust port 64 may be sufficient to eliminate the need for the rotary exhaust valve 80. From the exhaust port 64, the expanded steam would travel to a condenser (not shown) or to other expansion chambers prior to the condenser.

In still other embodiments, the engine 120 according to the present invention is well-suited to be used for a hybrid automobile application such as, but not limited to, a gasoline-electric hybrid, because the engine 120 is lighter and smaller than a comparable internal combustion piston engine, resulting in a high power-to-weight ratio. In addition, the foregoing embodiments can be adapted for use as vacuum and fluid pumps where the main rotor is driven by an external prime mover or by one or more rotors in the same housing.

Figure 17A:
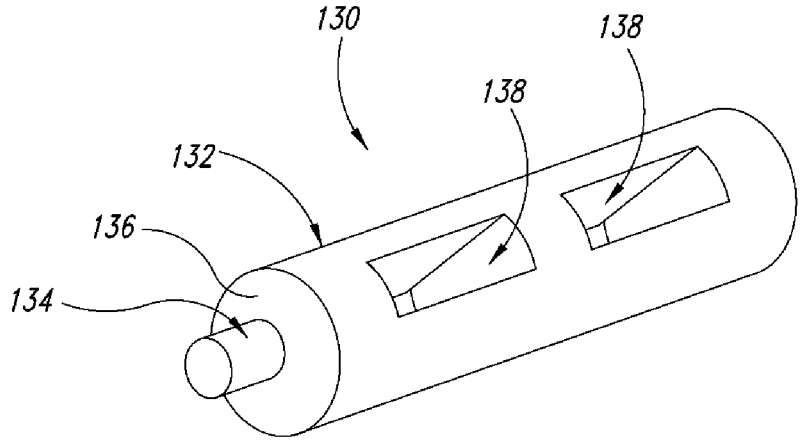
FIGS. 17A-17E are an isometric, front side, cross-sectional first end, second side, and cross-sectional second end views, respectively, of a rotor and shaft configuration formed in accordance with an alternative embodiment of the present invention.
Figure 17B:
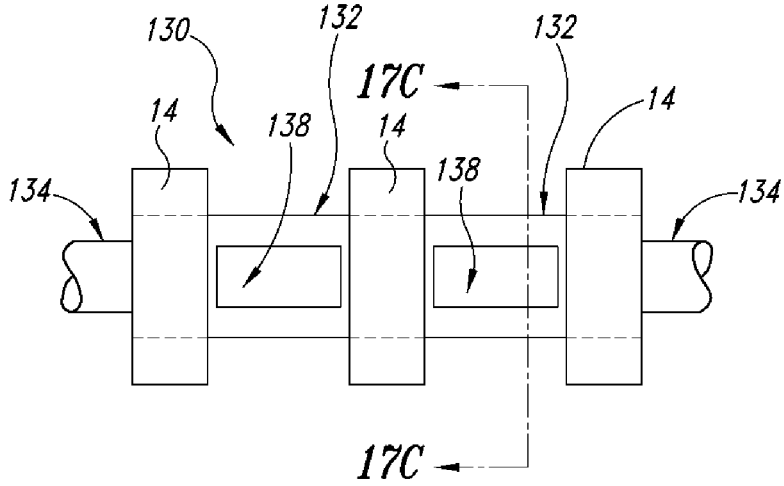
Figure 17C:
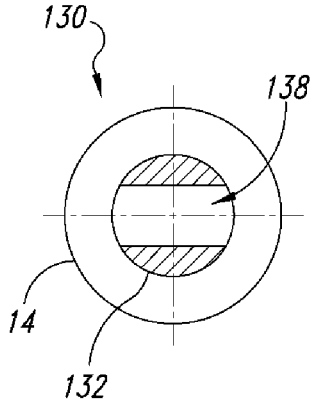
Figure 17D:
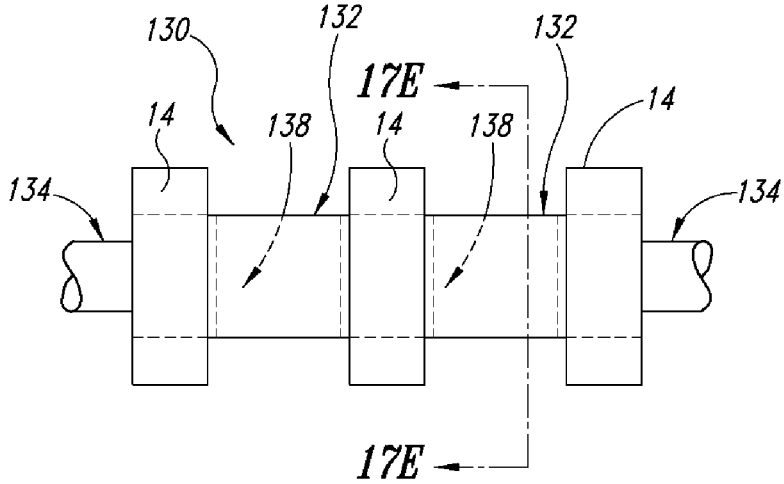
Figure 17E:
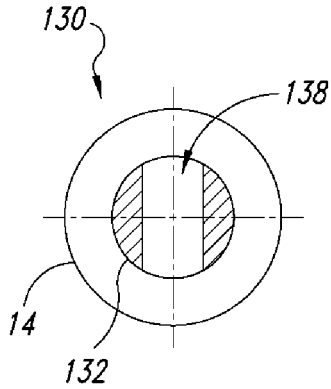
Figures 18A, 18B, 18C:
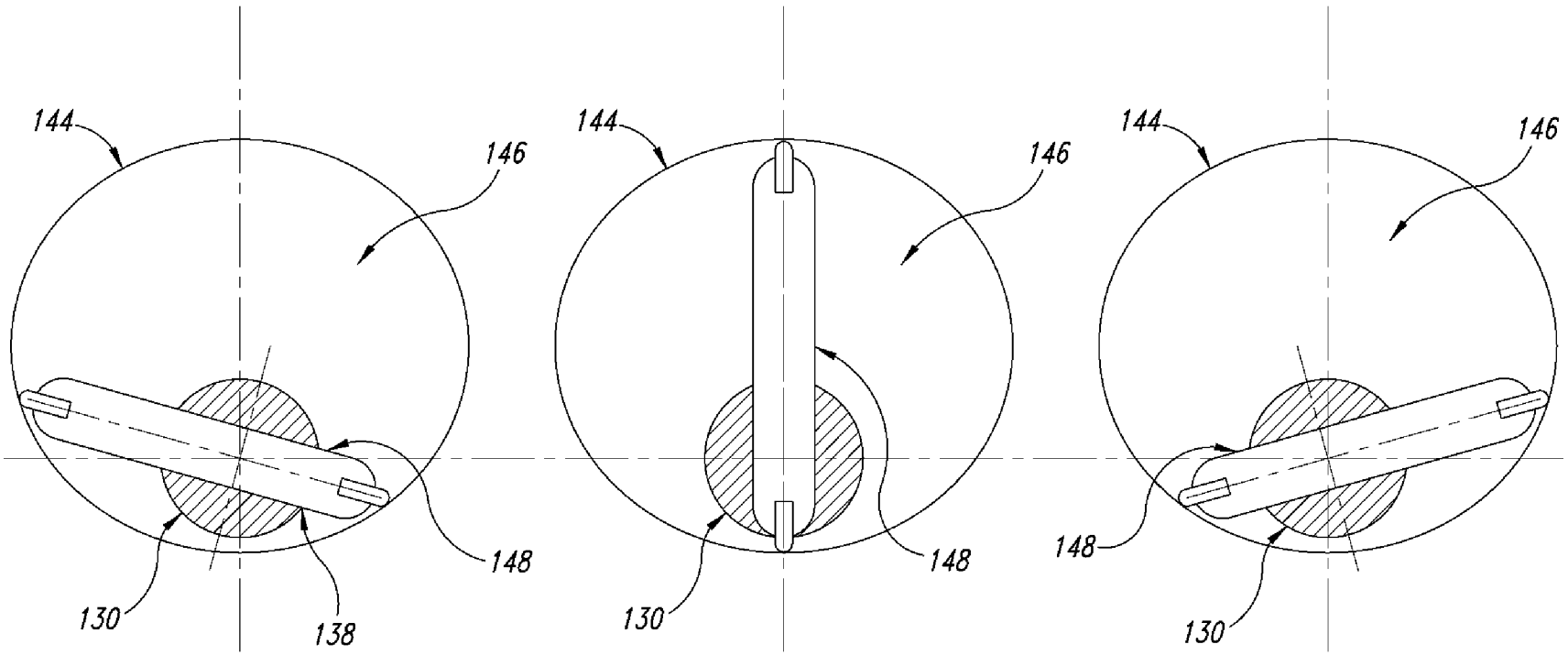
FIGS. 18A-18C are a series of cross-sectional views of an alternative embodiment of the rotary engine utilizing the rotor and shaft configuration of FIGS. 17A-17E.

A further embodiment of the invention is illustrated in accompanying FIGS. 17A-17E and 18A-18C. In FIG. 17A is shown a modified rotor shaft 130 having a substantially cylindrical body 132 with a circular cross-sectional configuration and a shaft 134 extending from each end 136 of the rotor shaft 130. A pair of transverse openings 138 is formed through the body 132 that are sized and shaped to receive a rotor in slidable engagement, which is shown in FIGS. 18A-18C. More particularly, the openings 138 as shown in this embodiment have a rectangular cross-sectional configuration to match the cross-sectional configuration of a corresponding rotor. It is to be understood that other cross-sectional configurations can be used. This embodiment depicts two openings because the rotor shaft 130, 131 will be used in a two-chamber housing having two rotors.

FIGS. 17B-17E are illustrations of the shaft 130 where ball or roller bearings 14 are mounted at each end and in the center of the shaft 130 to support the shaft 130 in the housing (not shown). FIG. 17C is a cross-section of the shaft 130 taken along lines C-C in FIG. 17B, and FIG. 17E is a cross section of the shaft 130 taken along lines E-E of FIG. 17D.

In FIGS. 18A-18C a rotary engine housing 144 is shown in cross section to include a chamber 146 having a shaft 130 rotatably mounted therein. The transverse opening 138 in the shaft receives a rotor 148 in slidable engagement. The rotor 148 can then slide within the shaft 130 to accommodate the changing relative positions of the rotor and housing as the rotor 148 rotates the rotor shaft 130.

Various other embodiments of the invention are described hereinbelow.

For example, the centerline of the intake valve port 62 and the centerline of the exhaust valve port 64 in the rotor housing 40 can be located on the centerline of the rotor shaft 10 as shown in FIG. 1 or above or below the centerline of the rotor shaft 10. Locating the centerline of the intake valve 62 below the center line of the rotor shaft 10 allows the intake air fuel mixture to enter the combustion chamber 52 at a point below the centerline of the rotor shaft 10 which may enhance the performance of the rotary engine. Locating the centerline of the exhaust valve port 64 below the center line of the rotor shaft 10 allows the engine exhaust to exit the combustion chamber 52 at a point below the centerline of the rotor shaft 10 which may enhance the performance of the rotary engine.

The curve of the inner surface 50 of the rotor housing 40 generated for a rotor 20 with round end seals 30 will be slightly different but essentially the same as the curve of the inner surface 50 of the rotor housing 40 generated for a rotor with end seals 30 that come to a point. The generation of the curve of the inner surface 50 of the rotor housing 40 is done using essentially the same method but in a slightly different manner.

Figure 2C:
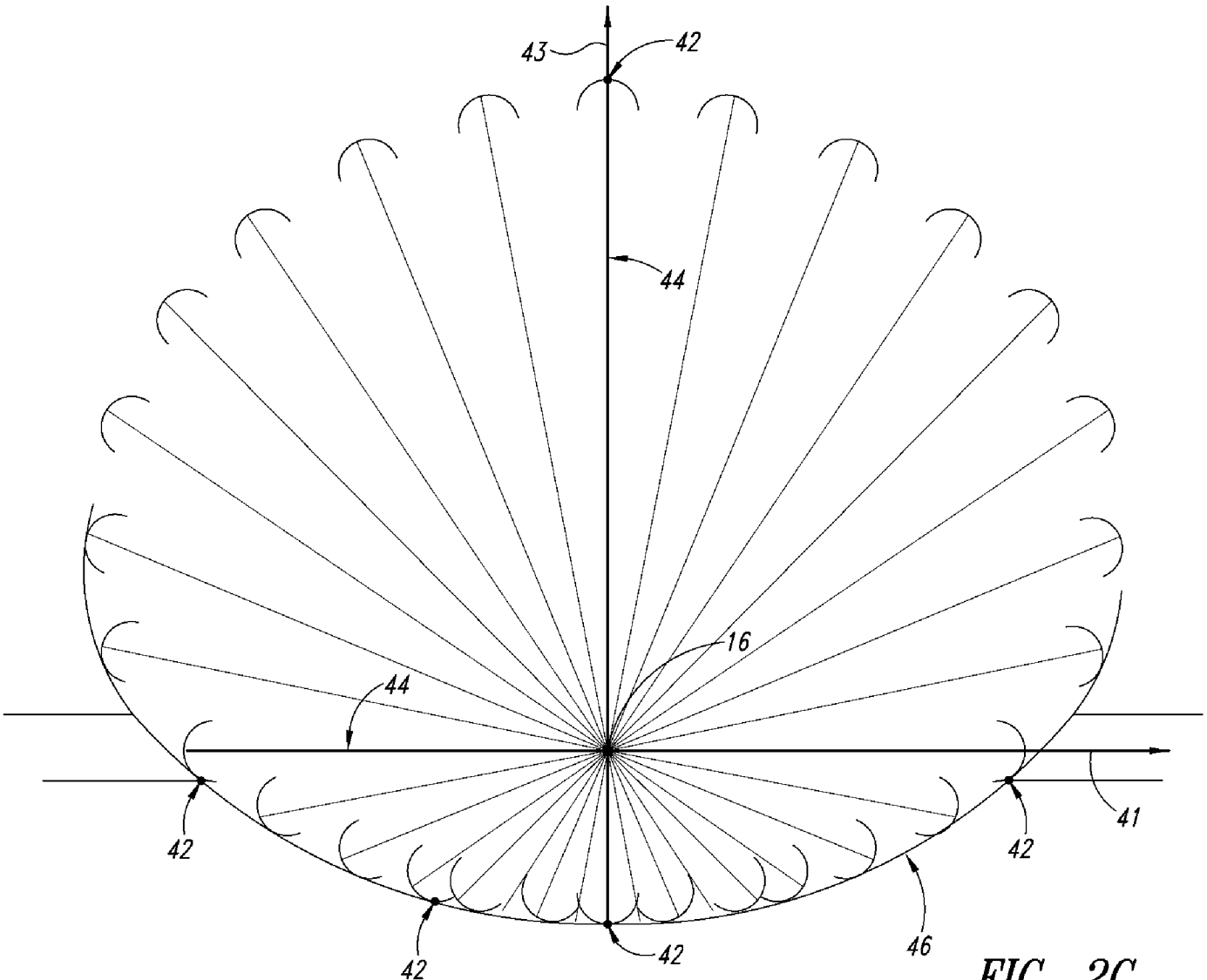
FIG. 2C is a view of the inner surface formed in accordance with an alternative generation method.
Figure 3A:
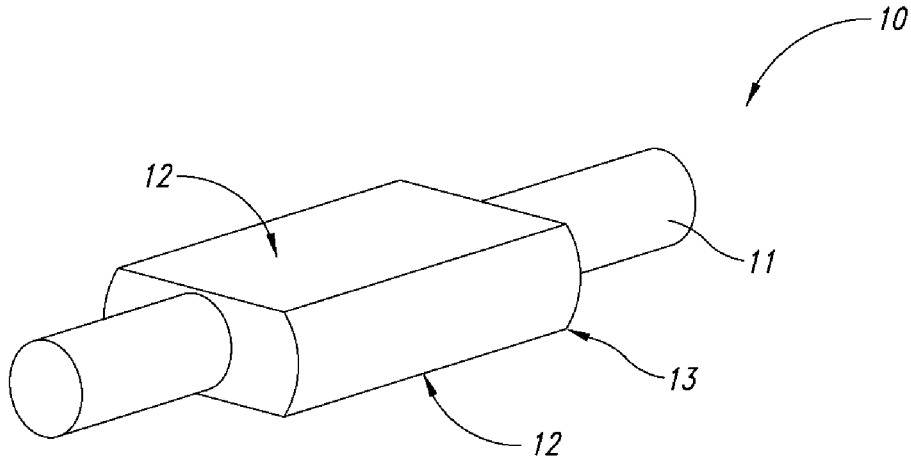
FIG. 3A is an isometric view of a rotor shaft provided in accordance with one embodiment of the present invention.
Figure 3B:
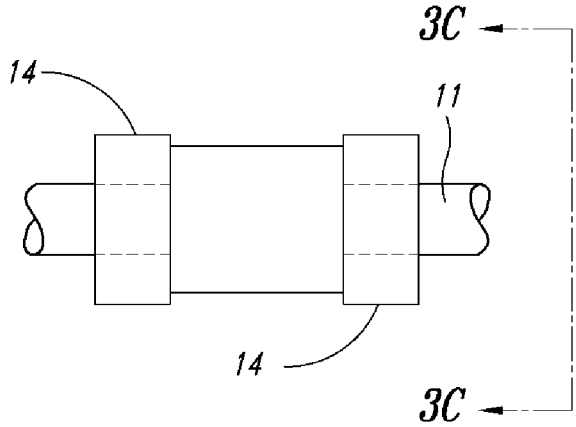
FIGS. 3B-3E are top, side, and corresponding cross-section views of a rotor shaft with a plurality of bearings provided in accordance with one embodiment of the present invention.
Figure 3C:
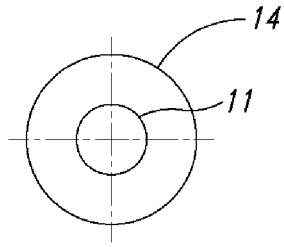
Figure 3D:
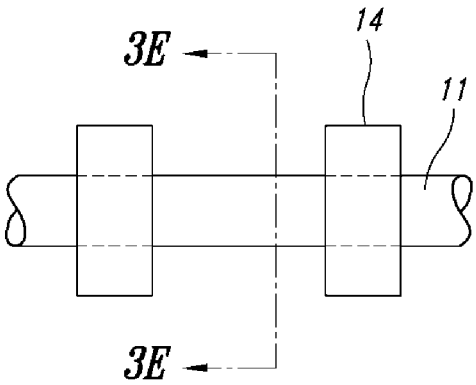
Figure 3E:
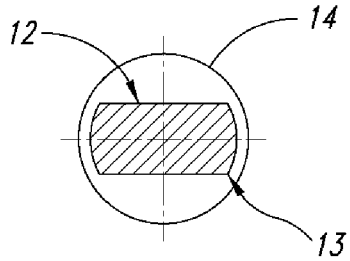

As shown in FIG. 2C a series of points 42 determine a unique contour of an inner surface 50 of the rotor housing 40, shown in FIG. 1. The points 42 are generated by the round end of the rotor at one end of a line segment 44, which is equal to the length along the horizontal axis of the rotor and the round end of the rotor at the other end of the line segment 44, and which traces along a curve 46 that forms one segment of the contour of the inner surface 50 and passes through an origin 16. The center of rotation of the rotor shaft 10 and the center of rotation of the rotor 20 is the origin 16. The inner surface 50 of the rotor housing 40 has a variable radius and a variable diameter. As shown in FIG. 2C the diameter of the inner surface 50 of the rotor housing 40 is greater along the first axis 41 than the diameter of the inner surface 50 of the rotor housing 40 along the second axis 43, which is perpendicular to the first axis 41.

Figures 19A, 19B, 19C:
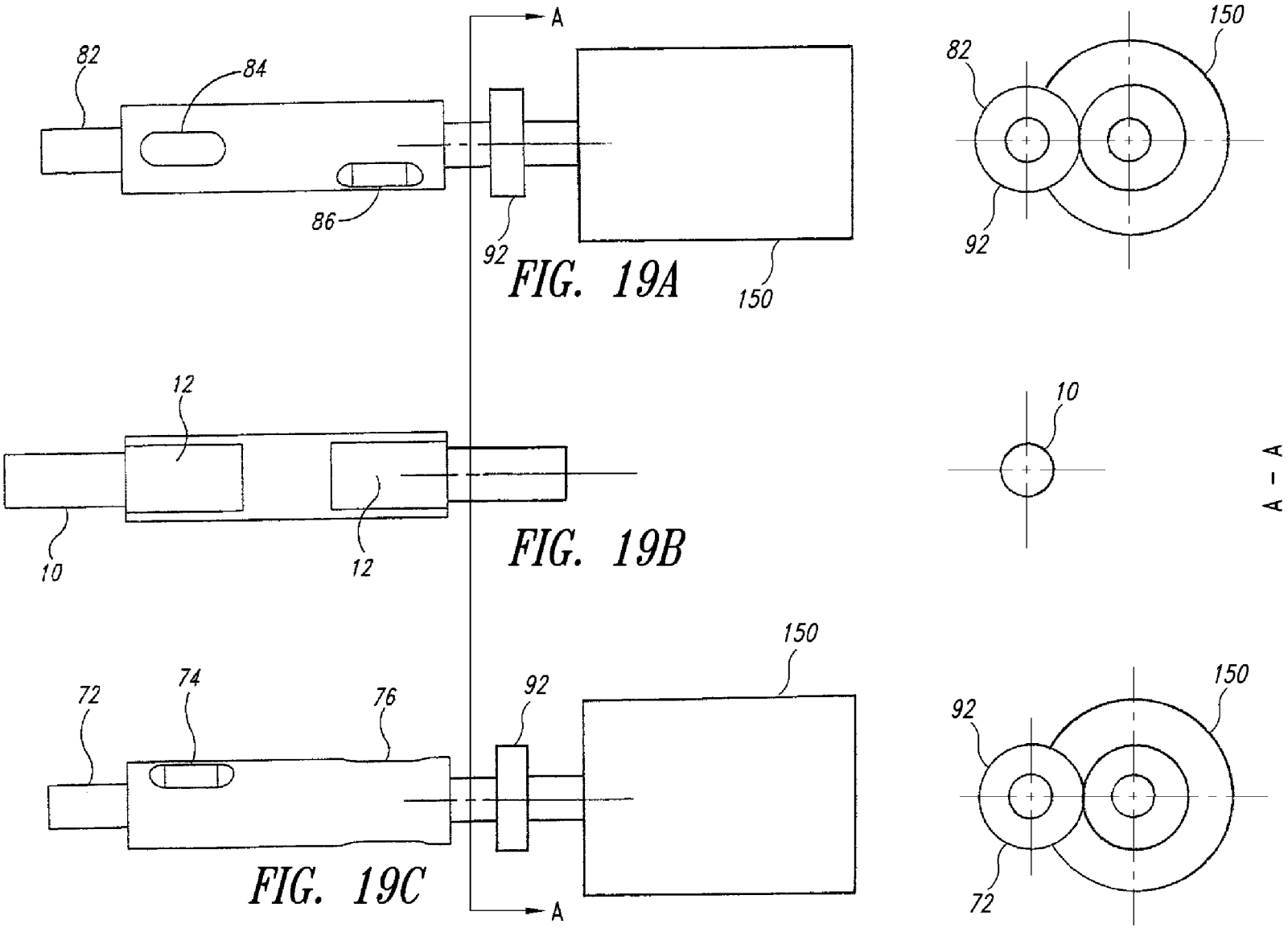
FIGS. 19A-19C illustrate a spur gear arrangement in combination with a stepper or servo motor.

In another embodiment as shown in FIGS. 19A-19C the spur gear 92 mounted on the intake valve shaft 72 and the spur gear 92 mounted on the exhaust valve shaft 82 mesh with other spur gears (not shown) mounted on the shaft of an electric stepper or servo motors 150. This allows the timing of the intermittent opening and closing of the intake and exhaust valves 74, 76, 84, 86 to be controlled electronically.

Figure 20A:
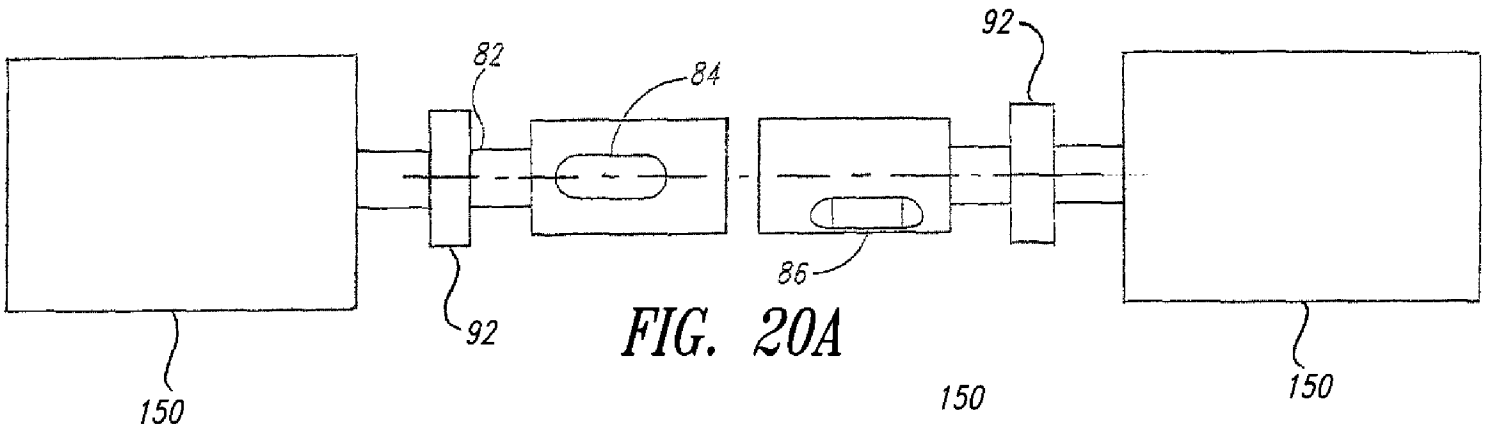
FIGS. 20A-20C illustrate yet another embodiment of actuation of intake and exhaust valves.
Figure 20B:
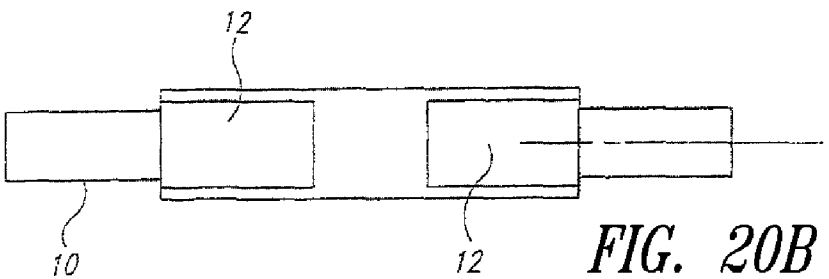
Figure 20C:
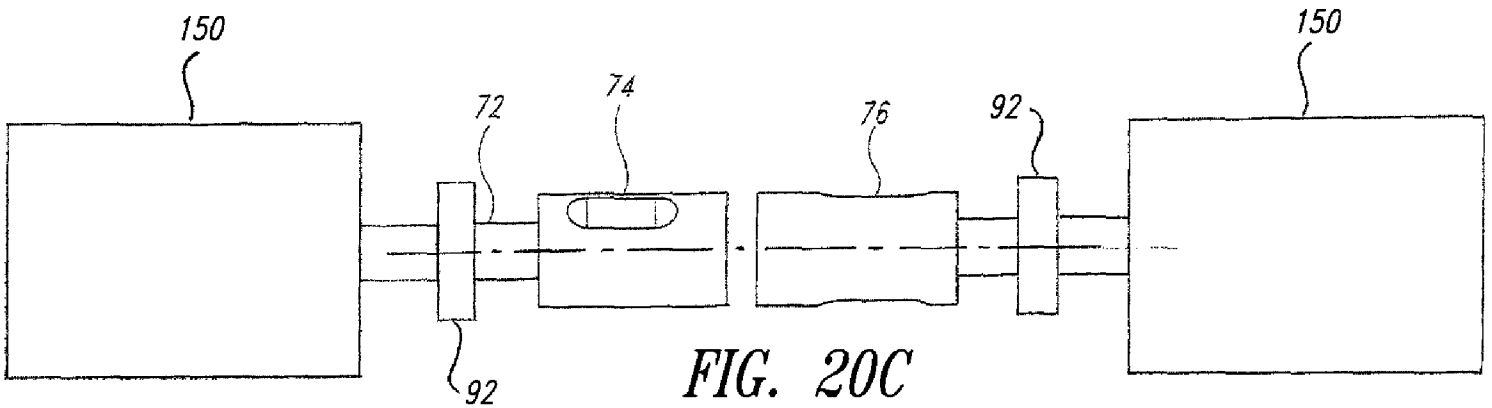

In another embodiment as shown in FIGS. 20A-20C the intake and exhaust valve shafts 72, 82 of a two rotor engine have the same center line but can be rotated independent of each other using electric stepper or servo motors 150. This allows for the timing of the intermittent opening and closing of the intake and exhaust valves 74, 76, 84, 86 to be rotated independent from each other and controlled electronically.

Figure 21:
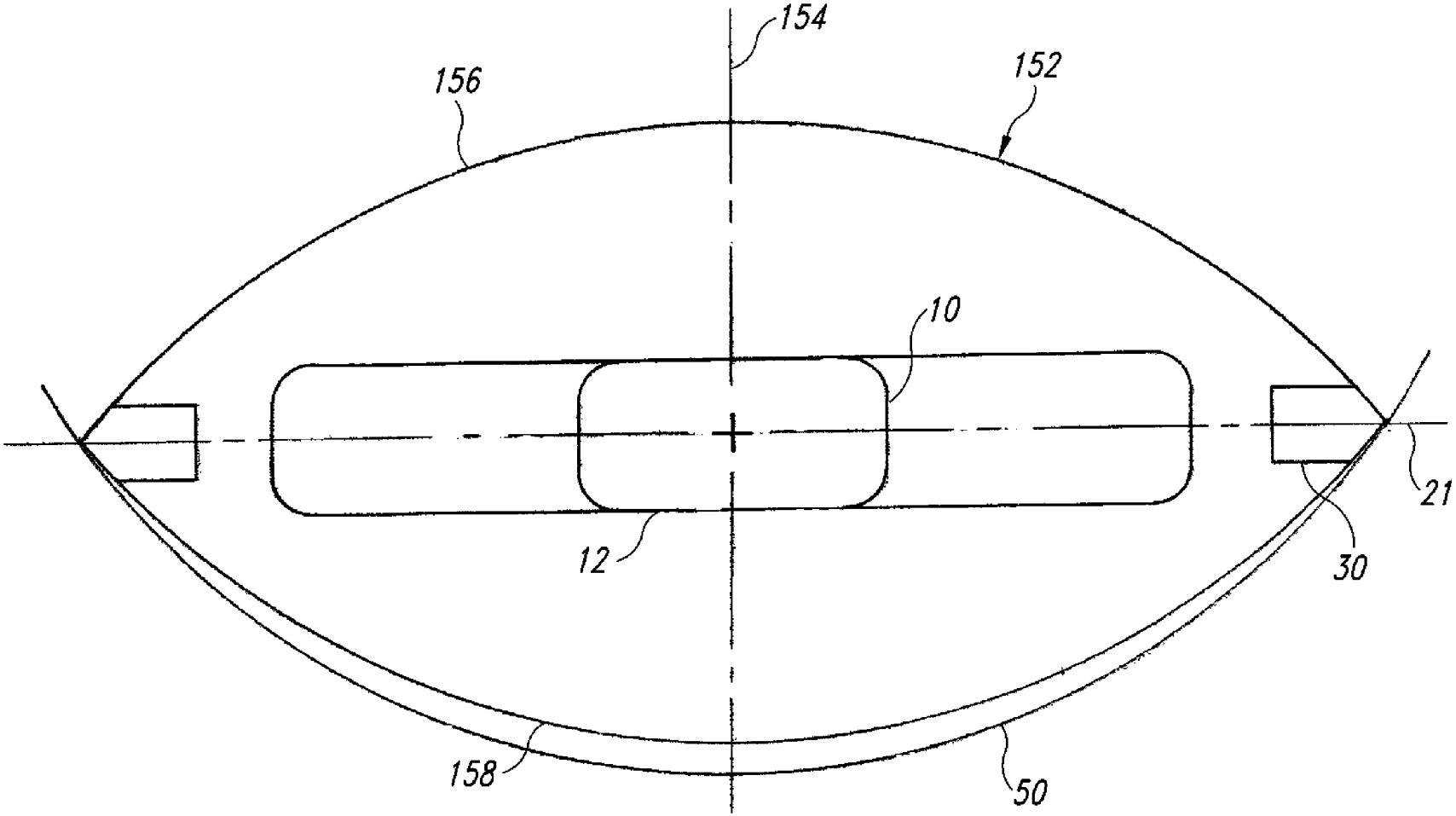
FIGS. 21-23 illustrate alternative embodiments of rotor configurations.

In another embodiment shown in FIG. 21, a rotor 152 can have flat top and bottom surfaces that curve symmetrically from the center lateral axis 154 to the tip of each rotor 152. The curve of the top and bottom surfaces 156, 158 can be any curve with a slightly larger diameter than that of the circular portion of the inner surface of the rotor housing 50. These curves will meet at the tip of the rotor seal 30 at the point the rotor seal 30 comes in contact with the inner surface of the rotor housing 50. This rotor shape will facilitate the clearing of exhaust fumes from the combustion chamber 52 during the exhaust phase of the engine's operating cycle by reducing the area of decreasing volume 58 in the rotor chamber to a minimum. This rotor shape also will increase the compression ratio of the engine for a given offset between the center of rotation of the rotor and the center of the circular portion of the inner surface of the rotor housing.

Figure 22:
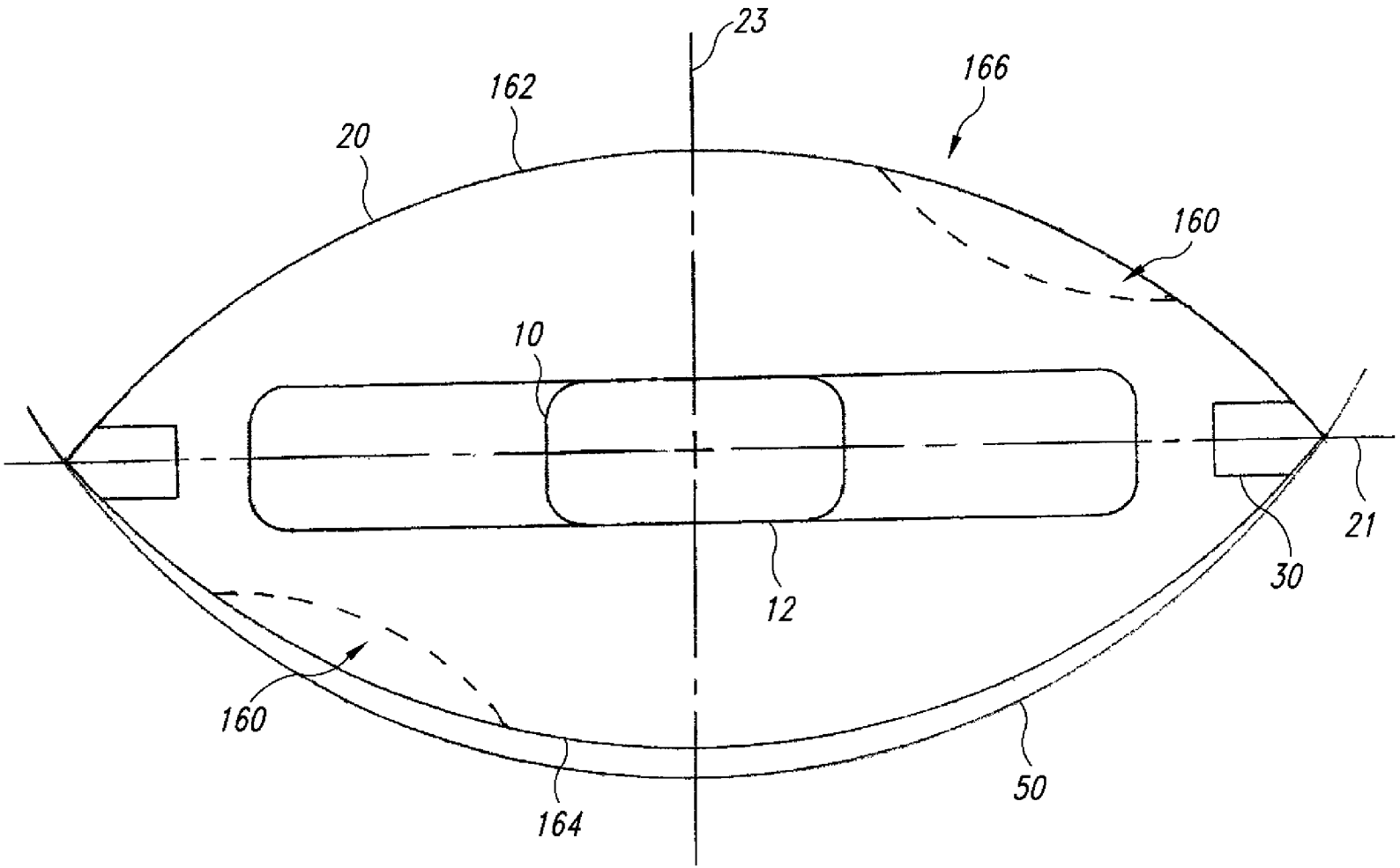

In another embodiment shown in FIG. 22 there can be a curved indentation or hollowed out area 160 in the top and bottom surface 162, 164 of the rotor 166. The air fuel mixture will be concentrated in this area when ignition takes place during the expansion phase of the engine's operating cycle, causing the combustion to be more complete.

Figure 23:
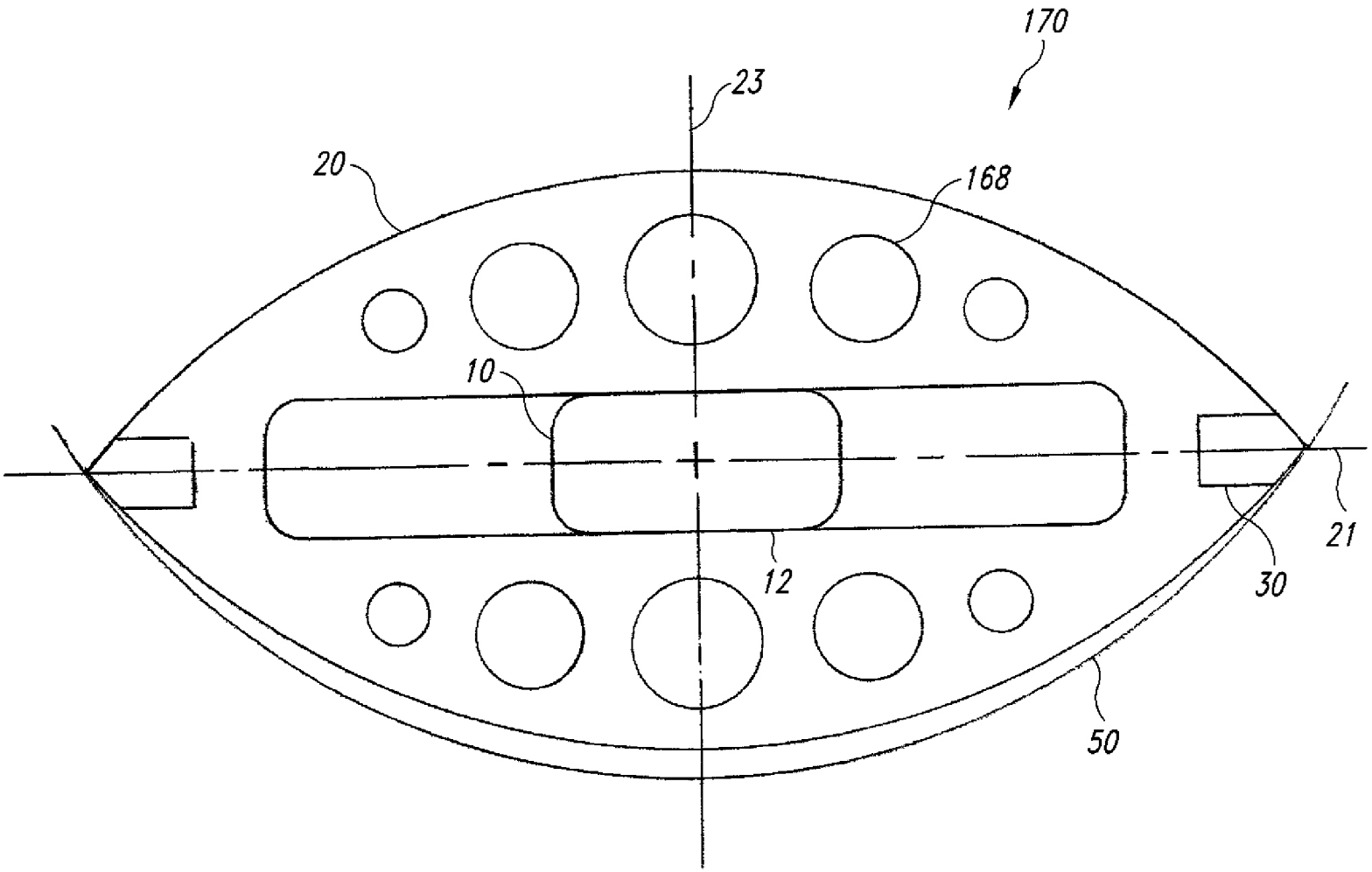

In FIG. 23 there is shown a number of horizontal holes 168 running from one side of the rotor 170 to the other side, which will decrease the weight of the rotor 170. The decrease in the weight of the rotor 170 will decrease the inertia of the rotor 170 which will make it more responsive to acceleration and deceleration as it rotates about the inside of the rotor housing 50. The decrease in the weight of the rotor 170 will decrease the unbalanced force generated by the unbalanced weight of the rotor 170 as it rotates about the inner surface of the rotor housing 50. This in turn will decrease the vibration of the engine.

Figure 24:
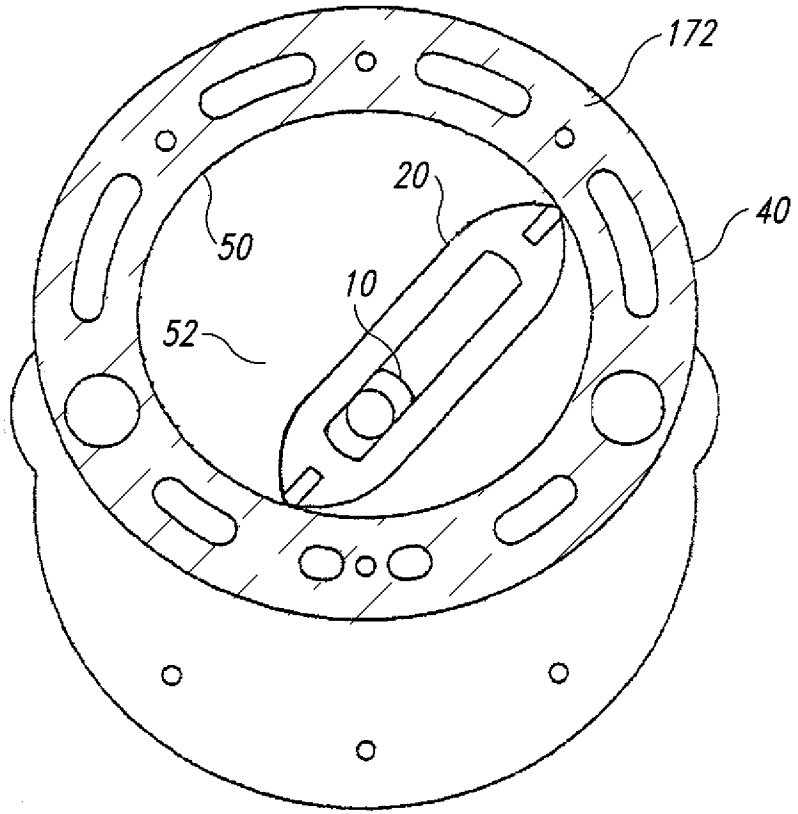
FIG. 24 is an illustration of a gasket applied to the housing.

As shown in FIG. 24, rotor housing end walls 60 and the rotor housing 40 will be sealed by using a gasket 172 similar to that of a head gasket of an internal combustion piston engine. This gasket 172 will allow coolant to circulate through the end wall of the rotor housing 60 and the rotor housing 40 and provide an air tight seal of the combustion chamber 52.

Figure 25:
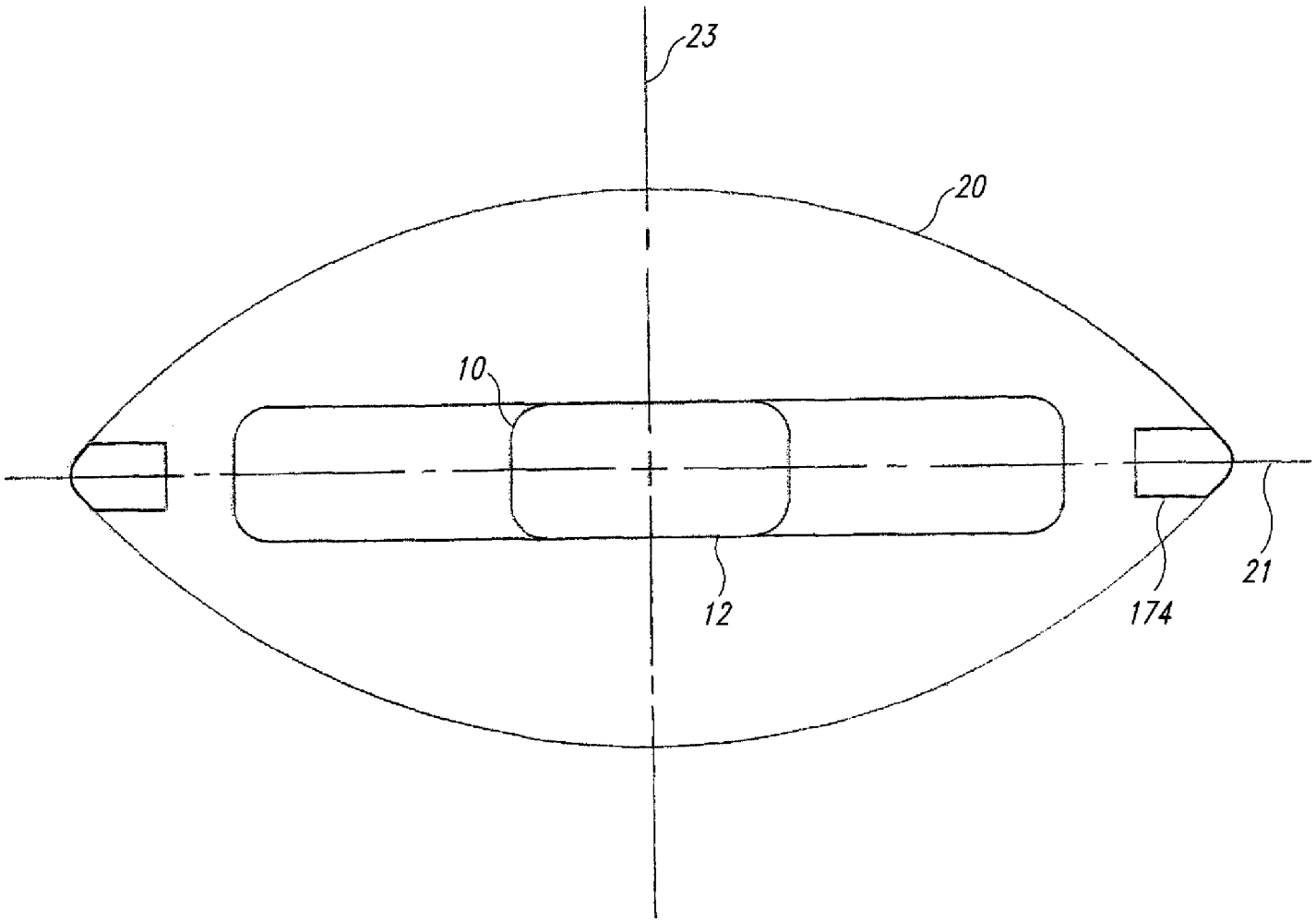
FIG. 25 is an alternative embodiment of a rotor in combination with a seal.

In another embodiment shown in FIG. 25, the seals 174 at the end of the rotor 20 can have a round or curved surface. The curved top and bottom surfaces of the rotor tip seals 30 will be symmetrical along the longitudinal axis 21 of the rotor 20. The curve of the top and bottom surfaces of the rotor end seals 174 would meet just beyond the point at which the rotor end seal 174 comes in contact with the inner surface of the rotor housing 50 if the end of the rotor seal 174 were not rounded to meet the inner surface of the rotor housing 50. This rounded or curved shape will cause the rotor end seals 174 to be rounded at the end which will reduce the wear on the end of the rotor seals 174 since the point at which the seals contact the inner surface of the rotor housing 50 will change as the rotor rotates about the inner surface of the rotor housing 50.

Figure 26:
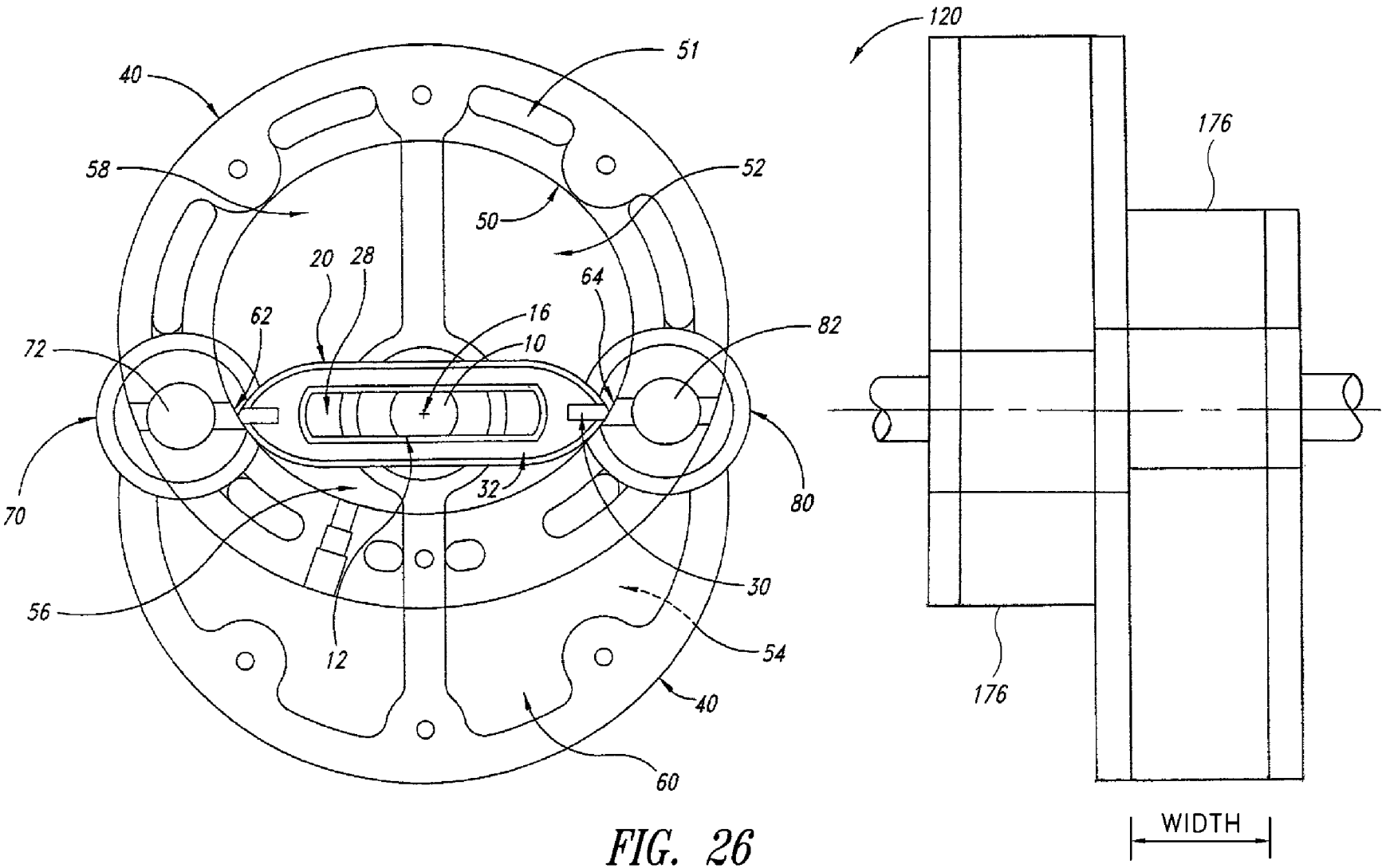
FIG. 26 illustrates an alternative configuration of a rotor housing and rotor formed in accordance with the present invention.

In another embodiment as shown in FIG. 26 the width 176 of the rotor housing 40 and rotor 20 inside the rotor housing 40 can be adjusted along with the shape of the inner surface of the rotor housing 50 to the achieve maximum performance of the rotary engine.

In the case of an engine with a supercharger chamber the width 176 of the rotor housing 40 and rotor 20 for the supercharger chamber would be made so that the supercharger chamber gives the engine maximum performance. The width 176 of the supercharger chamber is independent of the width 176 of the rotor 20 and rotor housing 40 of the engine.

In the case of an engine with a post-combustion chamber, the width 176 of the rotor housing 40 and rotor 20 inside the rotor housing 40 can be made so that the unburned fuel in the exhaust emissions are burned as completely as possible. The width 176 of the post-combustion chamber is independent of the width 176 of the rotor 20 and rotor housing 40 of the engine.

Figure 27:
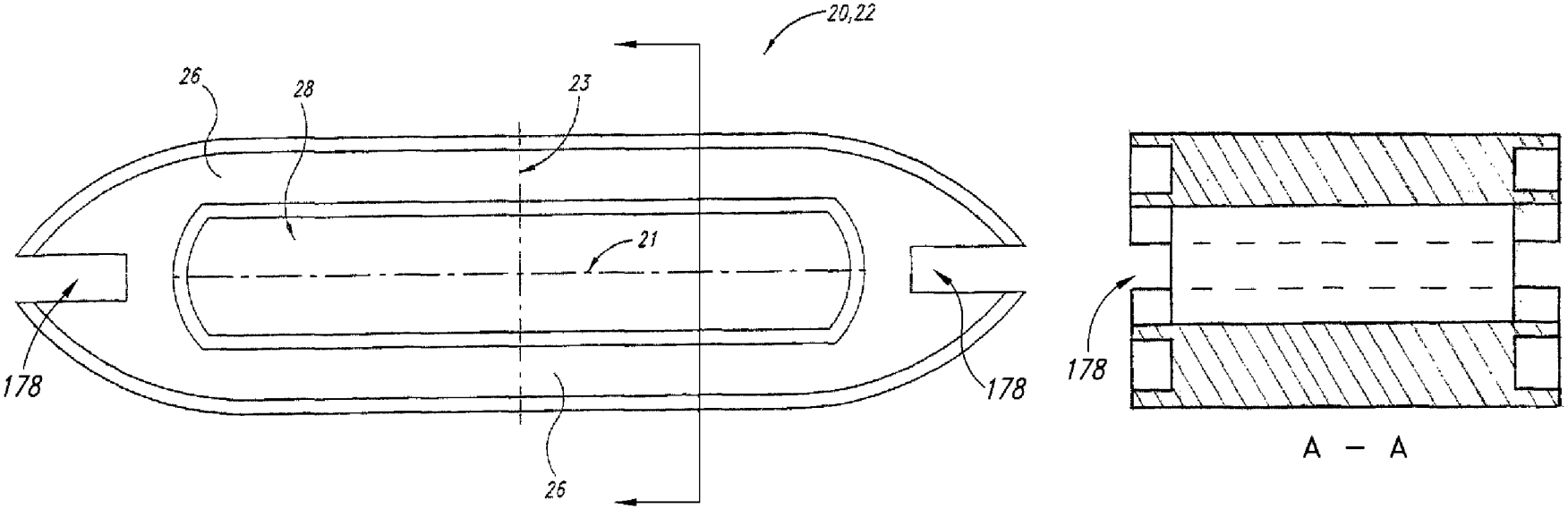
FIGS. 27-32 illustrate alternative embodiments of a rotor.
Figure 28:
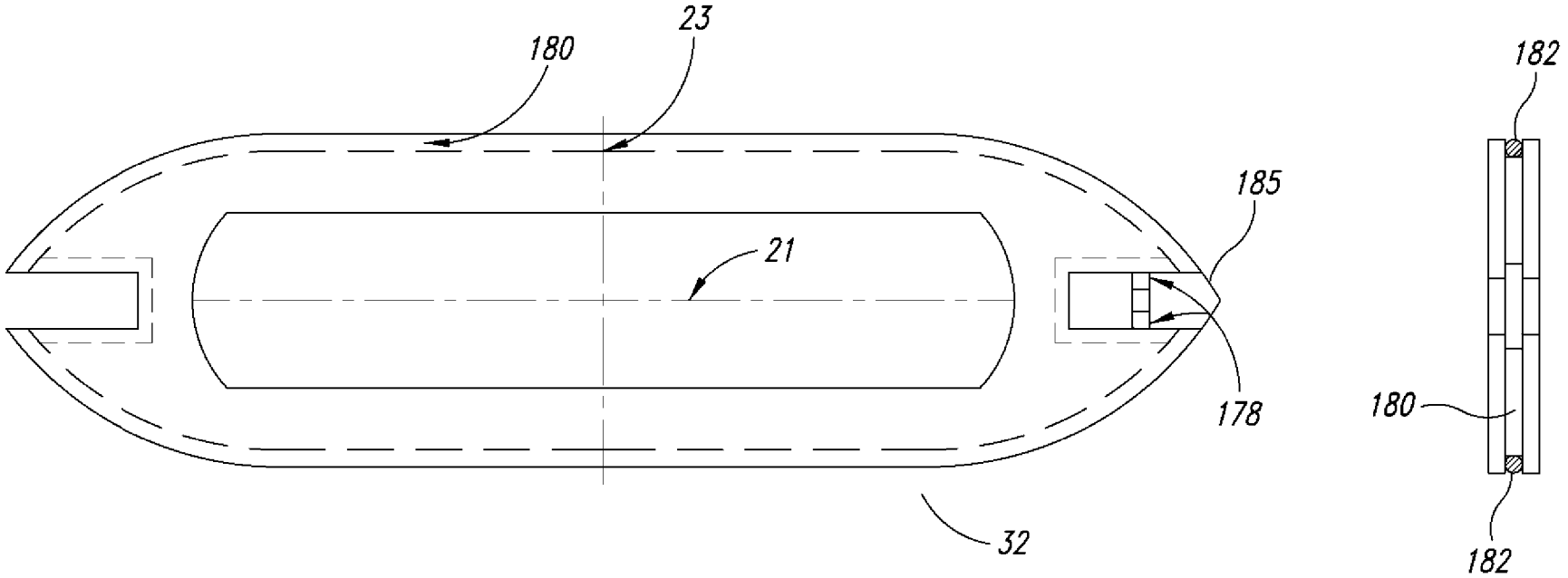

In another embodiment as shown in FIGS. 27 and 28, the rotor end seals and the rotor side seals have additional sealing material 182 mounted in enlarged grooves 178, 180, which are located around the perimeter of the rotor end seals 185 and the rotor side seals 184. This material 182 seals the small seam that may exist between the rotor 20 and the rotor end seals 182 and the rotor side seals 184. This material serves as a gasket to seal off the small areas around the rotor side seals 184 and rotor end seals 185 that may exist between the rotor 20 and the rotor end seals 185 and rotor side seals 184. This material will be elastic and made of heat and wear resistant material.

Figure 29:
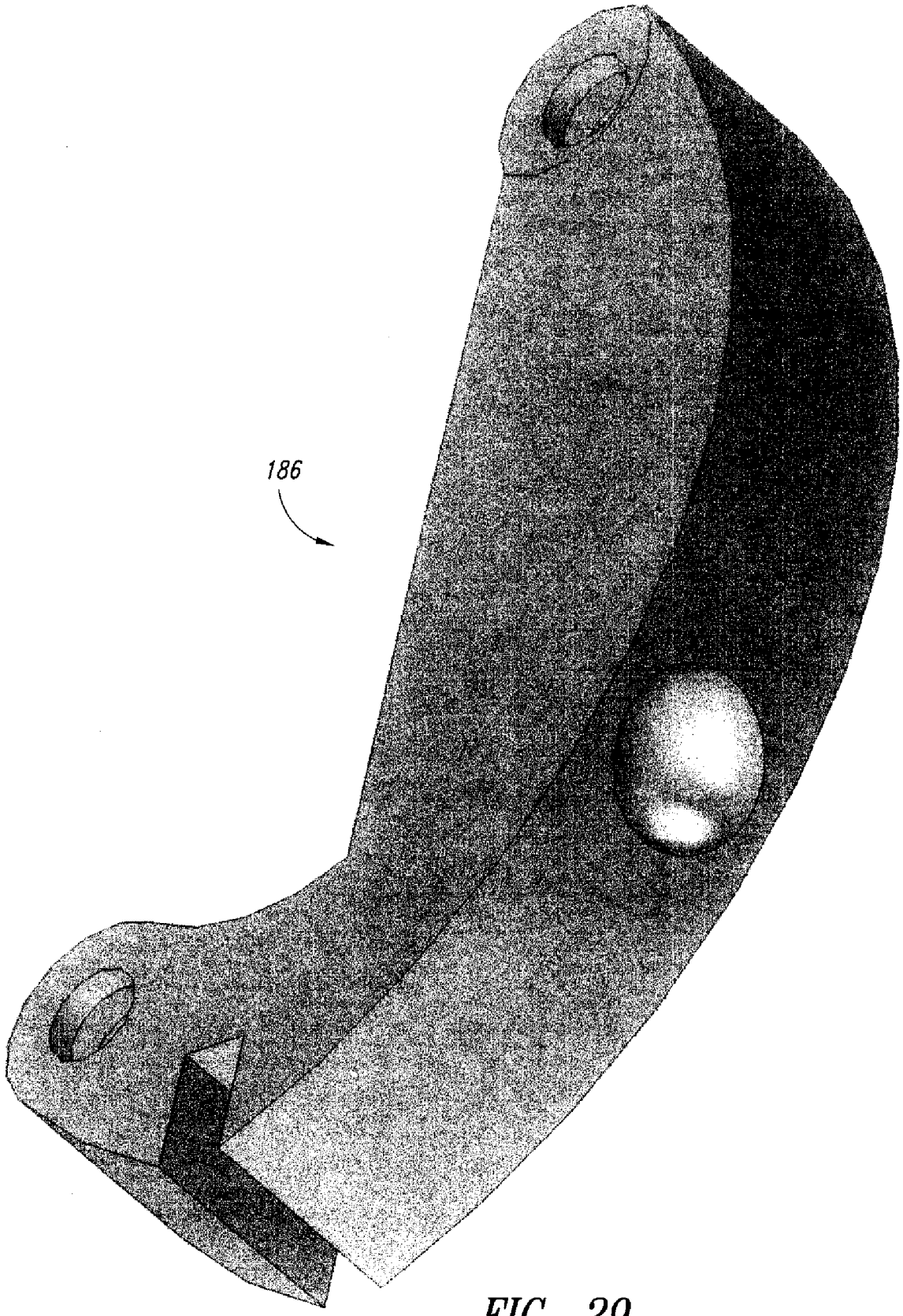
Figure 30:
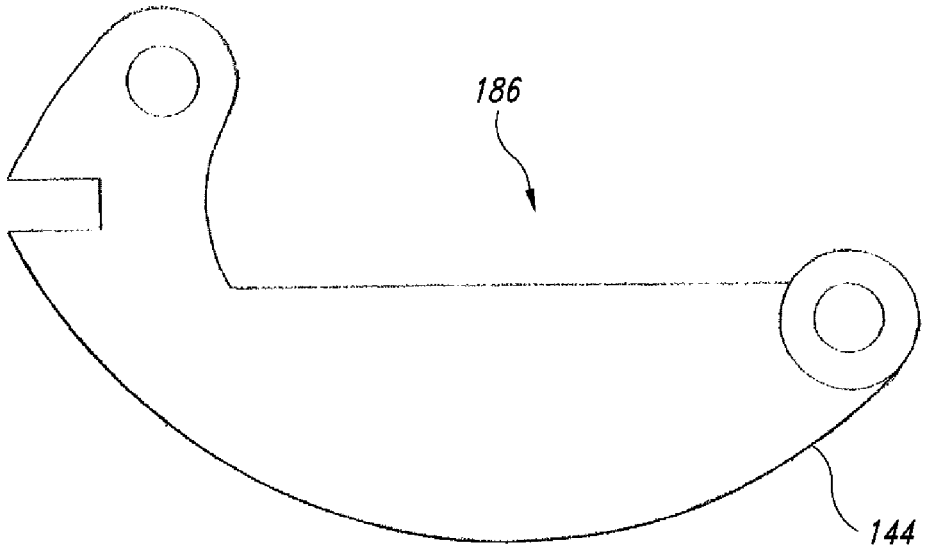
Figure 31:
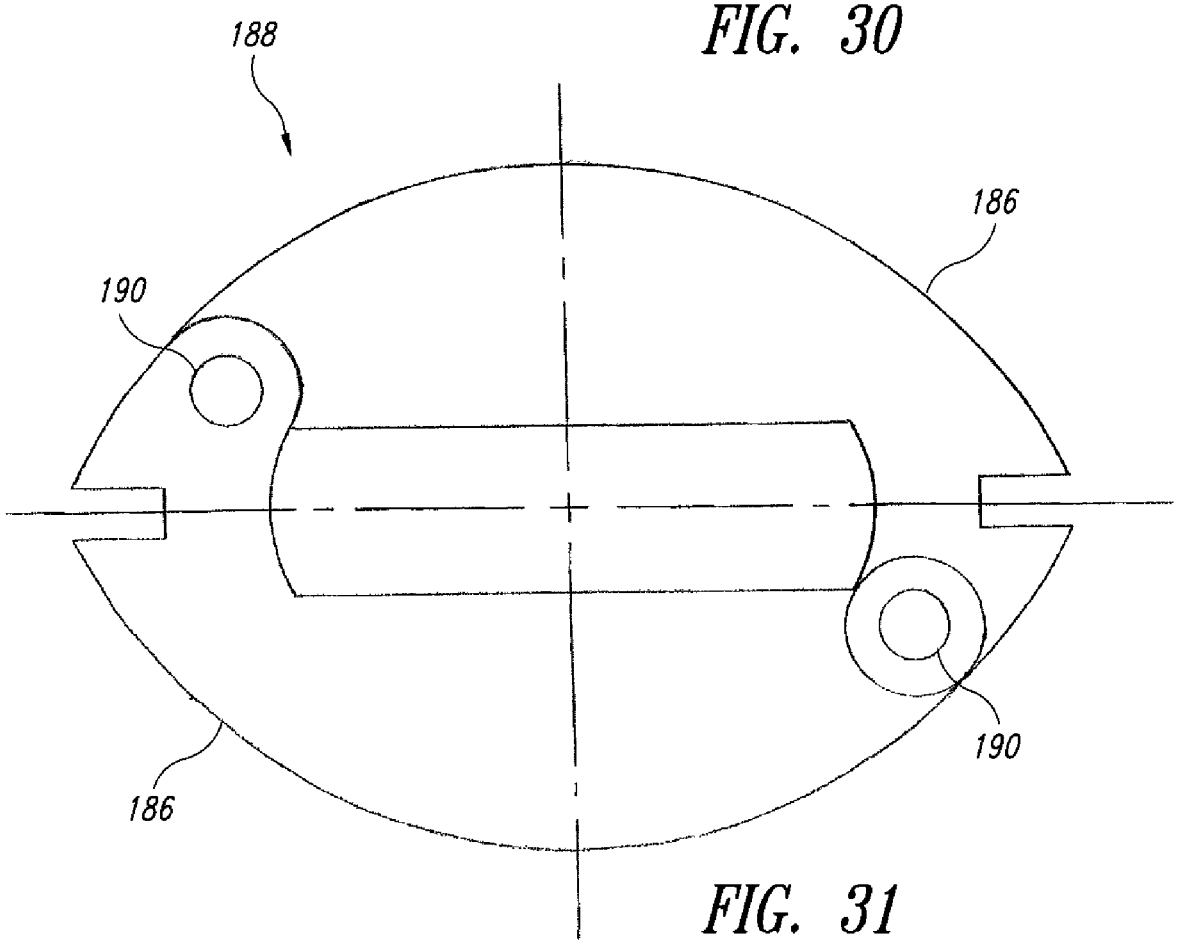

In another embodiment as shown in FIGS. 29-31, a rotor 188 can be split horizontally into two identical halves 186. This configuration allows the two halves 186 of the rotor 188 to be held together by either a pin or a bolt 190 running parallel to the rotor shaft. When installed, the split rotor 186 is mounted on and held together in the correct position on the flat surface 12 of the rotor shaft 10. This method of fabrication eliminates the need to slide the rotor over the rotor shaft 10 to get it into position for assembly of the engine. This allows for rotary engines to have any number of multiple pairs of rotors 188 mounted on round rotor shafts 10.

Figure 32:
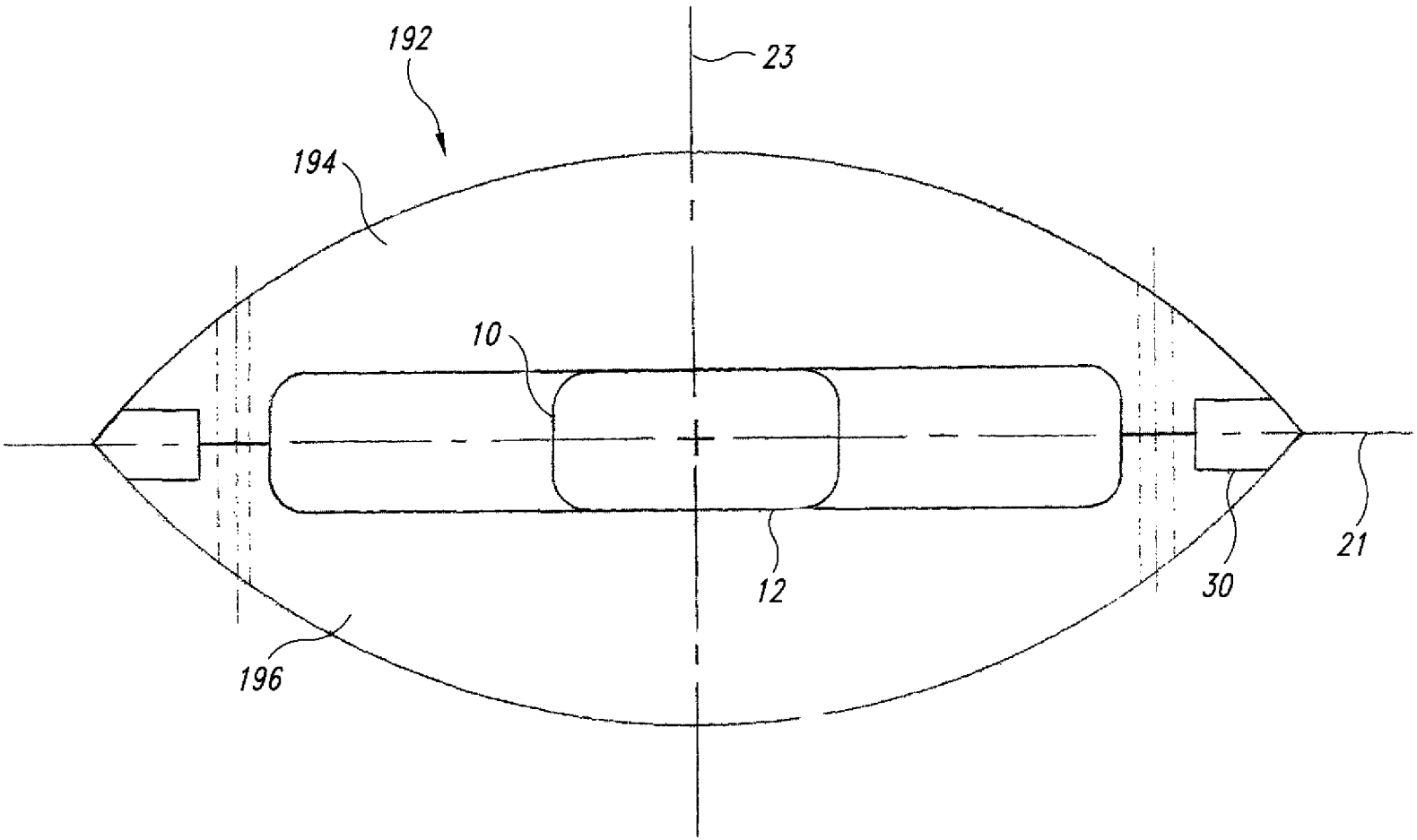
Figure 33:
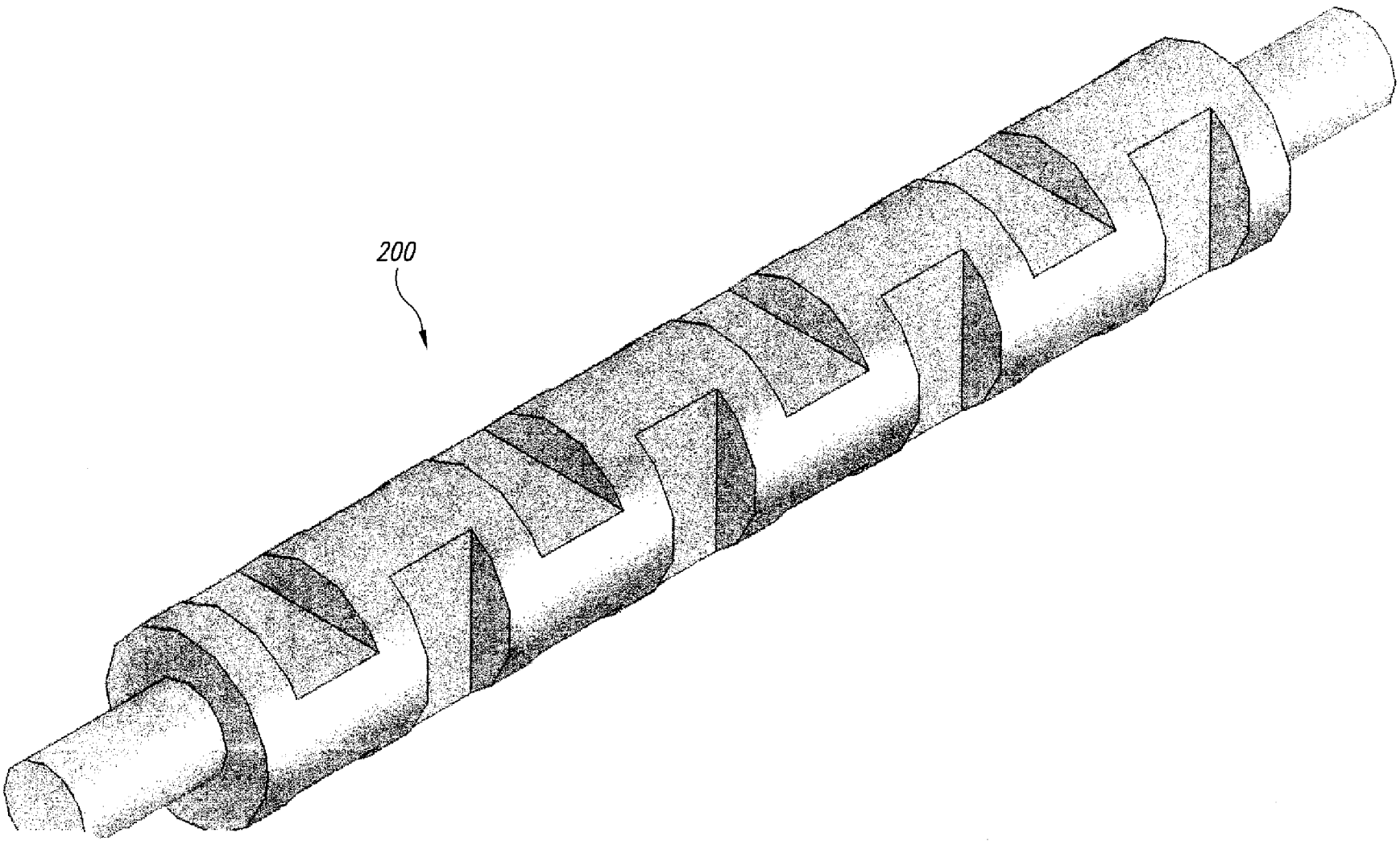
FIGS. 33 and 34A-34C illustrate alternative embodiments of a rotor shaft.
Figures 34A, 34B, 34C:
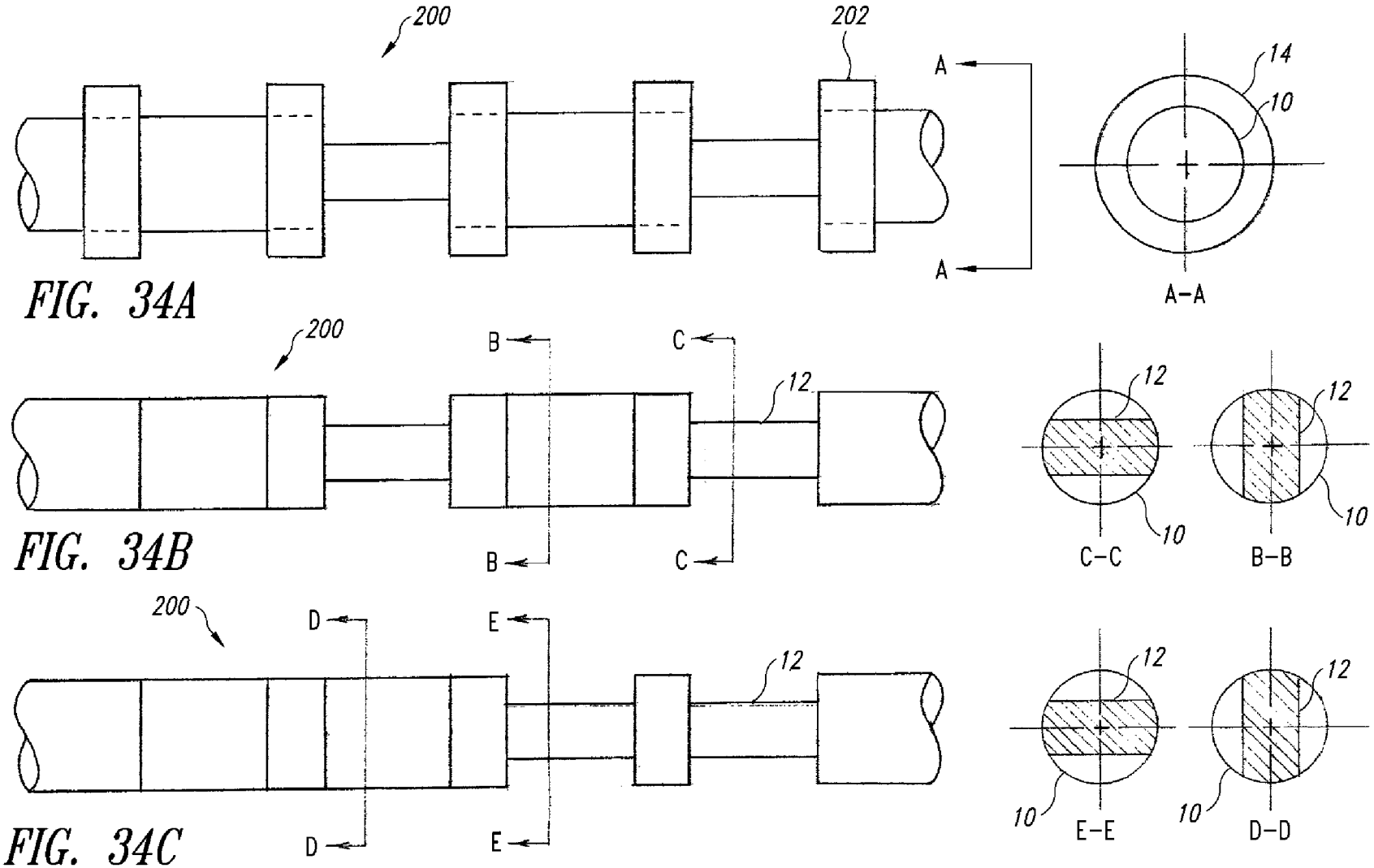

In another embodiment as shown in FIG. 32 a rotor 192 can be split horizontally into two identical halves 194, 196. This configuration allows the two halves 194, 196 of the rotor 192 to be held together by a set of screws or bolts running from one half of the split rotor 192 to the other half of the split rotor 192 perpendicular to the longitudinal axis 21 of the split rotor 192. When installed, the split rotor 192 is mounted on and held together in the correct position on the flat surface 12 of the rotor shaft 10. This method of fabrication allows rotary engines to have any number of multiple pairs of rotors 192 mounted on round rotor shafts 10.

In FIGS. 33 and 34A-34C, the rotor shaft 200 is a round shaft with flat surfaces 12 on opposite sides of the rotor shaft 200 where multiple pairs of rotors can be mounted by using the split rotors described above. As shown in FIG. 1, the flat surfaces 12 on the rotor shaft 10 accommodate the flat inner surfaces 12 of the rotors once they are mounted on the rotor shaft 10. Each pair of rotors 188, 192 are oriented at equal degree intervals from each other along the rotor shaft 200. Each pair of rotors can be next to each other on the rotor shaft 200 or they can be oriented so that a rotor of a different pair is located between them. The rotor shaft 200 can be mounted on a plurality of ball bearings or roller bearings 202 mounted in the end walls 60 of the rotor housing 40, shown in FIG. 1.

Figure 35:
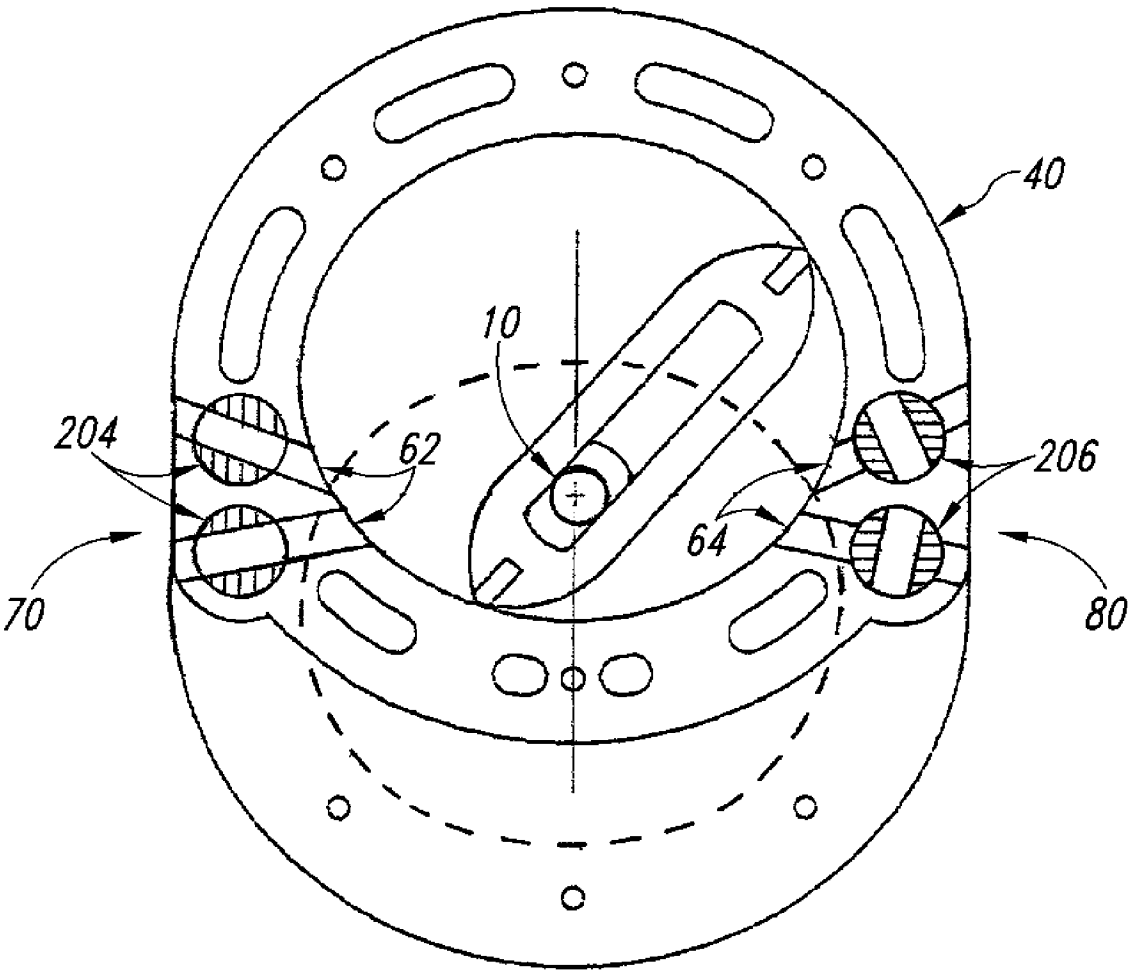
FIGS. 35 and 36A-36B illustrate alternative arrangements of valve shafts.

In another embodiment shown in FIG. 35, four rotary valve shafts are mounted on the rotor housing 40. The intake valves 204 and the exhaust valves 206 are located on opposite sides of the rotor housing 40. The four valve shafts increase the intake 204 and exhaust 206 valve cross sectional area. The additional valve area increases the amount of air and exhaust that can enter and exit the engine, which will result in better engine performance. Locating the input 62 and exhaust 64 ports above and below the horizontal plane of the rotor shaft 10 allows flexibility in the timing of the opening and closing of the input 204 and exhaust 206 valves for better engine performance.

Figure 36B:
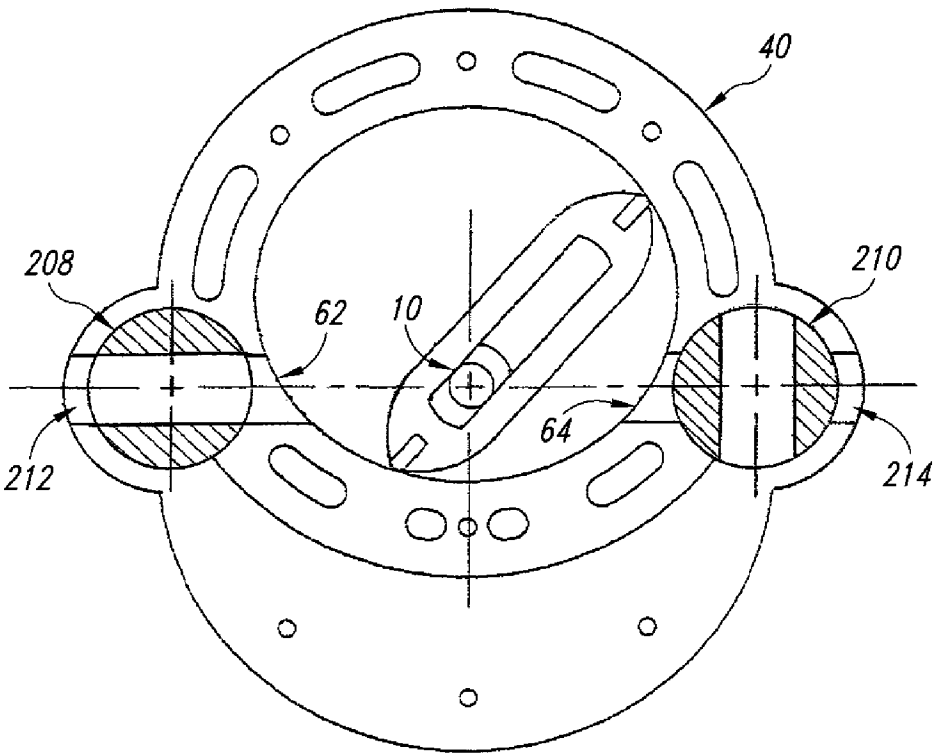
Figure 36A:
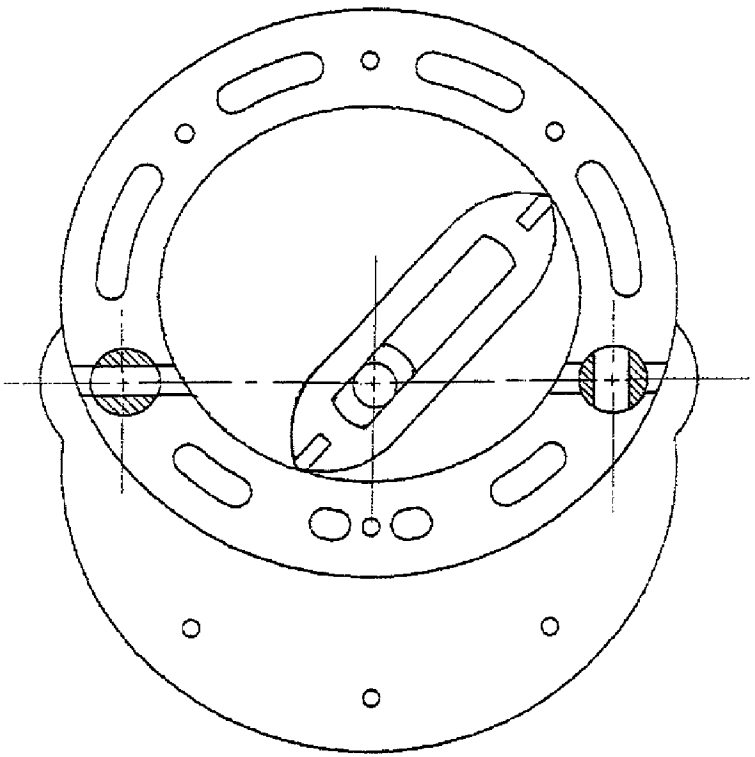

In the embodiment shown in FIGS. 36A-36B large rotary valve shafts 208, 210 are mounted on the rotor housing 40. The intake valve 212 and the exhaust valve 214 are located on opposite sides of the rotor housing 40 and in the same plane as the rotor shaft 10. The centerline of the intake valve port 62 and the centerline of the exhaust valve port 64 in the rotor housing 40 are located on a centerline passing through the rotor shaft 10. The large valve shafts 208, 210 increase the intake valve 212 and exhaust valve 214 cross sectional area. The additional valve area increases the amount of air and exhaust that can enter and exit the engine, which will result in better engine performance.

Figure 37:
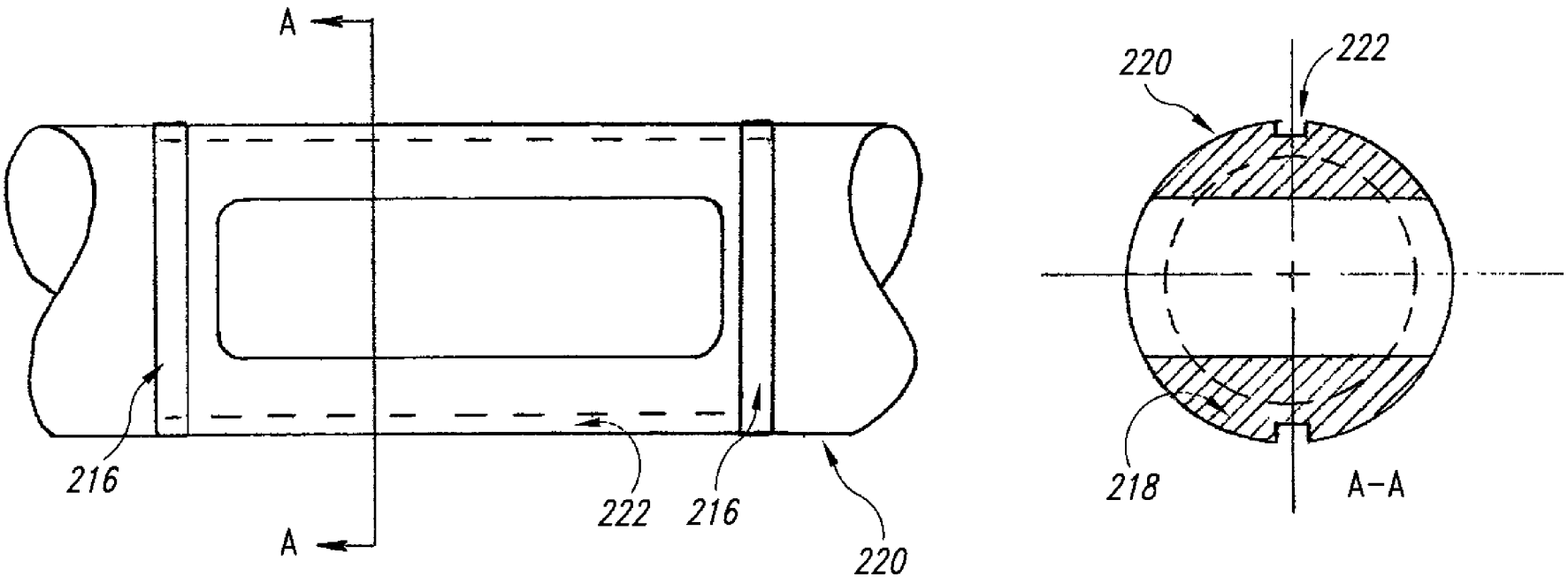
FIGS. 37-38 illustrate alternative valve seal configurations.

In FIG. 37 valve seals 216 are mounted in grooves 218 cut around the diameter of the valve shaft 220, which intersect channels 222 cut along the top and bottom of the valve shaft 220. Spring loaded valve seals 216 interlock with each other at the intersection of the grooves. There can be multiple grooves with seals in them to insure a tight seal around the valve shafts 220.

Figure 38:
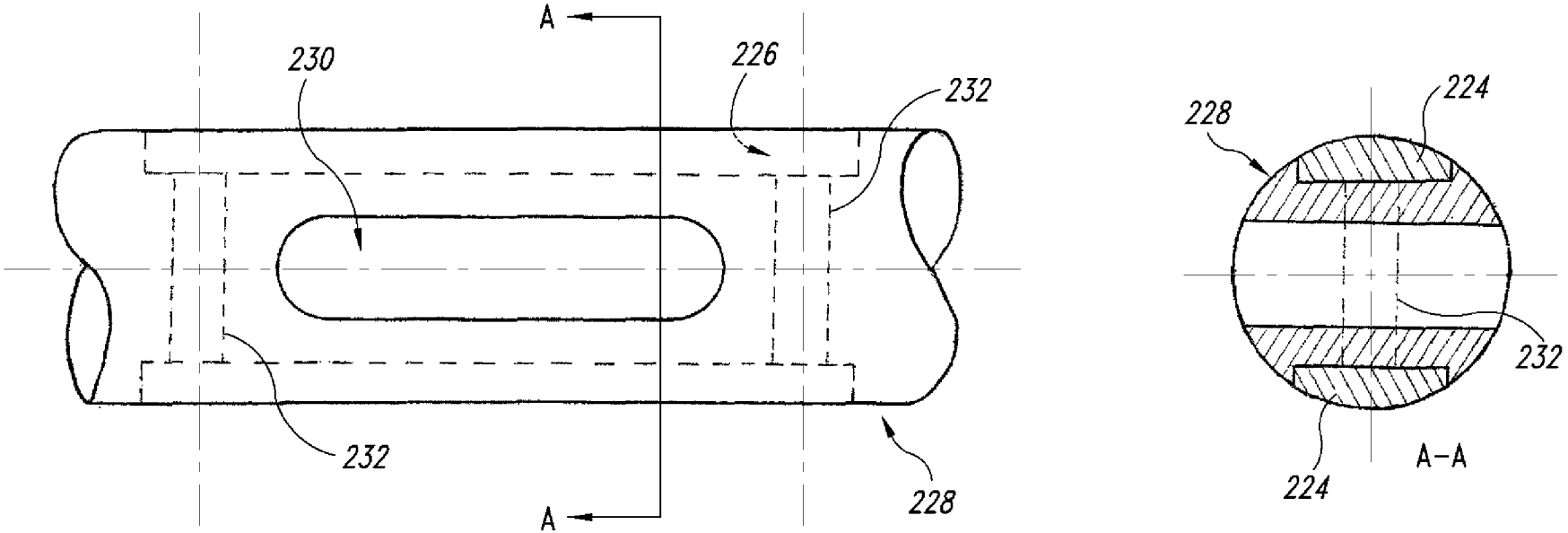

In another embodiment illustrated in FIG. 38 valve seals 224 are mounted in wide grooves 226 cut into the top and bottom of the valve shaft 228. These grooves 226 are oriented at ninety degrees from the valve openings 230 in the valve shaft 228. The valve seals 224, which are wider than the valve openings in the rotor housing 40, are mounted in these grooves 226 in the valve shaft 228. Valve seal springs (not shown) are mounted in holes passing through the valve shaft 228 on either side of the valve opening 230 and push against the valve seals 224 and hold them in place. These valve seals 224 can move in and out independently from the center of the valve shaft.

In another embodiment illustrated in FIG. 38, valve seals 224 are joined together with small shafts 232 mounted in holes passing through the valve shaft 228 on either side of the valve opening 230 so they move as a unit. As the pressure due to combustion or compression in the rotor chamber 52 increases to the point of moving the valve seal 224 away from the inside wall of the valve port 62, 64 thus overcoming the air tight seal of the valve 70, 80 the part of the valve seal 224 on the other side of the valve shaft 228 will be pressed against the out side wall of the valve port 62, 64 thus increasing the force of the seal 224 against that wall and preserving the airtight seal of the valve 70, 80. The force trying to move the valve seal 224 away from the inside wall of the valve port 62, 64 will be applied to the part of the valve seal 224 on the other side of the valve shaft 228 and will keep that part of the valve seal 224 from moving away from the outer wall of the valve port 62, 64.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A four-cycle internal combustion engine, comprising:

a case having at least two internal chambers, each chamber formed by at least one non-circular, constant-diameter circumscribing wall;

a single rotatable shaft extending through the at least two internal chambers and through the case in two opposing directions and rotatable about an axis of rotation that is coincident with a longitudinal axis of the shaft;

a first single rotor slidably mounted on the exterior of the shaft for translational movement to slide along an axis that is substantially perpendicular to the axis of rotation of the shaft as the rotor rotates within the chamber; and a second single rotor of the same size as the first rotor and slidably mounted on the exterior of the shaft for translational movement along an axis substantially perpendicular to the axis of rotation of the shaft and at 180 degrees to the axis of translational movement of the first single rotor and at least one second chamber oriented at 180 degrees to the at least one first chamber with respect to the axis of rotation of the shaft;

each rotor comprising a contour surface shaped to give a first segment of the rotor a larger surface area than a surface area of a corresponding second segment of the rotor to allow more force to act on the first segment of the rotor than on the second segment of the rotor during an expansion phase of an operating cycle of the system, the first segment of the rotor comprising a portion of the rotor from a lateral axis of the rotor to a first end, and the second segment of the rotor comprising a portion of the rotor on an opposite side of the lateral axis and extending from the lateral axis to a second end of the rotor.

2. The engine of claim 1 wherein each rotor comprises an elongate body having the opposing first and second ends that are in contact with the circumscribing wall when mounted on the shaft, the rotor body further comprising an elongate opening sized to be received over the shaft, and wherein the shaft comprises a mounting portion to engage the rotor body through the elongate opening to prevent relative rotation of the shaft and the rotor body while permitting translational movement of the rotor body relative to the shaft, and wherein each of the first and second segments are on the same side of a longitudinal axis of the rotor.

3. The engine of claim 1 wherein each circumscribing wall has a variable radius with respect to an origin point that is offset in the chamber, and the circumscribing wall having a constant diameter corresponding to a length of the rotor body, and wherein the shaft is mounted in the chamber with its longitudinal axis located at the origin point.

4. The engine of claim 1 wherein the case further comprises at least one intake port and at least one exhaust port, both ports in fluid communication with the internal chambers and at least one valve for each at least one intake port and at least one exhaust port for controlling fluid communication between each chamber and each of the at least one intake port and at least one exhaust port.

5. The engine of claim 1, further comprising an ignition system for igniting combustible mixtures in the chambers, the ignition system comprising means for timing the ignition of the combustible mixture to drive rotation of the rotors in the chambers.

6. A four-cycle combustion engine, comprising:

a housing having an outer surface and an inner surface, the inner surface defining first and second chambers having a constant diameter, varying radii about a center of origin, an intake valve port, and an exhaust valve port in each chamber;

a first single rotor having an axis of rotation, the at least one rotor having a body with an elongate opening, a first end, and a second end, wherein the first end and the second end are sealingly in contact with the inner surface of the housing in the first chamber;

a single rotor shaft extending through the outer surface of the housing in two opposing directions and the at least first and second chambers to rotate about an axis of rotation that is coincident with a longitudinal axis of the shaft, the rotor shaft slidably received in the elongate opening of the rotor, the first rotor, adapted to engage the exterior of the rotor shaft and rotate with the rotor shaft while sliding on the shaft along a longitudinal axis of the rotor;

a second single rotor of the same size as the first rotor and slidably mounted on the exterior of the shaft in the second chamber for translational movement along an axis substantially perpendicular to the axis of rotation of the shaft and at 180 degrees to the axis of translational movement of the first single rotor and at least one second chamber oriented at 180 degrees to the at least one first chamber with respect to the axis of rotation of the shaft;

at least first and second valves associated with each cylinder and engaged with the rotor shaft to rotate transverse openings in the first and second valves into and out of fluid communication with the respective valve ports that are in fluid communication with each chamber; and an intermittent gearing configuration using at least one continuously rotating spur gear driving two intermittently rotating gears to open and close the intake valve and the exhaust valve.

7. The combustion engine of claim 6 wherein the housing further comprises at least one cooling chamber, operable to hold and route a cooling agent, and formed between the inner surface and the outer surface.

8. The combustion engine of claim 6 wherein the elongate opening in each rotor is of a rectangular shape, the intake valve port and the exhaust valve port are diametrically opposed, and the rotor shaft further comprises at least two opposing flat surfaces, extending longitudinally along at least an exterior portion of the rotor shaft and at least partially in contact with a rotor surface adjacent the opening in the rotors.

9. A four-cycle rotary combustion system, comprising:

a housing having at least two end walls, an outer surface, and an inner surface, the inner surface defining first and second chambers, each chamber having an intake port and an exhaust port;

an intake valve and an exhaust valve associated with each intake port and exhaust port, respectively;

a first shaft having at least two opposing exterior flat surfaces, a first end, and a second end connected to the first end by a single shaft, the first shaft extending through the first and second chambers and through the outer surface of the housing in two opposing locations to rotate about an axis of rotation that is coincident with a longitudinal axis of the first shaft;

means for igniting fuel and air received in each chamber from the intake valve port;

first and second single rotors, each rotor having a first end, a second end, and an elongate opening adapted to slidably received over the exterior flat surfaces at opposing ends of the first shaft in the first and second chambers, respectively, wherein each rotor is operable to rotate in response to the combustive force, and the first end and the second end of the rotor are rotatably and sealingly in contact with the inner surface of the housing;

a second shaft having at least two openings extending laterally there through, a first end, and a second end, wherein the first end is rotatably mounted on an end wall of the housing, and the openings are positionable adjacent the intake valves of each chamber;

a third shaft having at least two openings extending laterally there through, a first end, and a second end, wherein the first end is rotatably mounted on an end wall of the housing and the openings are positionable adjacent the exhaust valves of each chamber;

a gearing configuration to rotate the second shaft and the third shaft to periodically align the openings in the second shaft and the third shaft with the intake ports and the exhaust ports, respectively, in an alternating pattern so that each chamber is periodically in fluid communication with a source of fuel and air and alternatingly in fluid communication with the exhaust ports; and wherein each rotor comprises a contour surface shaped to give a first segment of the rotor contour surface a larger surface area than a surface area of a corresponding contour surface of a second segment of the rotor that is adjacent the first segment to allow more force to act on the first segment of the rotor than on the second segment of the rotor during an expansion phase of an operating cycle of the system.

10. The rotary combustion system of claim 9 wherein the means for rotating the second shaft and the third shaft comprise:

a first gear having a plurality of toothed members spaced on a periphery of the first gear and a coupling device positioned in a center of rotation of the first gear, the coupling device coupling the first gear to the second end of the first shaft;

a second gear having a plurality of toothed members spaced on a periphery of the second gear and a coupling device positioned in a center of rotation of the second gear, the coupling device coupling the second gear to the second end of the second shaft;

a third gear having a plurality of toothed members spaced on a periphery of the third gear and a coupling device positioned in a center of rotation of the third gear, the coupling device coupling the third gear to the second end of the third shaft; wherein, the toothed members of the first gear rotatably engage the toothed members of the second gear and the toothed members of the third gear on opposing sides of the first gear, and the first gear operable to rotate the second gear and the third gear upon receiving rotational energy from the first shaft, generated by the rotation of the rotor in response to the combustive force.

11. The rotary combustion system of claim 10 wherein the toothed members on the first gear, the second gear, and the third gear are configured to intermittently rotate the second gear and the third gear, selectively controlling a duration of alignment of openings in the chamber with the openings in the second shaft and the opening in third shaft.

12. The rotary combustion system of claim 9, wherein the gearing configuration comprises an intermittent gearing configuration using at least one rotating spur gears driving two intermittently rotating gears to open and close the intake valve and the exhaust valve.

13. The rotary combustion system of claim 12, wherein the gearing configuration comprises two continuously rotating single toothed spur gears driving the two intermittently rotating gears to open and close the intake valve and the exhaust valve.

14. The rotary combustion system of claim 9, wherein each rotor contour surface curves from a center lateral axis to a tip, the curve of the contour surfaces having a slightly larger diameter than a diameter of a circular portion of an inner surface of the chamber in which the rotor is mounted, the contour surfaces meeting at the tip of the rotor where a rotor seal is mounted, the rotor seal structured to come in contact with the inner surface of the chamber.

15. The rotary combustion system of claim 9, wherein the contour surfaces comprise a curved indentation that forms a concave area to concentrate an air fuel mixture when ignition takes place during an expansion phase of the engine's operating cycle, causing the combustion to be more complete.

16. The engine of claim 6, wherein the gearing configuration comprises two continuously rotating single toothed spur gears driving the two intermittently rotating gears to open and close the intake valve and the exhaust valve.

17. The engine of claim 6, wherein each rotor comprises a contour surface shaped to give a first segment of the rotor a larger surface area than a surface area of a corresponding second segment of the rotor that is adjacent the first segment to allow more force to act on the first segment of the rotor than on the second segment of the rotor during an expansion phase of an operating cycle of the system.

18. The engine of claim 6, wherein each rotor contour surface curves from a center lateral axis to a tip, the curve of the contour surfaces having a slightly larger diameter than a diameter of a circular portion of an inner surface of the chamber in which the rotor is mounted, the contour surfaces meeting at the tip of the rotor where a rotor seal is mounted, the rotor seal structured to come in contact with the inner surface of the chamber.

19. The engine of claim 6, wherein the contour surfaces comprise a curved indentation that forms a concave area to concentrate an air fuel mixture when ignition takes place during an expansion phase of the engine's operating cycle, causing the combustion to be more complete.

20. The engine of claim 1, wherein each rotor contour surface curves from a center lateral axis to a tip, the curve of the contour surfaces having a larger diameter than a diameter of a circular portion of an inner surface of the chamber in which the rotor is mounted, the contour surfaces meeting at the tip of the rotor where a rotor seal is mounted, the rotor seal structured to come in contact with the inner surface of the chamber.

21. The engine of claim 1, wherein the contour surfaces comprise a curved indentation that forms a concave area to concentrate an air fuel mixture when ignition takes place during an expansion phase of the engine's operating cycle, causing the combustion to be more complete.

* * * * *